US008191713B2

(12) United States Patent
Calendrille, Jr.

(10) Patent No.: US 8,191,713 B2
(45) Date of Patent: Jun. 5, 2012

(54) INTERACTIVE DISPLAY PACKAGING FOR A TOY FIGURE

(75) Inventor: John Calendrille, Jr., Coram, NY (US)

(73) Assignee: Mattel, Inc., El Segundo, CA (US)

( * ) Notice: Subject to any disclaimer, the term of this patent is extended or adjusted under 35 U.S.C. 154(b) by 644 days.

(21) Appl. No.: 11/776,283

(22) Filed: Jul. 11, 2007

(65) Prior Publication Data

US 2008/0029418 A1 Feb. 7, 2008

Related U.S. Application Data

(60) Provisional application No. 60/819,632, filed on Jul. 11, 2006.

(51) Int. Cl.
*B65D 25/00* (2006.01)

(52) U.S. Cl. ..... 206/767; 206/736; 446/75; 446/314; 446/383

(58) Field of Classification Search ..... 206/736, 206/767, 768, 737; 446/314, 360, 72, 75, 446/71, 268, 383; 40/421, 491
See application file for complete search history.

(56) References Cited

U.S. PATENT DOCUMENTS

| | | | | | |
|---|---|---|---|---|---|
| 1,041,573 | A | * | 10/1912 | Gould | 40/486 |
| 1,188,864 | A | * | 6/1916 | Webber | 446/366 |
| 1,262,998 | A | * | 4/1918 | Sumner | 446/152 |
| 1,323,669 | A | * | 12/1919 | Allstatter | 446/366 |
| 2,334,008 | A | | 11/1943 | Ischinger | |
| 2,573,625 | A | * | 10/1951 | Swart | 40/422 |
| 3,392,823 | A | | 7/1968 | Green et al. | |
| 4,026,066 | A | | 5/1977 | Reiner et al. | |
| 4,234,079 | A | | 11/1980 | Otake | |
| 4,263,741 | A | * | 4/1981 | Koshiya | 446/291 |
| 4,407,083 | A | * | 10/1983 | Hartgrave | 40/414 |
| 4,412,399 | A | * | 11/1983 | Abe et al. | 446/359 |
| 4,536,164 | A | * | 8/1985 | Klawitter | 446/143 |

(Continued)

FOREIGN PATENT DOCUMENTS

WO 9907609 2/1999

OTHER PUBLICATIONS

PCT International Search Report for PCT/US2007/073255 (Dec. 28, 2007)—3 pages.

*Primary Examiner* — J. Gregory Pickett
*Assistant Examiner* — Blaine Neway
(74) *Attorney, Agent, or Firm* — Edell, Shapiro & Finnan, LLC

(57) ABSTRACT

The present invention is directed to a display package for a toy product (e.g., a toy figure), the package facilitating demonstration of the toy's animated features, or provides animation features to a toy that otherwise would not otherwise not be animated. The display package of the present invention defines an enclosure that houses the toy. The display package includes a manually-manipulated animation mechanism that repositions the toy within the enclosure and/or moves a portion of the toy from a first display position to a second display position (and vice versa). For example, the display package may include a movable segment to which the toy is connected. An actuator drives the movable segment, which, in turn, generates motion in the toy (motion which simulates animation of the toy).

23 Claims, 48 Drawing Sheets

U.S. PATENT DOCUMENTS

| | | | | |
|---|---|---|---|---|
| 5,172,806 | A | 12/1992 | Mickelberg | |
| 5,188,222 | A | 2/1993 | Pierce | |
| 5,289,916 | A | 3/1994 | Mickelberg | |
| 5,494,252 | A | 2/1996 | Amit et al. | |
| 5,636,741 | A | 6/1997 | O'Keefe | |
| 5,718,335 | A | 2/1998 | Boudreaux | |
| 5,919,074 | A | 7/1999 | Honda | |
| 6,409,568 | B1 * | 6/2002 | Sogaard et al. | 446/73 |
| 6,727,826 | B1 | 4/2004 | Ki Kwan et al. | |
| 6,749,437 | B2 | 6/2004 | Chan | |
| 7,318,766 | B2 * | 1/2008 | Marine et al. | 446/359 |
| 7,603,802 | B2 * | 10/2009 | Oudekerk et al. | 40/375 |
| 2002/0106624 | A1 | 8/2002 | Chan | |
| 2006/0118461 | A1 | 6/2006 | Calendrille, Jr. et al. | |

* cited by examiner

INTERACTIVE DISPLAY PACKAGING FOR A TOY FIGURE

CROSS REFERENCE TO RELATED APPLICATION

This application is a nonprovisional of U.S. Provisional Application No. 60/819,632 entitled "Interactive Display Packaging for a Toy Figure" and filed on 11 Jul. 2006, the disclosure of which is hereby incorporated by reference in its entirety.

BACKGROUND OF THE INVENTION

The rapid and virtually unlimited development of toy products within the marketplace has been, to some extent, paced by a similar dramatic rate of development in product packaging and product packaging techniques. Thus, as toy products have become increasingly entertaining, amusing, colorful, complex, and sophisticated, packaging for toy products has endeavored to provide evermore interesting, amusing, informative, and attractive displays. In addition to the basic function of toy product packaging (i.e., to provide protection and convenient shipping and product handling containers for the products), designers of toy packaging expend great effort making the packaging for toy products colorful, interesting, eye-catching, informative, and entertaining. One of the more significant improvements provided by designers of toy packaging may be generally described as "try-me" feature packaging. This type of packaging acquired its name from its capability of displaying and supporting the product in a manner which allows and encourages a potential purchaser to try the product without removing it from the packaging. Thus, the objective of "try-me" packaging is to provide an environment in which the product may be tried or demonstrated, without compromising the integrity of the packaging or its protection and retention of the product.

SUMMARY OF THE INVENTION

Accordingly, the present invention is directed toward a display package for a toy figure (e.g., a doll) or similar product that facilitates demonstration of the toy's animated features, or provides animation features to a toy that would not otherwise not be animated. The display package defines an enclosure that houses the toy. In one embodiment, the display package includes a front wall, a rear wall, and side walls that enclose the toy. In another embodiment, the display package includes a blister-type package with an inner shell and outer shell. The inner shell supports the toy, and is configured to move relative to an outer shell. The display package may further include and animation mechanism operable to drive the toy (or a portion of the toy) from a first position (relative to the display package) to a second position. A manually engaged actuator may selectively drive the animation mechanism. In operation, the actuator may be selectively operated to move the toy from a first display position to a second display position, and vice versa. Thus, the entire toy may be repositioned within the enclosure and/or the toy may include a portion capable of moving from a first position to a figure position (and vice versa).

BRIEF DESCRIPTION OF THE DRAWINGS

FIGS. 10-12 illustrate the animation mechanism of the display packaging of FIG. 9, with: FIG. 10 illustrating a close-up front view of the upper portion of the display packaging of FIG. 9, showing a sliding actuator; FIG. 11 illustrating an internal rear view of the display packaging of FIG. 9, showing a rotatable gear attached to the sliding actuator.

Like reference numerals have been used to identify like elements throughout this disclosure.

DETAILED DESCRIPTION OF THE INVENTION

The present invention is directed toward display packaging for a toy (e.g., a doll) or similar product and, in particular, display packaging that facilitates demonstration of an action feature of the toy or similar product. The toy, housed in display packaging in accordance with the present invention, may include a portion moveable from a first position to a second position, and vice versa. Alternatively or in addition to, the entire toy may be moved within the display packaging. The display packaging of the present invention is an enclosure for the toy, where the enclosure may have a rear package portion, a front package portion, side package portions extending between the rear package portion and the front package portion, and a bottom package portion extending between the rear package portion and the front package portion. The display package may also include a display panel mounted to the enclosure. The toy (or portions thereof) may be coupled to the display packaging such that engaging an actuator activates an animation mechanism within the packaging, generating movement in the toy.

Figure 1A:
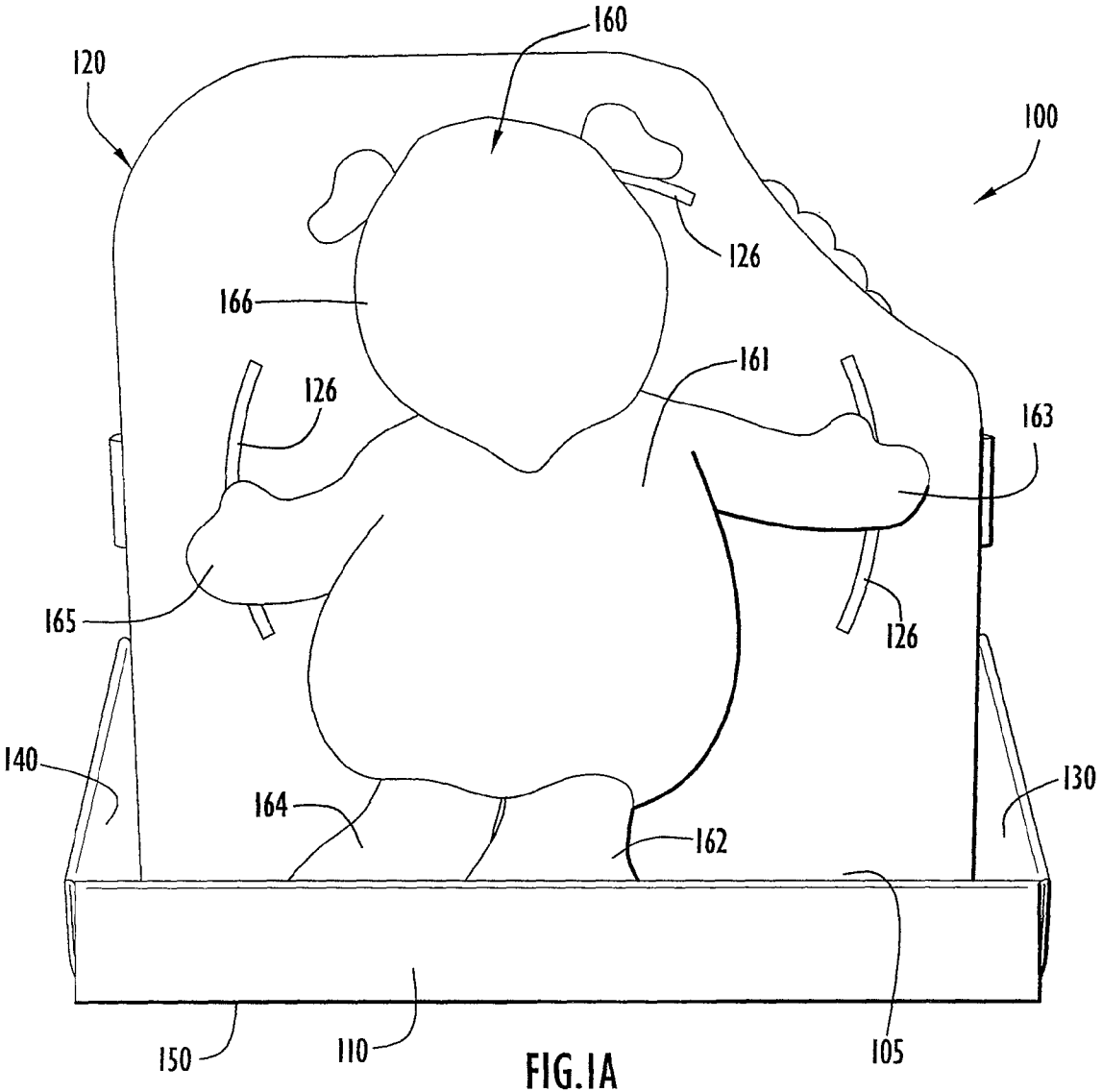
FIG. 1A illustrates a front view of display packaging in accordance with an embodiment of the present invention.
Figure 1B:
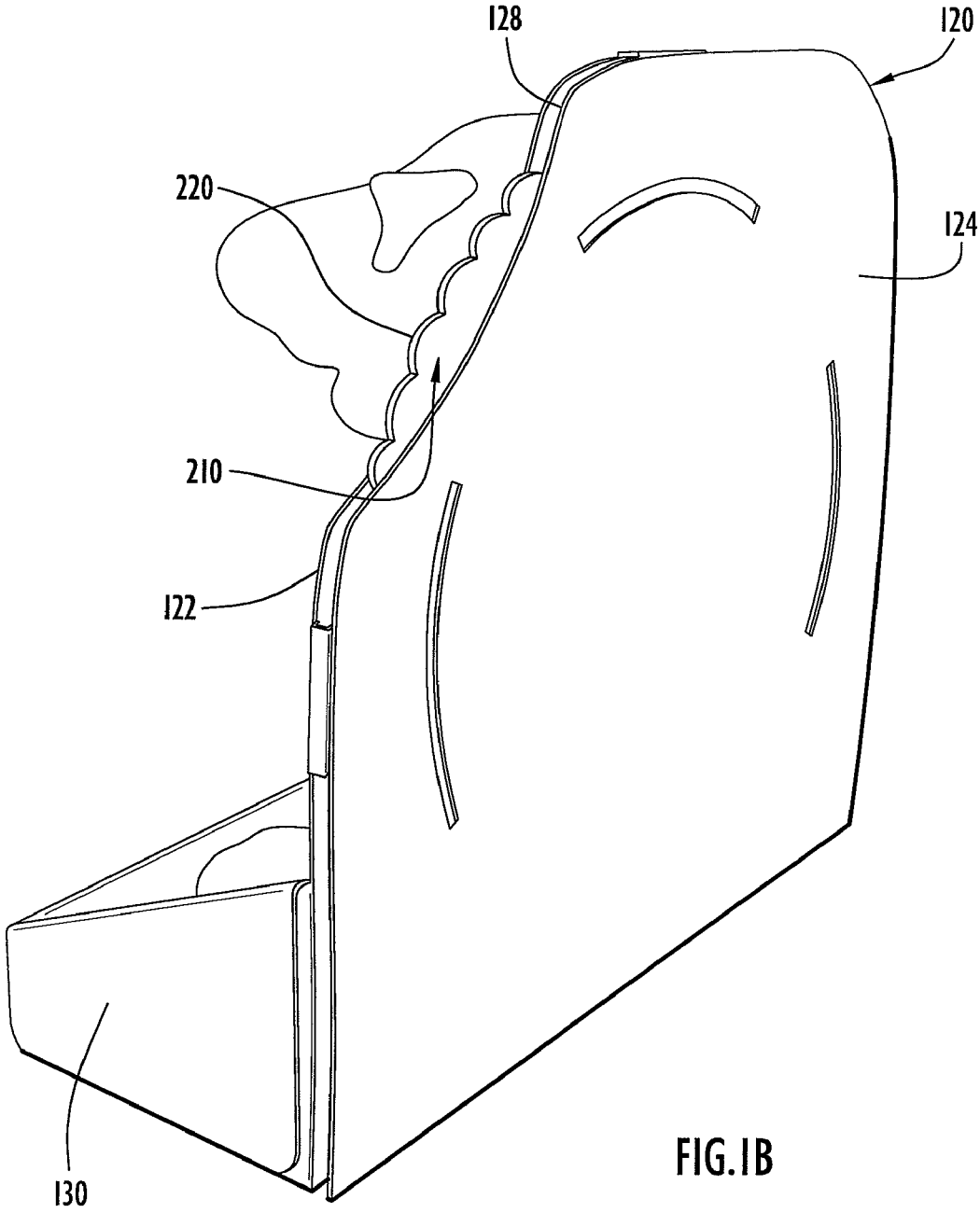
FIG. 1B illustrates a rear side view of the display packaging of FIG. 1A.

FIGS. 1A and 1B are front and rear/side perspective views, respectively, of the display package or packaging 100 in accordance with an embodiment of the present invention. The display package 100 may include a front package portion 110, a rear package portion 120, a first side package portion 130 (also called a first side wall) extending between the rear package portion 120 and the front package portion 110, a second side package portion 140 (also called a second side wall) extending between the rear package portion 120 and the front package portion 110, and a bottom package portion or floor 150 extending between the rear package portion 120 and the front package portion 110 and positioned along the bottom edge of the first and second side walls 130, 140. These portions 110, 120, 130, 140, 150 define an enclosure into which a toy 160 (e.g., a doll or similar product) may be housed. An opening 105 may be provided within the front package portion 110 and/or side package portions 130, 140 to permit a user to access the toy 160. Optionally, a transparent section (not illustrated) may be provided over the opening 105 to permit a user to view the product 160 within the display package 100, while preventing a user from reaching into the display package 100. The toy 160 may be secured to the display package 100 proximate the rear package portion 120 as described below. The display package 100 and any of its components may be readily fabricated of paper board, cardboard, flake board, plastic, metal, wood, or any other conventional packaging material.

As discussed above, a toy 160 is housed within the display package 100. The toy may be a figure such as a doll. The toy 160 may be motorized, or may be manually animated. For example, the toy 160 may include at least one moveable portion animated by a drive mechanism within the toy. Referring to the embodiment of FIG. 1, the toy 160 may include a figure having a torso 161, a first moveable portion (first leg/foot) 162, a second moveable portion (first arm/hand) 163, a third movable portion (second leg/foot) 164, a fourth movable portion (second arm/hand) 165, and a fifth movable portion (head/heck) 166. If present, the drive mechanism (not illustrated) may repeatedly move any of the torso 161 and/or movable portions 162-166 from a first position to a second position and vice versa. Alternatively, the shell of the toy 160 may comprise flexible or plush material permitting a user to bend the torso 161 and/or movable portions 162-166 from the first position to a second position (and vice versa).

Figure 2:
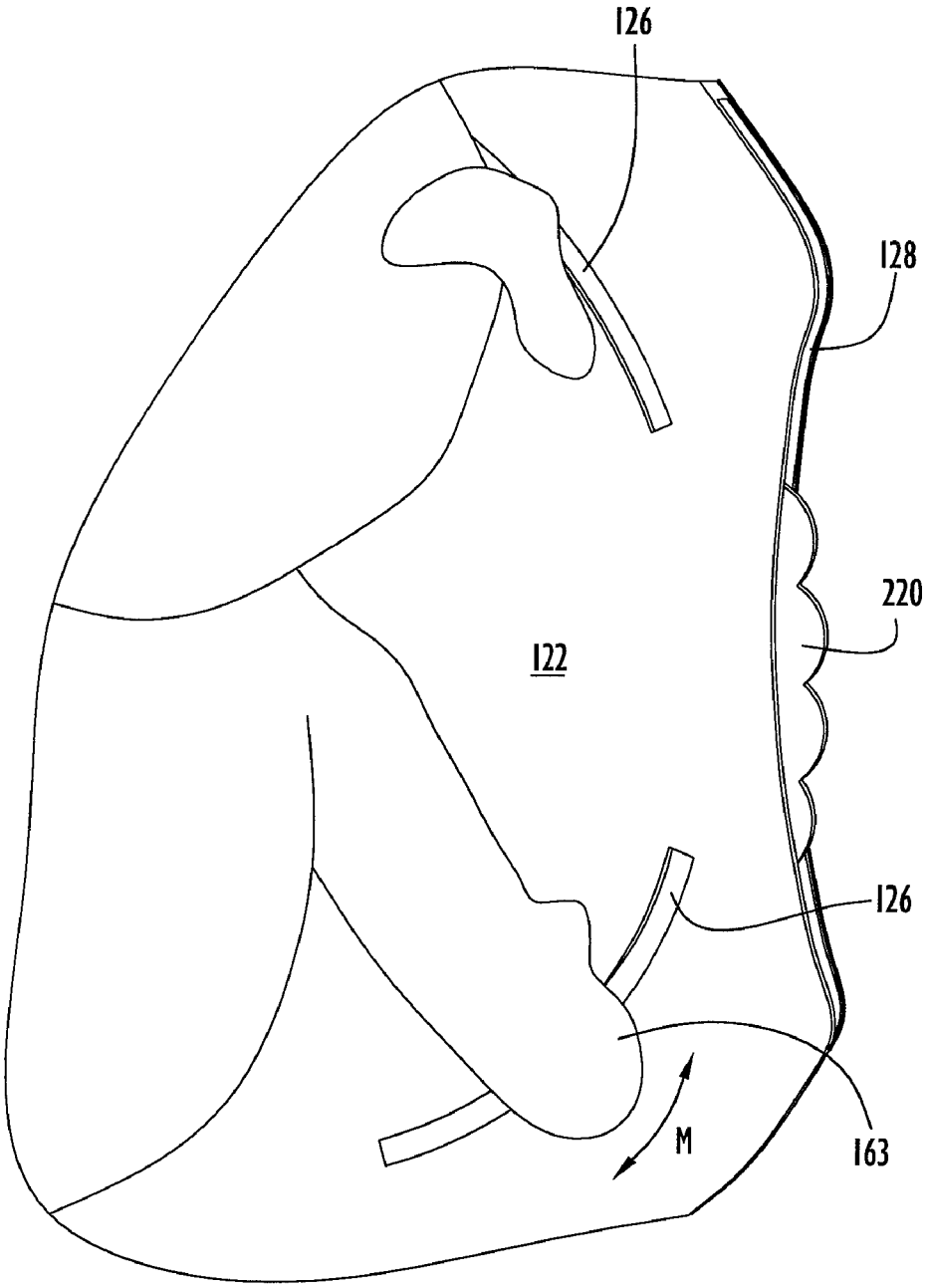
FIG. 2 illustrates a close-up front view of the upper portion of the display packaging of FIG. 1A, showing guide slots.

The display package 100 of the present invention may contain a manually-manipulated animation mechanism operable to drive the toy 160 from a first display position and a second display position, and vice versa. Specifically, the rear package portion 120 may house a disk assembly 200 that may be selectively engaged to generate movement in the toy 160. As best illustrated in FIG. 1B, the rear portion 120 may include an interior wall 122, an exterior wall 124, and a rotatable disk 210 captured between the walls 122, 124. FIG. 2 illustrates a close-up front view of the upper portion of the display package 100. The interior 122 and/or exterior 124 walls may include one or more guide slots 126, as well as a cut-out portion 128 partially exposing an engagement/gripping portion 220 of the disk 210. The slots 126 not only expose portions of the disk 210, but also define tracks that guide the movement of the toy 160 upon actuation of the manually-manipulated animation mechanism. As illustrated in the embodiment of FIG. 2, each slot 126 may be generally elongated, slightly curved, and angularly spaced about the interior wall 122. It is important to note that the slots 126 may include other dimensions/shapes than those illustrated in FIG. 2. Similarly, the number and positioning of the slots 126 are not limited to that which is illustrated herein. In the embodiment of FIG. 1A, the interior wall 122 includes a three slots—a first slot 126 located proximate the second movable toy portion 163 (first arm/hand), a second slot 126 located proximate the fourth movable toy portion 165 (second arm/hand), and a third slot 126 located proximate the fifth movable toy portion toy 166 (head/neck). Each associated movable portion 163, 165, 166 may be connected to the disk 210 through each slot 126 using conventional fasteners (tie straps, etc.). Thus, as the disk 210 moves, each movable portion moves along its respective slot 126 (indicated by arrow M in FIG. 2).

Figure 3A:
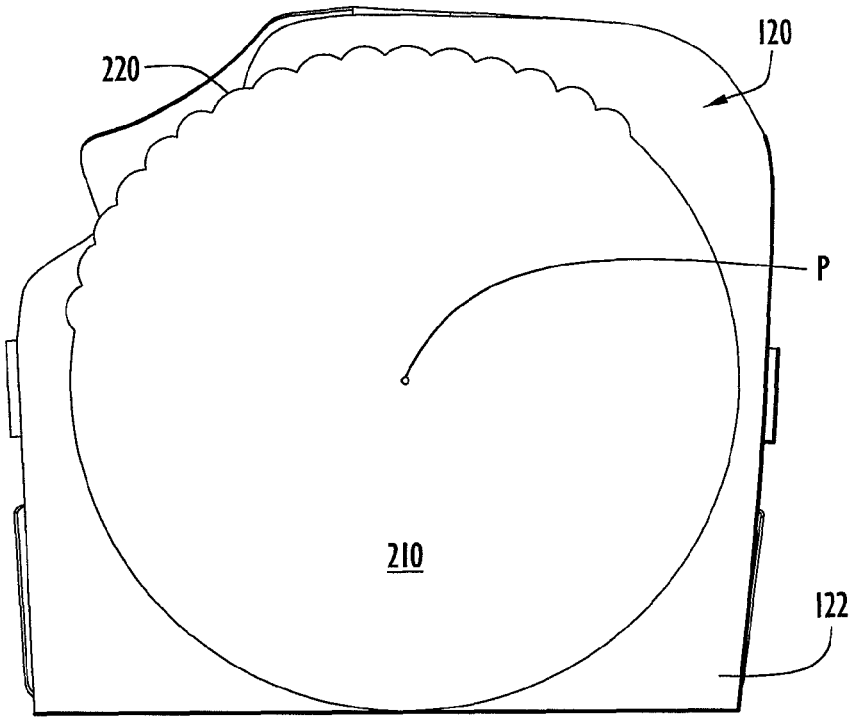
FIGS. 3A and 3B illustrate an interior views (rear and side, respectively) of the display packaging of FIG. 1A, showing a rotatable disk.
Figure 3B:
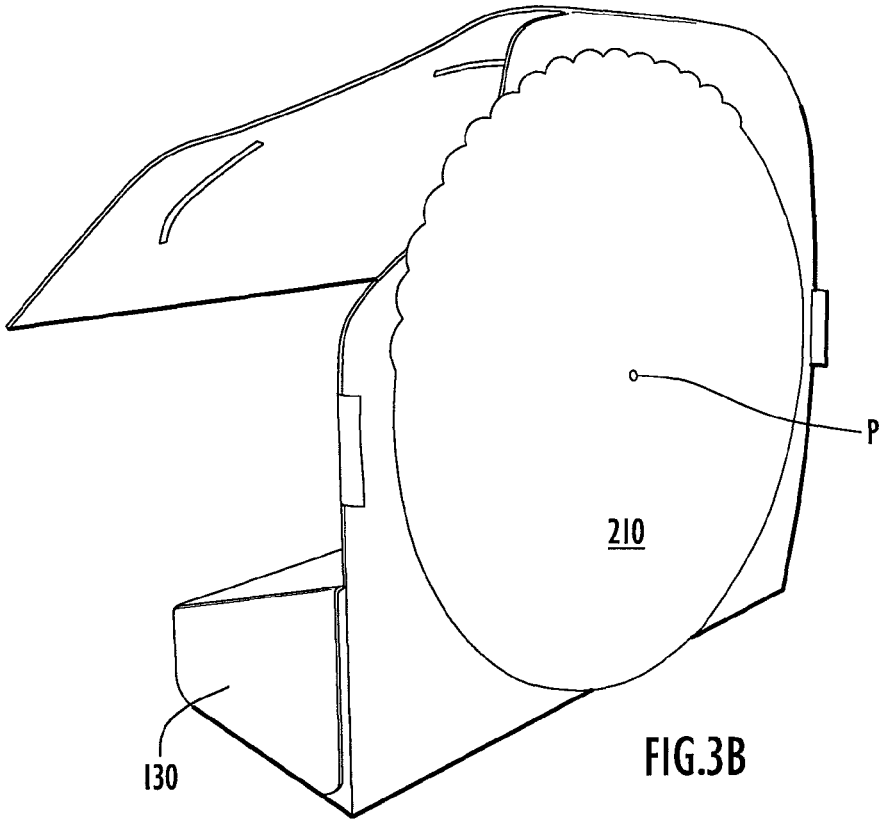

FIGS. 3A and 3B are rear perspective views of the display package 100 with the exterior wall 124 removed for clarity. In the illustrated embodiment, the rear portion 120 includes a generally circular disk 210 configured to rotate about a pivot point P. The dimensions of the disk 210 are not limited to those disclosed herein; in addition, the degree of rotation may include amount up to and including 360°.

Figure 4A:
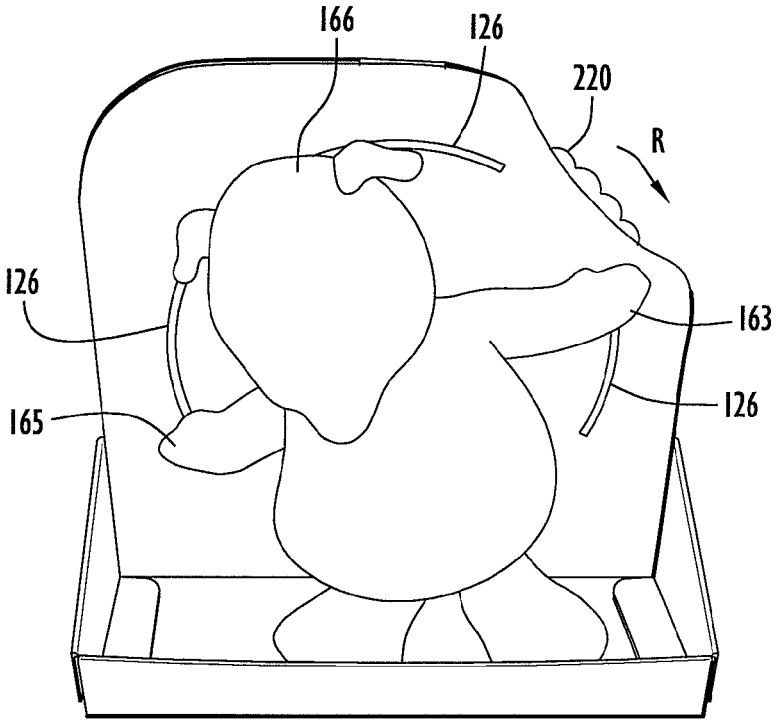
FIGS. 4A and 4B illustrate front views of the display packaging of FIG. 1A, showing movement of the toy from a first display position to a second display position.
Figure 4B:
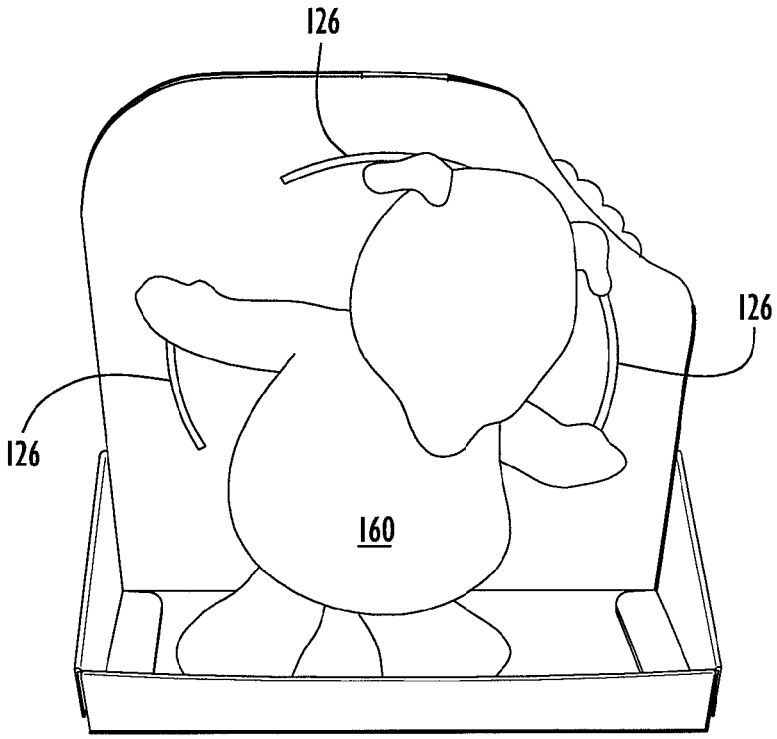

The operation of the display package 100 of FIG. 1A is explained with reference to FIGS. 4A and 4B. The toy 160 begins in its first display position (FIG. 4A). A user may engage the engagement portion 220 of the disk 210 to rotate the disk about the pivot point P (indicated by arrow R in FIG. 4A). By way of example, the disk 210 may be rotated in a generally clockwise or counterclockwise direction. This rotation causes a corresponding movement to any toy portions coupled to the disk 210. That is, each movable portion 163, 165, 166 that is coupled to the disk 210 moves with the disk, guided by each portion's 163, 165, 166 respective slot 126. As a result, the toy 160 is capable of moving from a first display position (FIG. 4A) to a second display position (FIG. 4B), and vice versa. For example, movement simulating a side bending/arm swaying movement may be created in the toy 160.

Figure 4C:
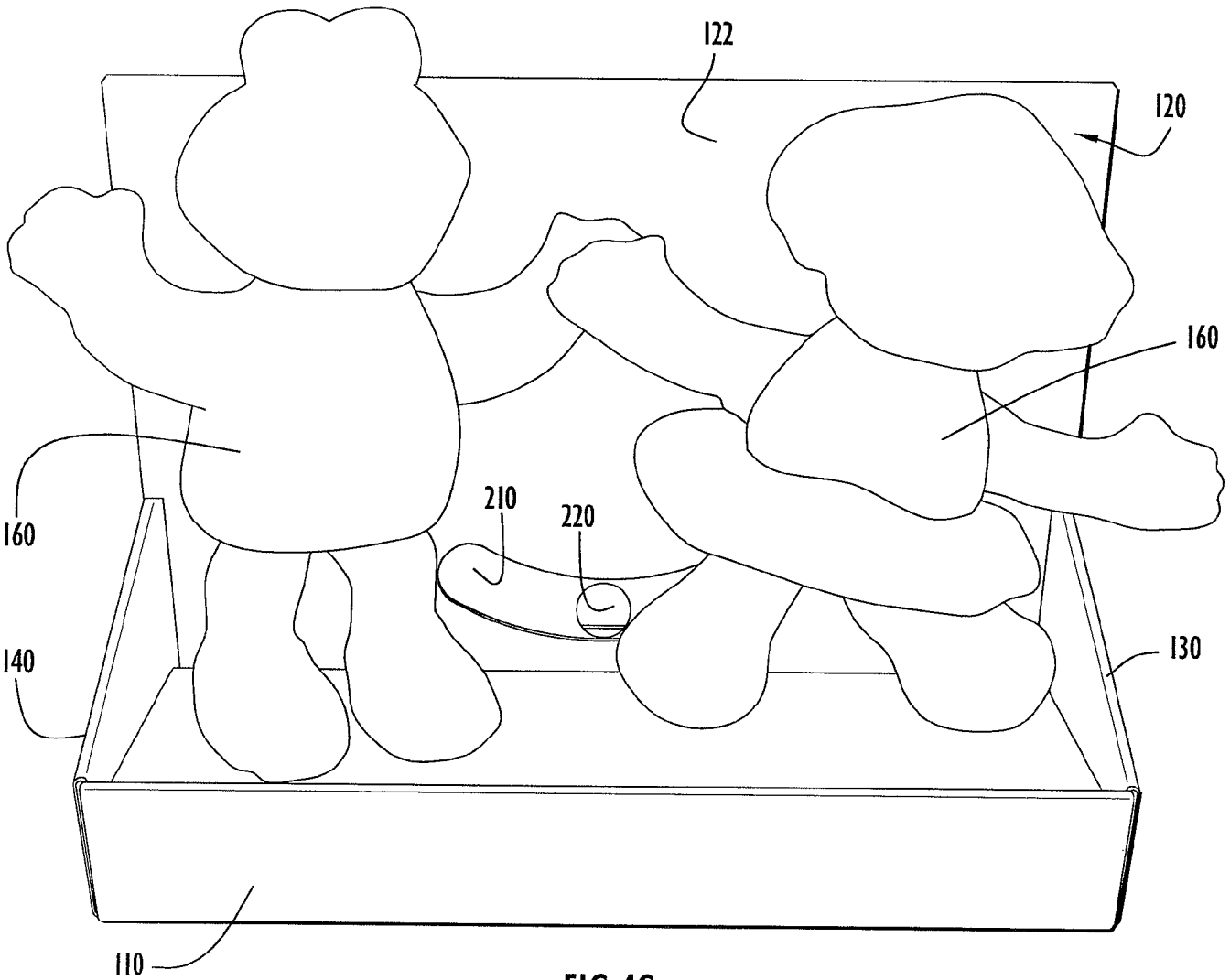
FIG. 4C illustrates a front perspective view of display packaging in accordance with another embodiment of the invention

FIG. 4C shows a display package 100 similar to the embodiment of FIG. 1, and includes a disk assembly 200 operable to selectively move a pair of toys 160 displayed within the packaging 100. An engagement member 220 may be disposed within a slot 126 located proximate the bottom edge of the interior wall 122 of the rear package portion 120. Manipulating the engagement member 220 by rotating it clockwise or counterclockwise generates a corresponding motion in the toys 160. Specifically, moving the engagement member 220 clockwise may cause one toy 160 to tilt/curtsy, while moving the engagement member 220 counterclockwise may cause the other toy 160 to tilt/curtsy.

Figure 5:
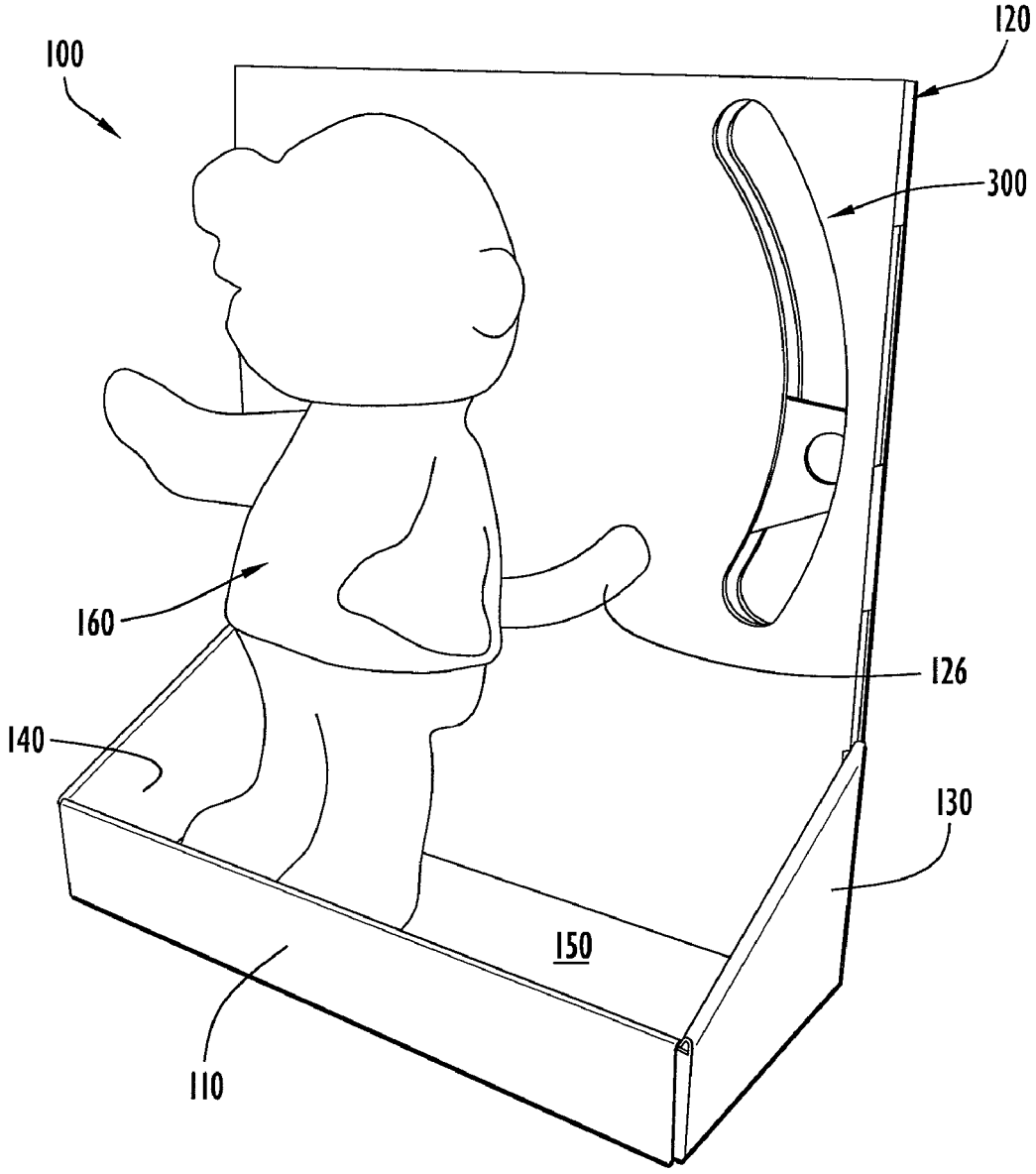
FIG. 5 illustrates a perspective view of display packaging in accordance with another embodiment of the present invention.
Figure 6:
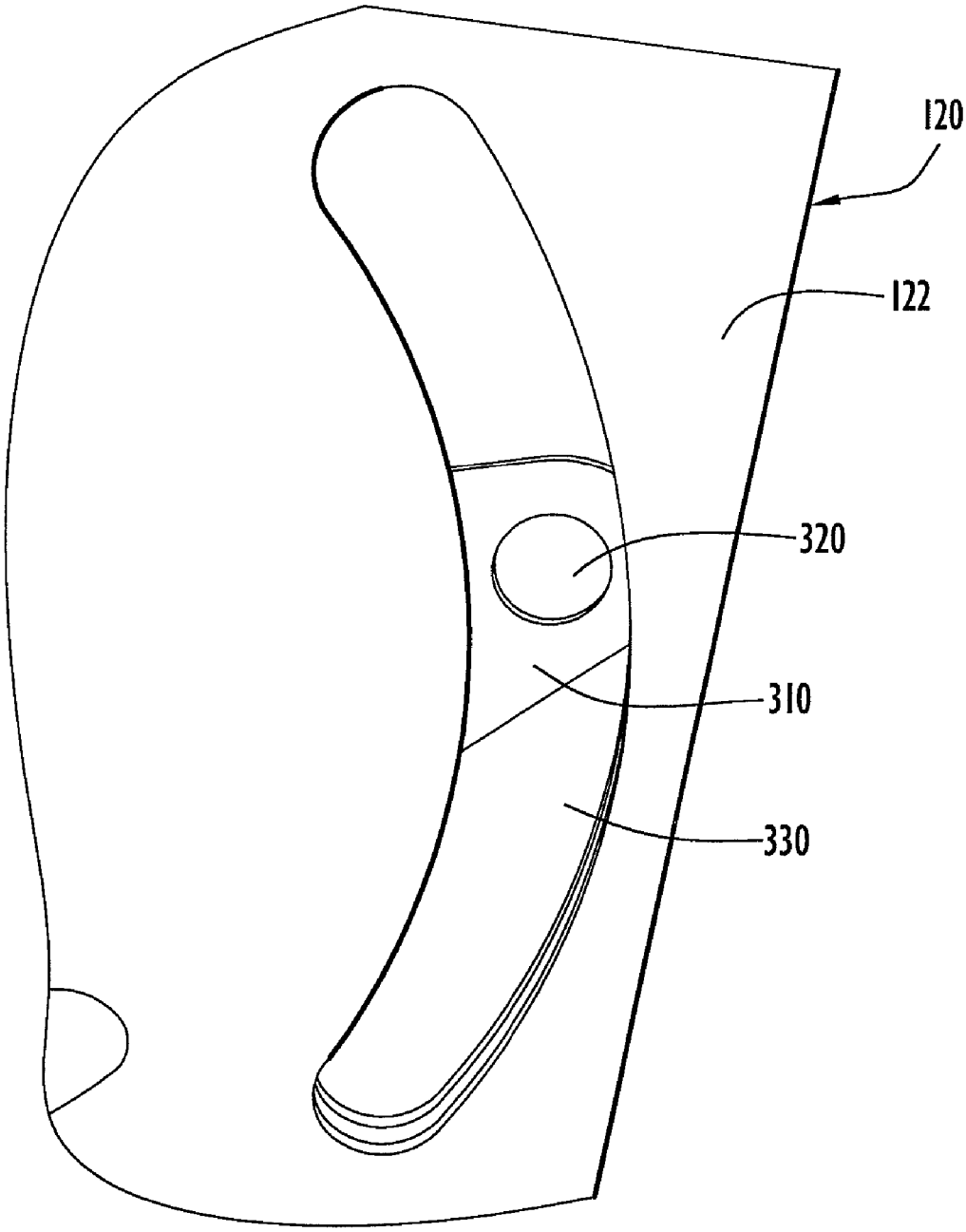
FIG. 6 illustrates a close-up front view of the upper portion of the display packaging of FIG. 5, showing an actuation lever.
Figure 7:
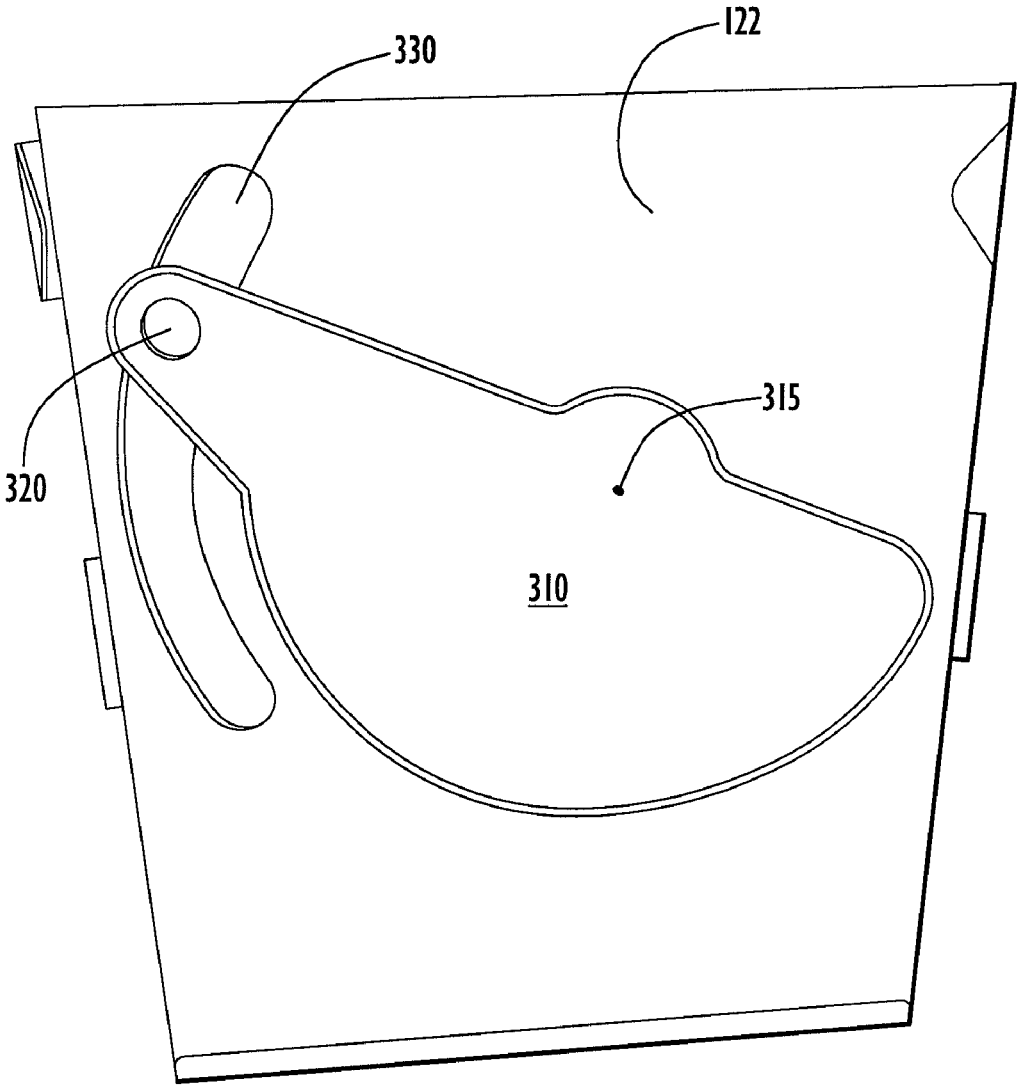
FIG. 7 illustrates an internal rear view of the display packaging of FIG. 5, showing the actuation lever assembly.

FIGS. 5-8 illustrate a display package 100 in accordance with another embodiment of the present invention. FIG. 5 illustrates a perspective view of the display package 100. As shown, the display package 100 has a general structure similar to that described above, including a front package portion 110, a rear package portion 120, side package portions 130, 140, and a bottom package portion 150. The rear package portion 120, instead of housing a disk assembly, may now contain a lever assembly 300 operable to move the toy 160 or a portion thereof 161-166 from a first display position to a second display position, and vice versa. FIG. 6 illustrates a close-up front view of the upper portion of the display package 100 of FIG. 5. FIG. 7 illustrates an internal rear view of the display package 100 of FIG. 5 with the exterior wall 124 removed (folded out of the way) for clarity. The rear package portion 120 may include a lever 310 coupled to the outer side of the inner wall 122 of the rear portion 120 at pivot point 315. The lever 310 may include an engagement portion 320 (e.g., a finger hole) positioned within a channel 330 formed in the rear package portion 120. The interior wall 122 of the rear package portion 120 may further include a slot 126 (similar to that described above) defining a track along which the toy 160 moves (see FIG. 5). The toy 160 may be coupled to the lever 310 through the slot 126 such that, as the lever 310 moves, it causes a corresponding movement in the toy 160 (and/or portions thereof 161-166). By way of example, the rear torso 161 of the toy 160 may be coupled the lever 310. The toy 160 may be coupled to the lever 310 in any conventional manner including, but not limited to, tie fasteners.

Figure 8A:
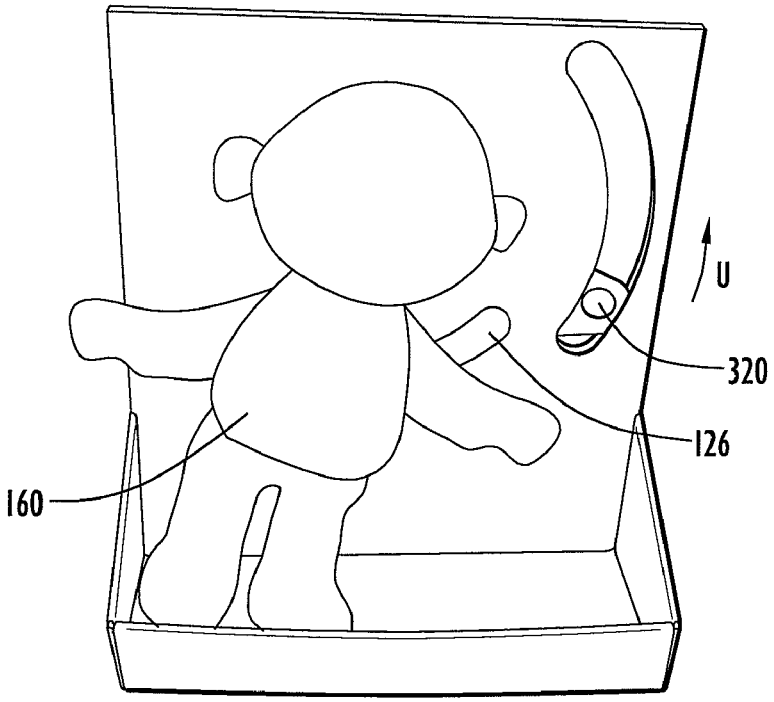
FIGS. 8A and 8B illustrate front views of the display packaging of FIG. 5, showing the operation of the actuation lever assembly to move the toy from a first display position to a second display position.
Figure 8B:
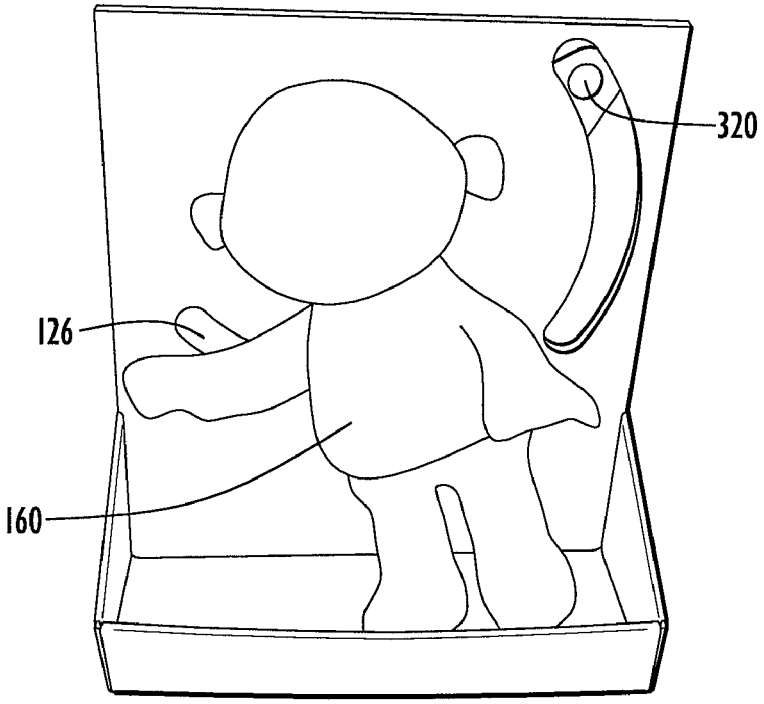

Operation of the display package 100 of FIG. 5 is explained with reference to FIGS. 8A and 8B. The toy 160 begins in its first display position (FIG. 8A). A user may contact the finger hole 320 of the lever 310, urging it along the channel 330 (indicated by arrow U). By way of example, the finger hole 320 may be urged downward or upward along the channel 330. Movement of the finger hole 320 pivots the lever 310 about the pivot point 315. This, in turn, causes a corresponding movement of the toy 160 along the slot 126. As a result, the toy 160 is capable of moving from a first display position (FIG. 8A) to a second display position (FIG. 8B), and vice versa. For example, movement simulating a hip sway motion may be created in the toy 160.

Figure 9:
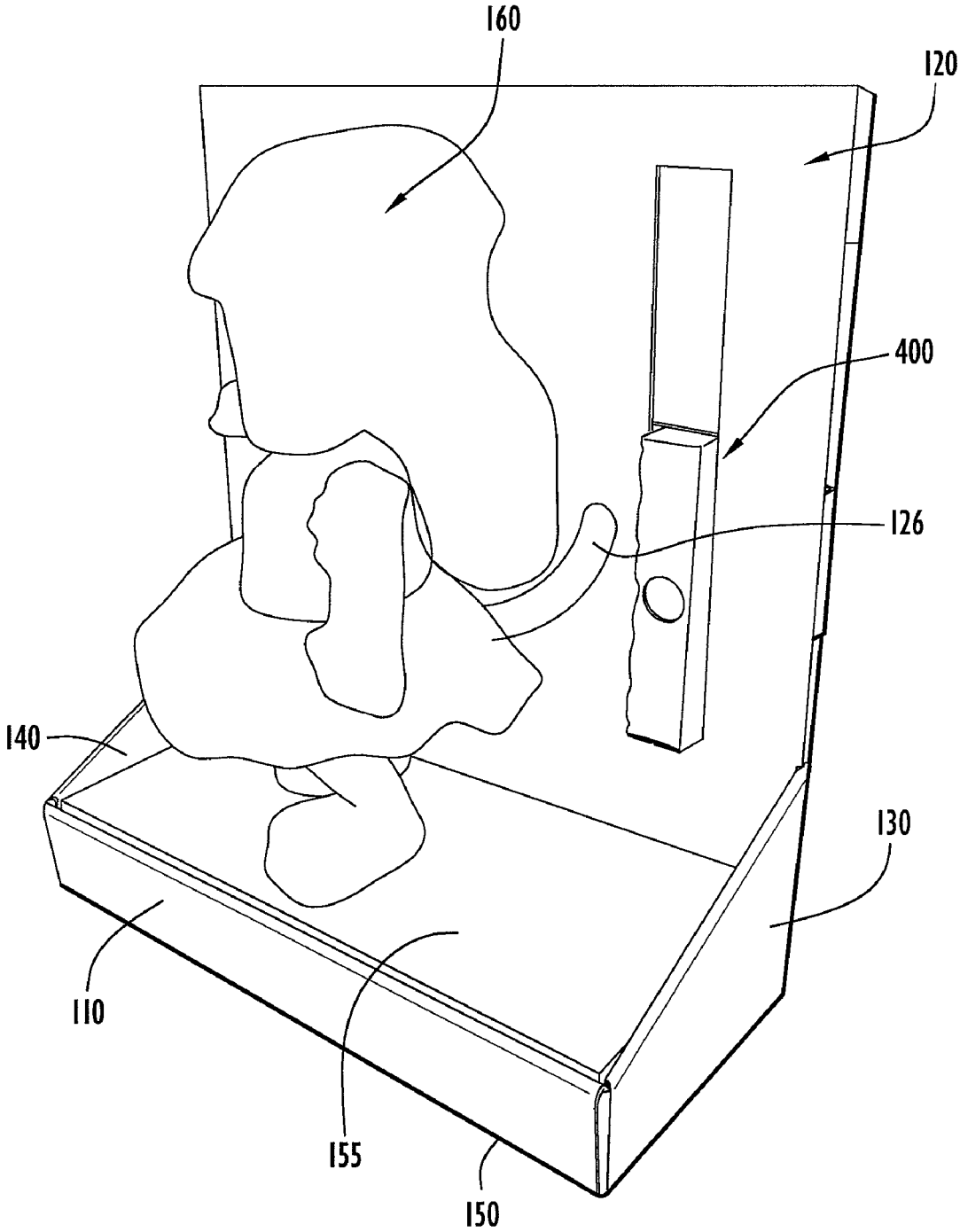
FIG. 9 illustrates a perspective view of display packaging in accordance with another embodiment of the present invention.

FIGS. 9-13 illustrate a display package 100 in accordance with another embodiment of the invention. FIG. 9 illustrates a perspective view of the display package 100. As shown, the display package 100 has a general structure similar that described above, including a front package portion 110, a rear package portion 120, side package portions 130, 140, and a bottom package portion 150. In addition, the display package 100 may further include a display panel 155 positioned between the first and second side walls 130, 140, as well as between the front 110 and rear 120 package portions. Specifically, the display panel 155 may be mounted to the bottom package portion 150 and configured to support the toy 160 thereon. In addition, the display panel 155 may be movable on the display package 100, being adapted to move in an up and down motion, toward and away from the bottom package portion 150. This movable display panel 155 configuration is further disclosed in U.S. Published Patent Application No. 2006/0118461 (Calendrille), the disclosure of which is hereby incorporated by reference in its entirety.

Figure 10:
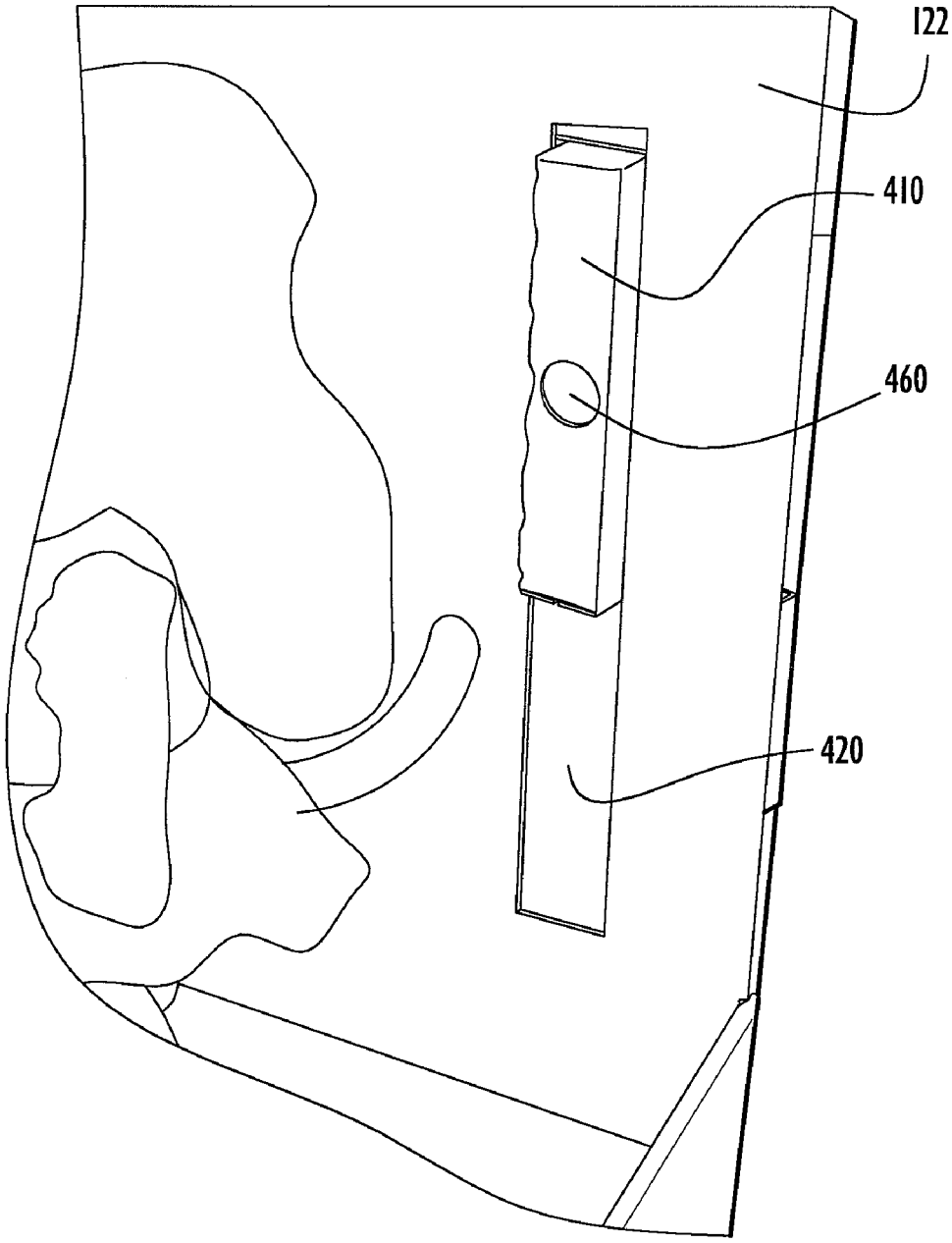
Figure 11:
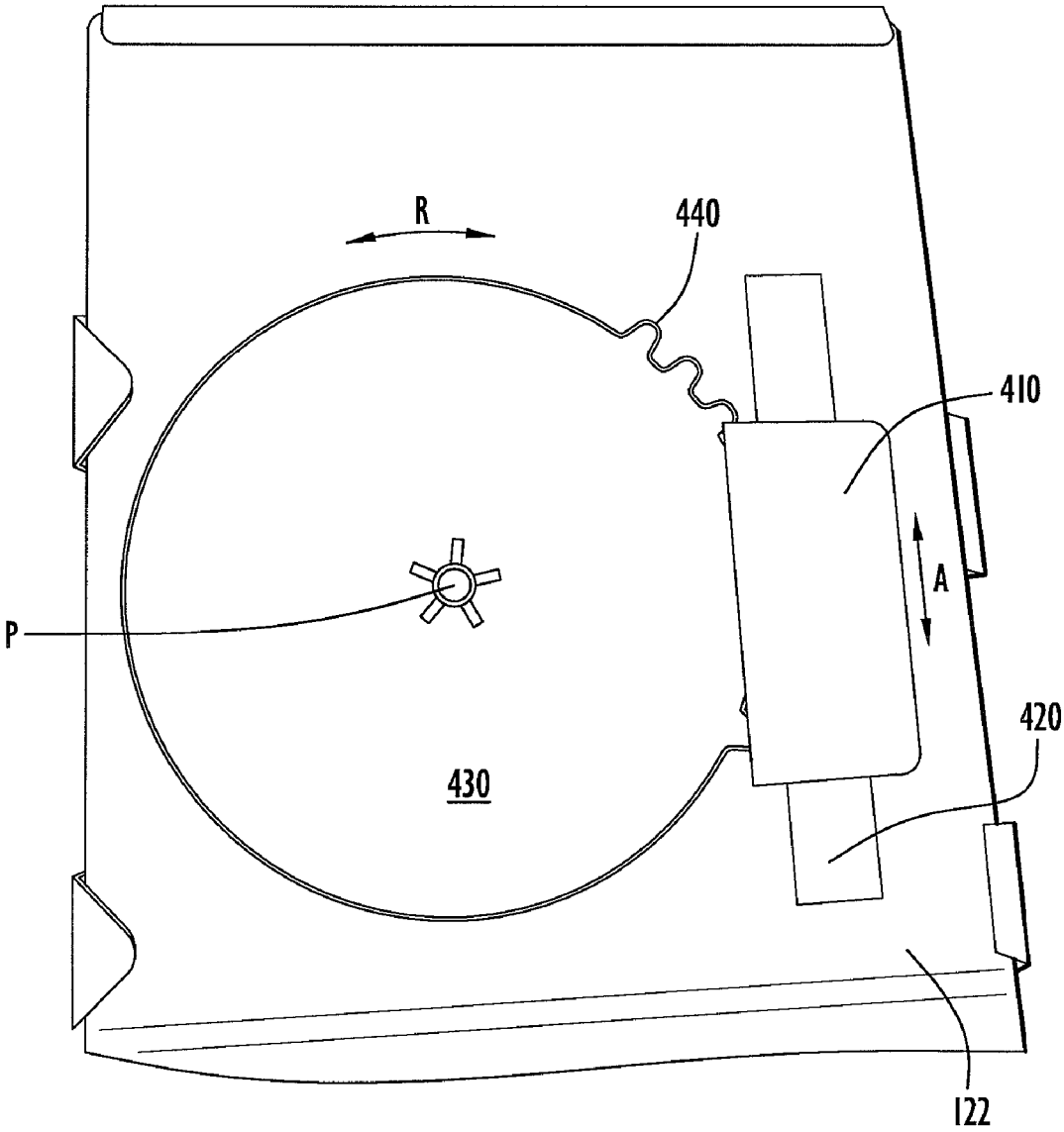
Figure 12A:
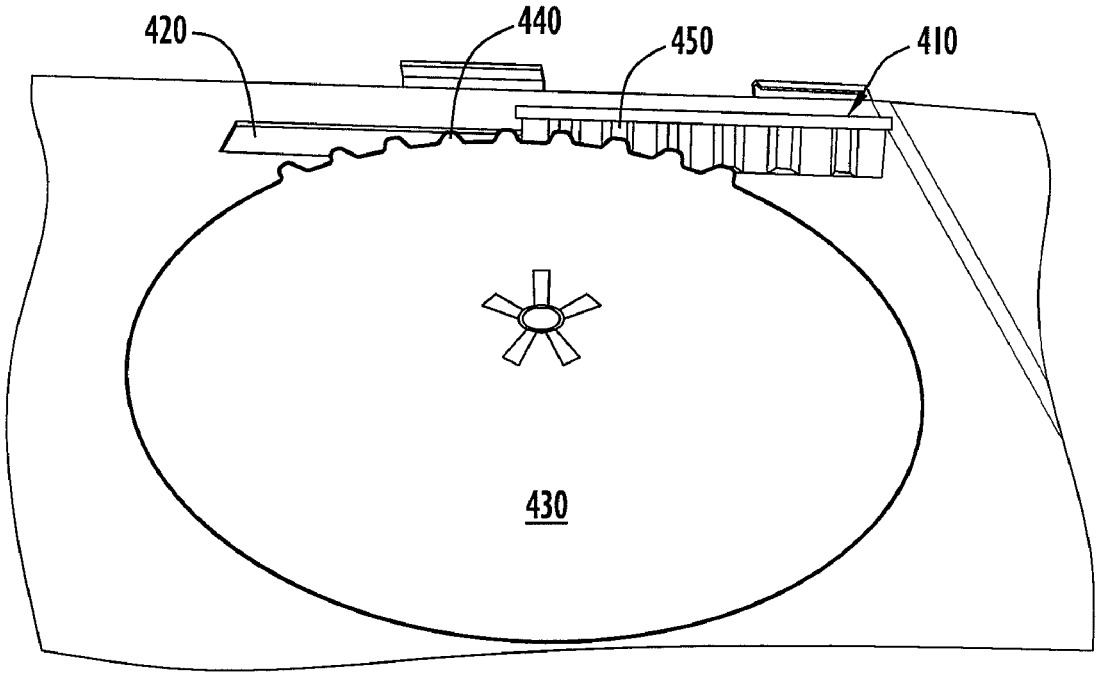
FIGS. 12A and 12B showing the interaction between the sliding actuator of FIG. 10 and the rotatable gear of FIG. 1.
Figure 12B:
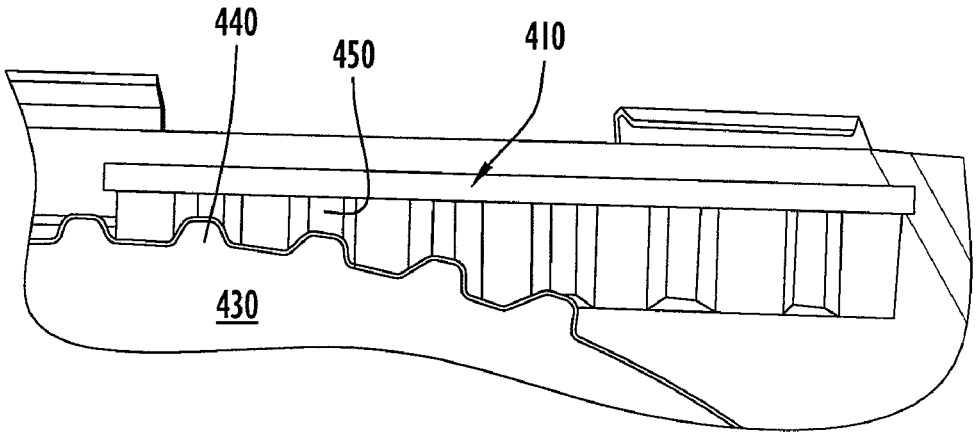

The rear package portion 120 may further contain an animation mechanism operable to move the toy 160 or a portion thereof 161-166 from a first display position to a second display position, and vice versa. FIG. 10 is a close-up front view of the upper portion of the display package 100 of FIG. 9. FIG. 11 is an internal rear view of the display package 100 of FIG. 9, with the exterior wall 124 removed for clarity. The animation mechanism may include a sliding member assembly with an engagement member 410 configured to slide along a channel 420 formed within the interior wall 122 of the rear package portion 120. The engagement member 410 may be further adapted to engage a gear 430 mounted on the rear package portion 120 (e.g., captured between the interior 122 and exterior 124 walls of the rear package portion 120) such that the gear 430 rotates about a pivot point P. Specifically, the gear 430 may include one or more teeth 440 operable to engage corresponding recesses 450 formed within the engagement member 410. FIGS. 12A and 12B are top perspective views of the interaction between the sliding actuator 410 and the rotatable gear 430. With this configuration, as the engagement member 410 moves along the channel 420 (indicated by arrow A in FIG. 11) the teeth 440 of the rotatable gear 430 engage the recesses 450 formed in the engagement member 410, rotating the gear 430 (indicated by arrow R) about the pivot point P.

Referring back to FIG. 9, the interior wall 122 of the rear portion 120 may further include a slot 126, similar to that described above, defining a track along which the toy 160 (or a portion thereof 161-166) may be moved. Specifically, the toy 160 may be coupled to the gear 430 through the slot 126 such that, as the gear 430 moves, it causes a corresponding movement in the toy 160 and/or a portion thereof 161-166. By way of example, the fourth movable portion 165 (second arm/hand) and the fifth movable portion 166 (the head) of the toy 160 may be coupled the gear 430 along respective slots 126. The toy 160 may be coupled to the gear 430 in any conventional manner including, but not limited to, tie fasteners.

Figure 13A:
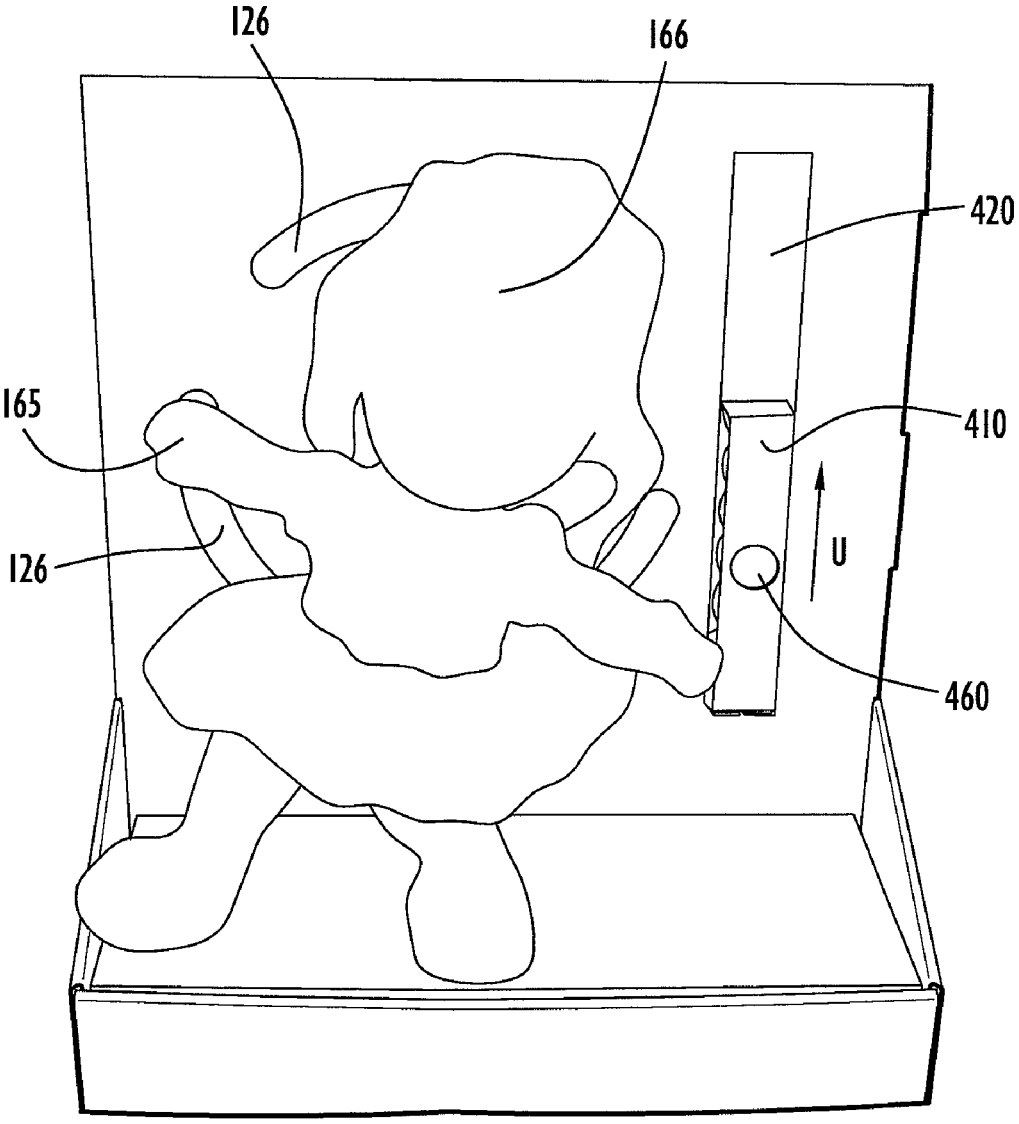
FIGS. 13A and 13B illustrate front views of the display packaging of FIG. 9, showing movement of the toy from a first display position to a second display position.
Figure 13B:
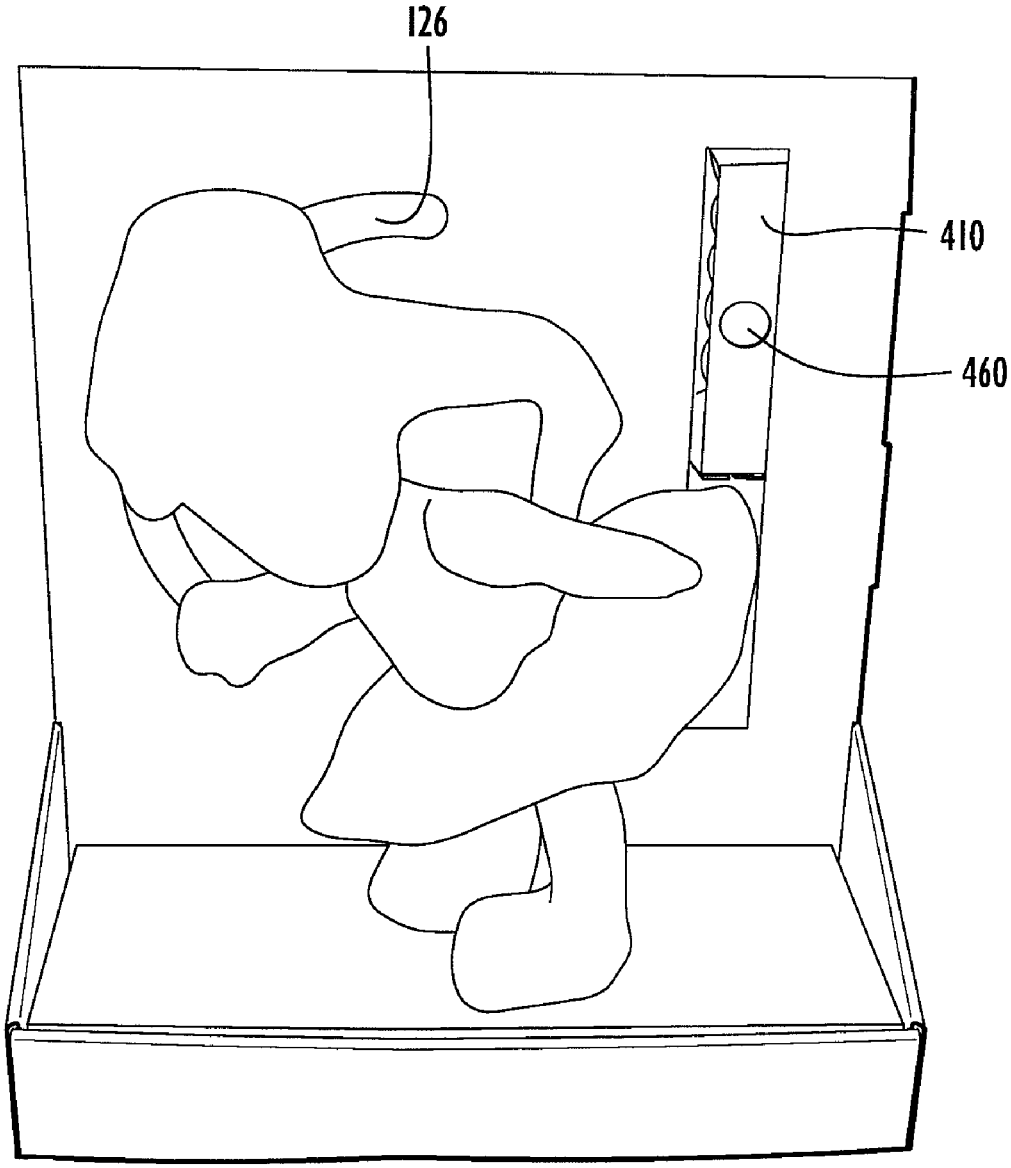

Operation of the display package 100 of FIG. 9 is described with reference to FIGS. 13A and 13B. The toy 160 begins in its first display position (FIG. 13A). A user may contact a finger hole 460 formed in the engagement member 410, urging it along the channel 420 (indicated by arrow U). By way of example, the engagement member 410 may be urged upward or downward along the channel 420. Movement of the engagement member 410 causes the recesses 450 of the engagement member 410 to mesh with the teeth 440 of gear 430, rotating it about the pivot point P as explained above. The rotation of the gear 430, in turn, causes a corresponding movement of the toy 160 along the slots 126. As a result, the toy 160 is capable of moving from a first display position (FIG. 13A) to a second display position (FIG. 13B). For example, the animation mechanism may generate a curtsy motion in the toy 160.

Figure 14:
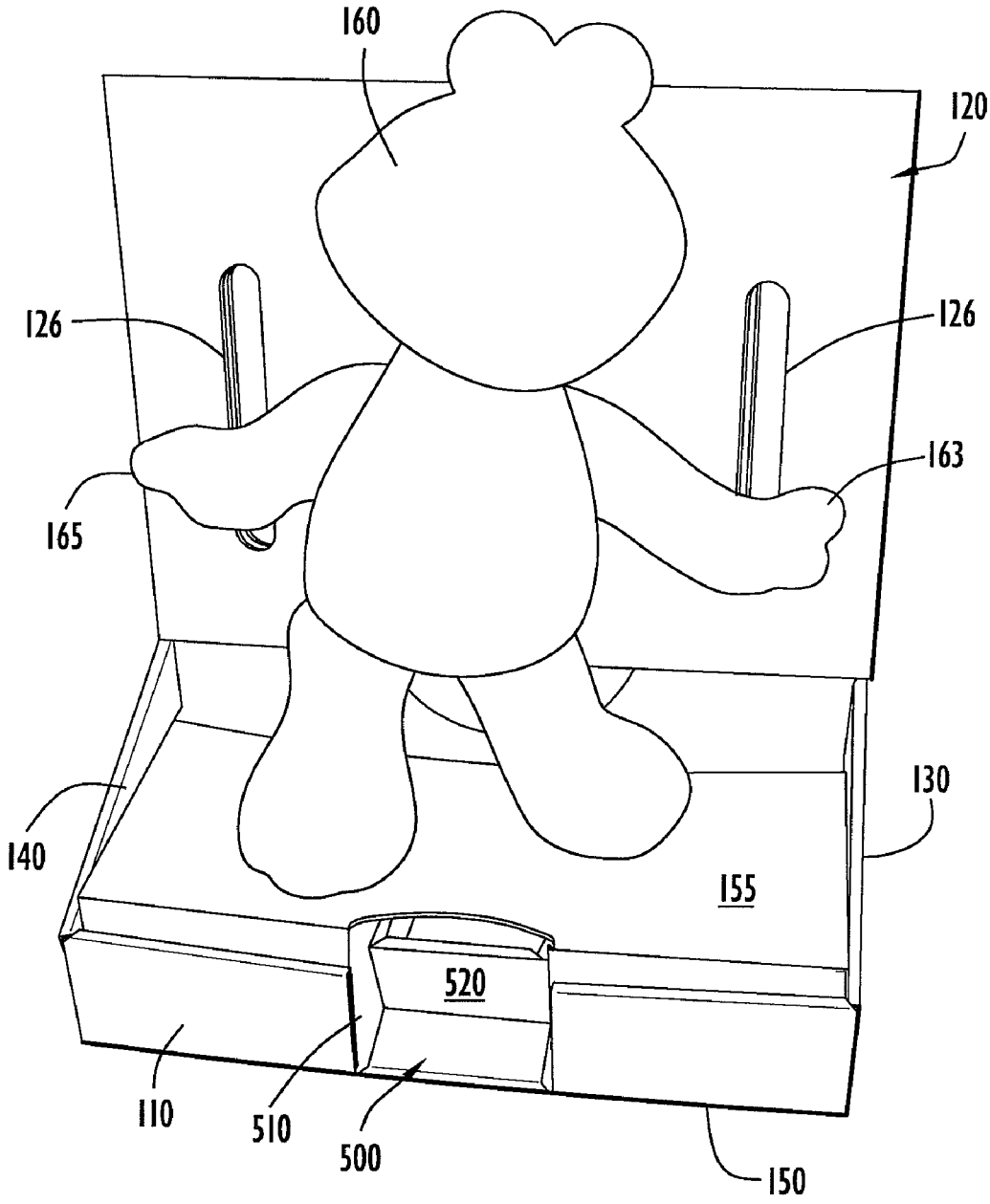
FIG. 14 illustrates a front perspective view of display packaging according to another embodiment of the present invention.

FIGS. 14-18 illustrate a display package 100 in accordance with another embodiment of the present invention. FIG. 14 illustrates a front perspective view of the display package 100. As shown, the display package 100 of FIG. 14 may have a general structure generally similar that described above, having a front package portion 110, a rear package portion 120, side package portions 130, 140, and a bottom package portion 150. In addition, the display package may further include a display panel 155 positioned between the first and second side walls 130, 140, as well as between the front 110 and rear 120 package portions.

Figure 15:
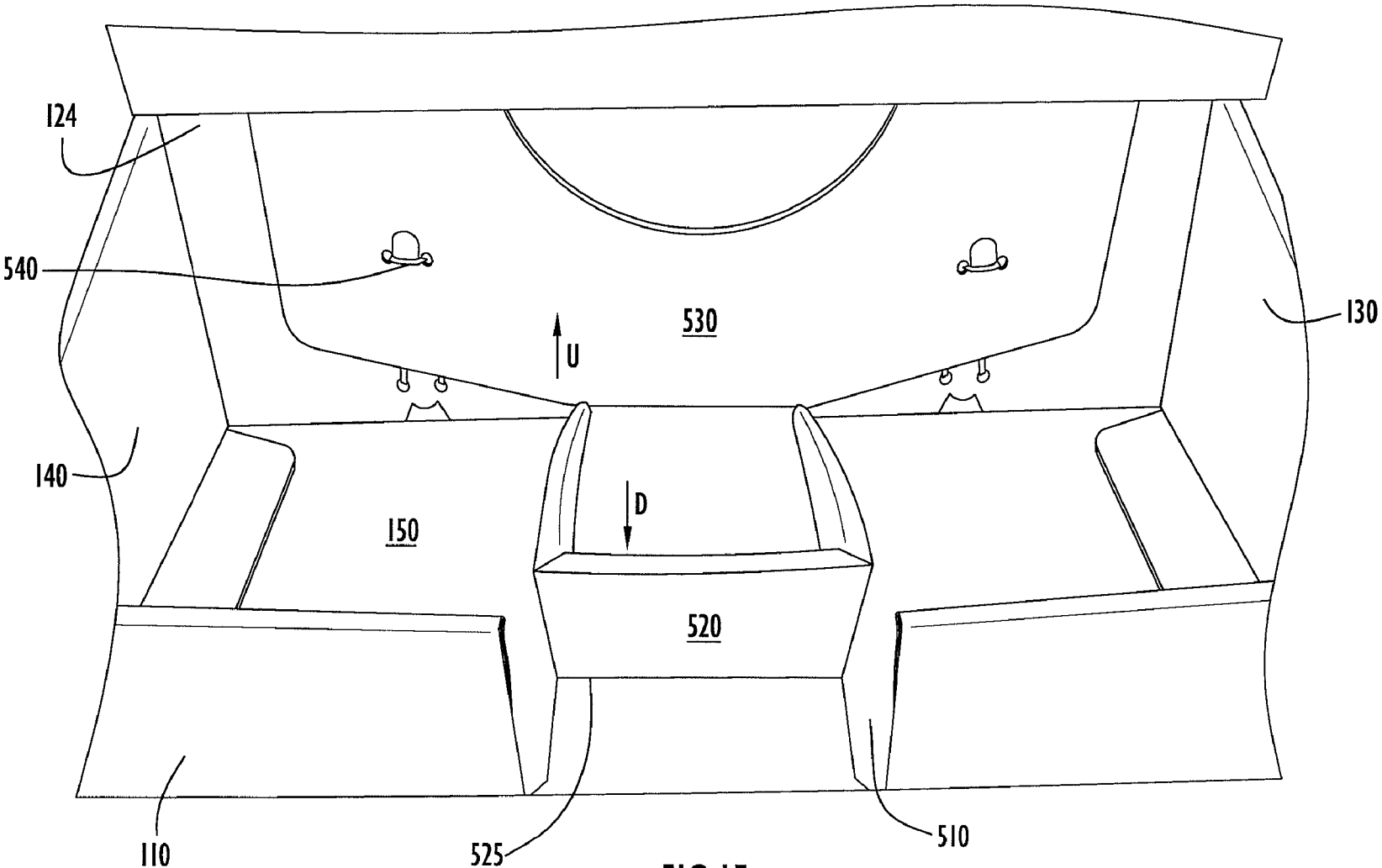
FIG. 15 illustrates a close-up internal, elevated front perspective view of the display packaging of FIG. 14, showing the actuator handle assembly.
Figure 16A:
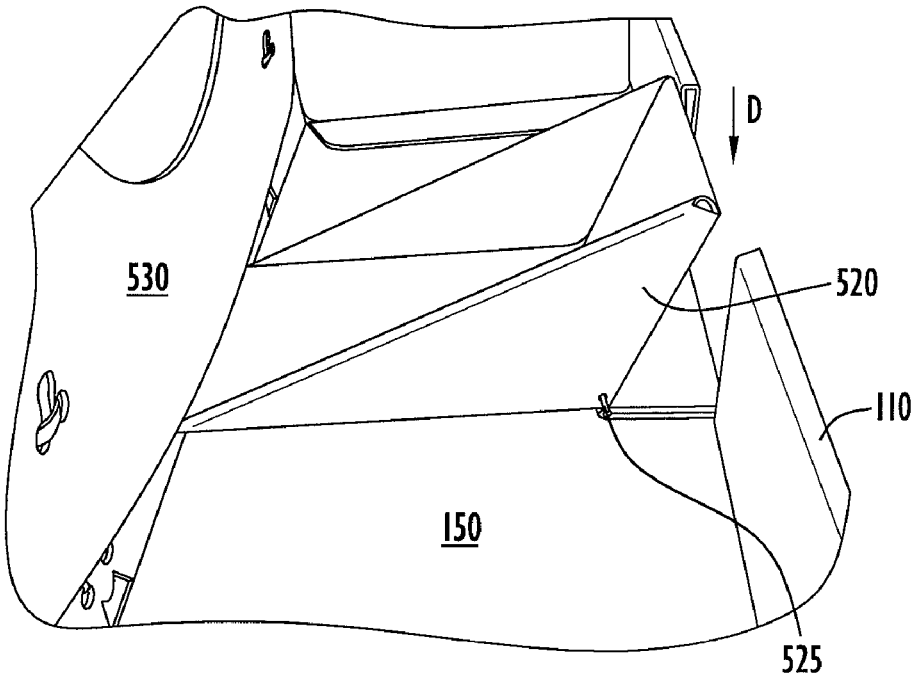
FIGS. 16A and 16B illustrate close-up internal, side views of the handle assembly of FIG. 15, showing the interaction between the handle assembly and the display packaging.
Figure 16B:
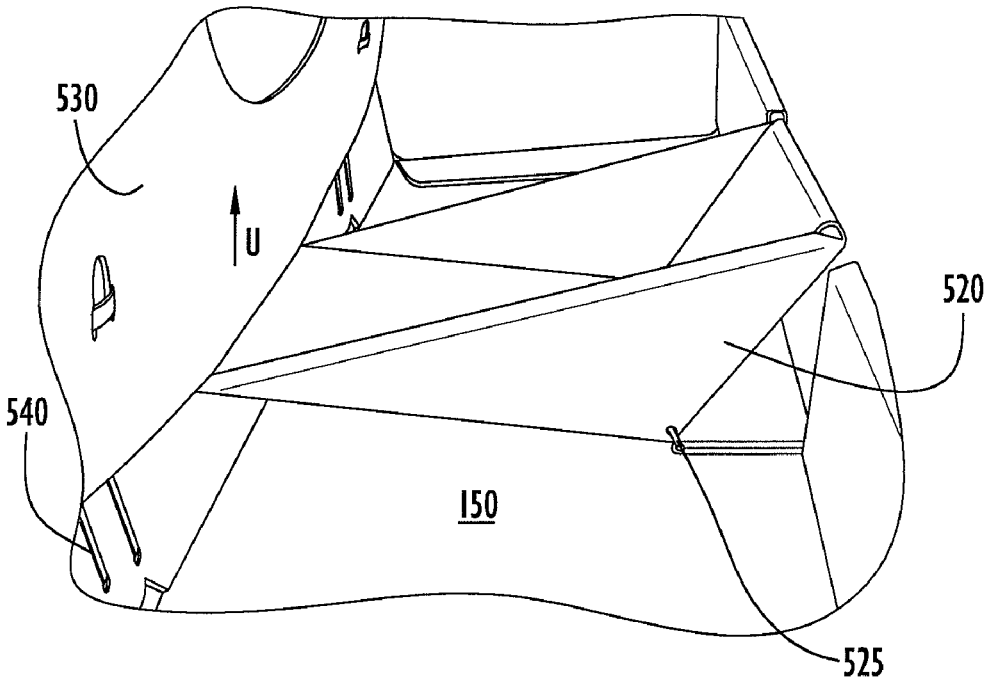

The display package 100 of FIG. 14 may further contain an animation mechanism operable to move the toy 160 or a portion thereof 161-166 from a first display position to a second display position, and vice versa. Specifically, the front package portion 110 may contain a handle assembly 500 that may be selectively engaged to move the toy 160 from a first display position to a second display position, and vice versa. FIGS. 15, 16A, and 16B are internal, perspective views of the display package 100 of FIG. 14, with the display panel 155 removed for clarity. As shown in FIGS. 14 and 15, an opening 510 formed in the front package portion 110 provides access to a handle 520 that is in communication with a plate 530 slidably captured within the rear package portion 120 (e.g., between the interior wall 122 and the exterior wall 124). Referring to FIGS. 15, 16A, and 16B (where interior wall 122 has been removed for clarity), the handle 520 may be pivotally connected to the bottom package portion 150 via tab 525; consequently, applying a downward force (as indicated by arrow D) to the front of the handle 520 urges the rear of the handle 520 upward (i.e., away from the bottom package portion 150). This, in turn, drives the plate 530 upward (indicated by arrow U) from its normal position. In addition, at least one biasing member 540 (e.g., a rubber band) may be coupled to the plate 530 and configured to return the plate to its normal position. Thus, pressing downward on the top portion of the handle 520 drives the plate 530 upward (FIG. 16B) and, when the handle 520 is released, the force applied by the biasing member(s) 540 draws the plate 530 downward, back to its normal position.

Referring back to FIG. 14, the interior wall 122 of the rear package portion 120 may further include a slot or slots 126 (similar to that described above) defining a track along which the toy 160 (or a portion 161-166 thereof) moves. Specifically, the toy 160 may be coupled to the plate 530 through the slots 126 such that, as the plate 530 moves, it causes corresponding movement in the toy 160 and/or a portion thereof 161-166. By way of example, the second moveable portion (first arm/hand) 163, and the fourth movable portion 165 (second arm/hand) of the toy 160 may be coupled to the plate 530 through respective slots 126. The toy 160 may be coupled to the plate 530 in any conventional manner including, but not limited to, tie fasteners. Thus, as the plate moves upward, the second 163 and fourth 165 movable portions of the toy 160 move upward.

Figure 17A:
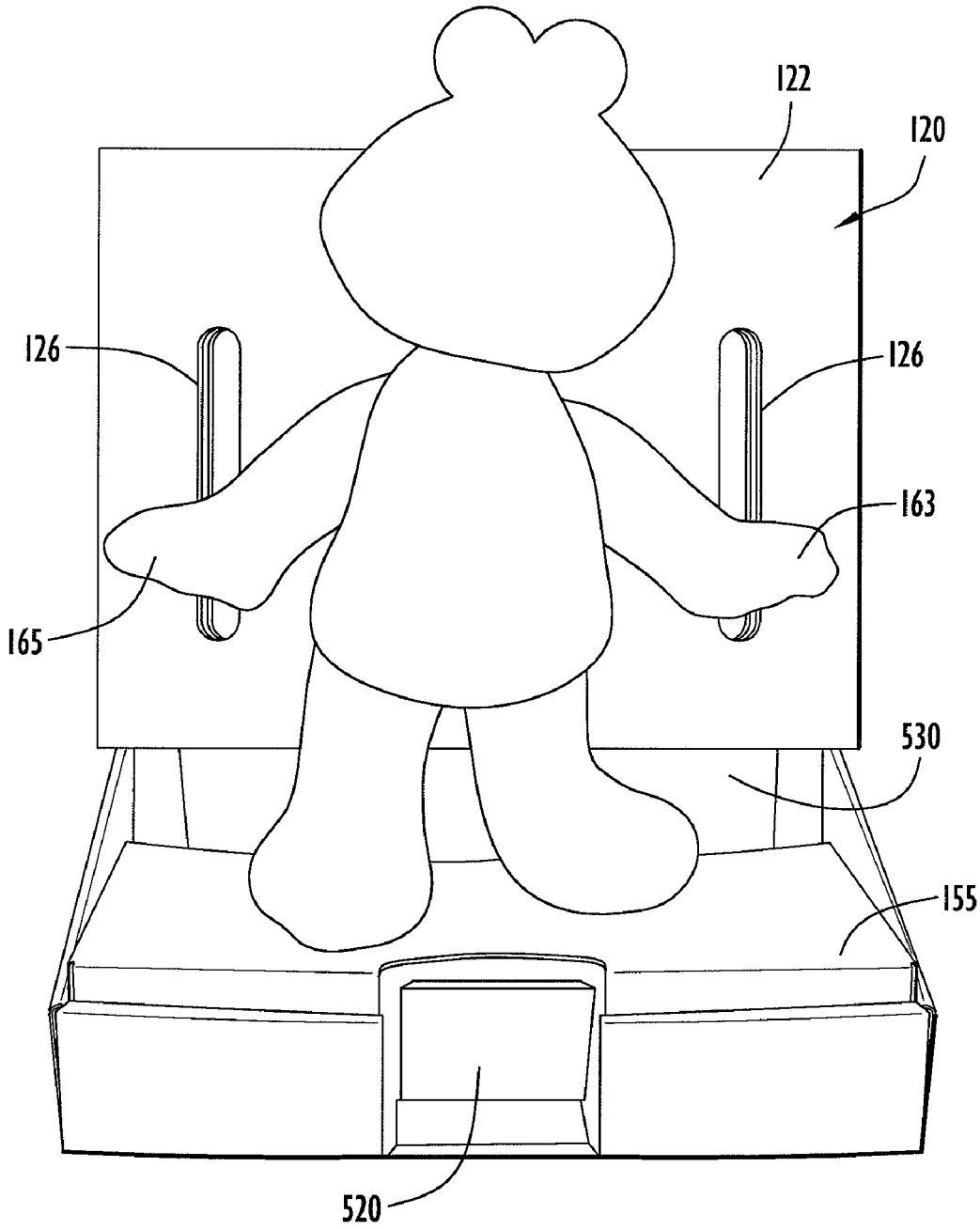
FIGS. 17A and 17B illustrate front perspective views of the display packaging of FIG. 14, showing operation of the handle assembly to move the toy from a first display position to a second display position.
Figure 17B:
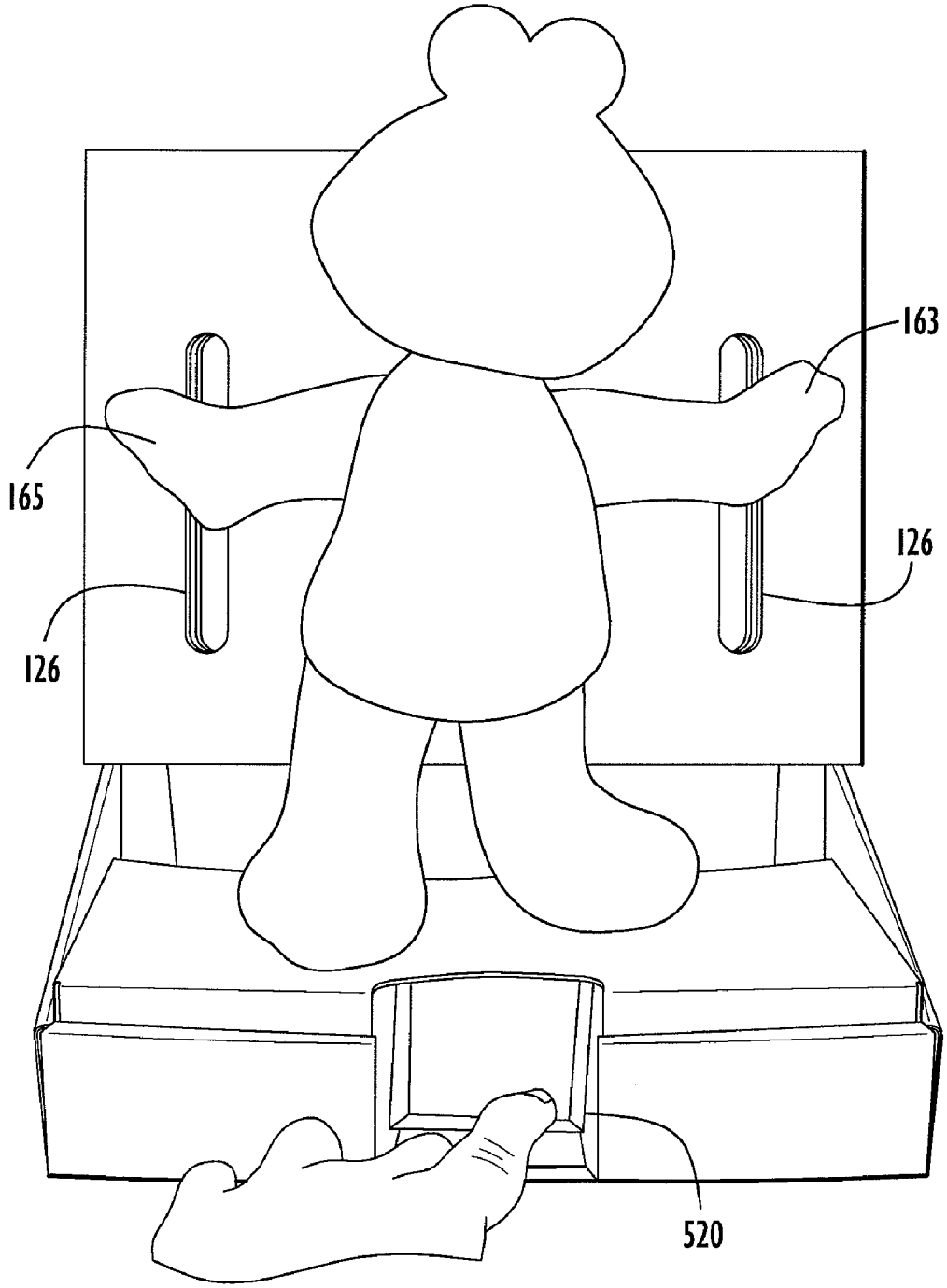
Figure 18A:
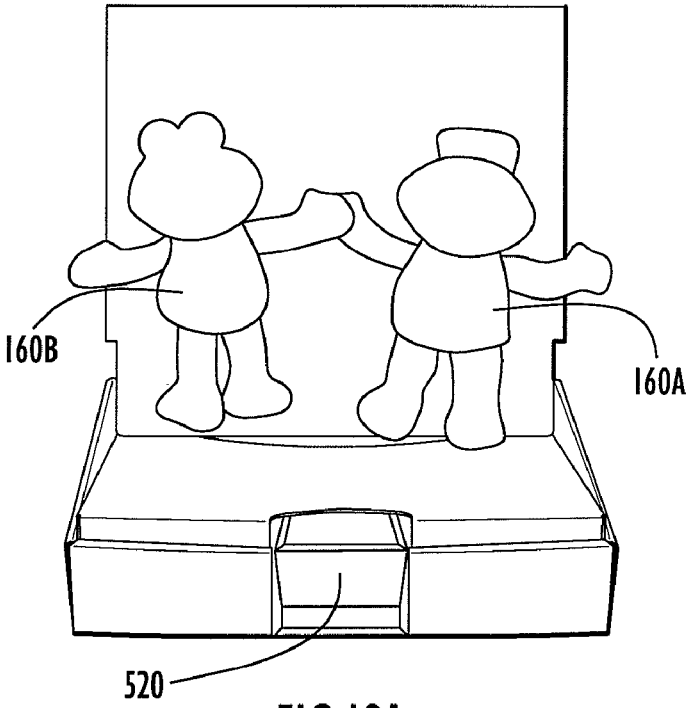
FIGS. 18A and 18B illustrate front perspective views of the display packaging of FIG. 14 further including multiple toys, showing operation of the handle assembly to move the toys from a first display position to a second display position.
Figure 18B:
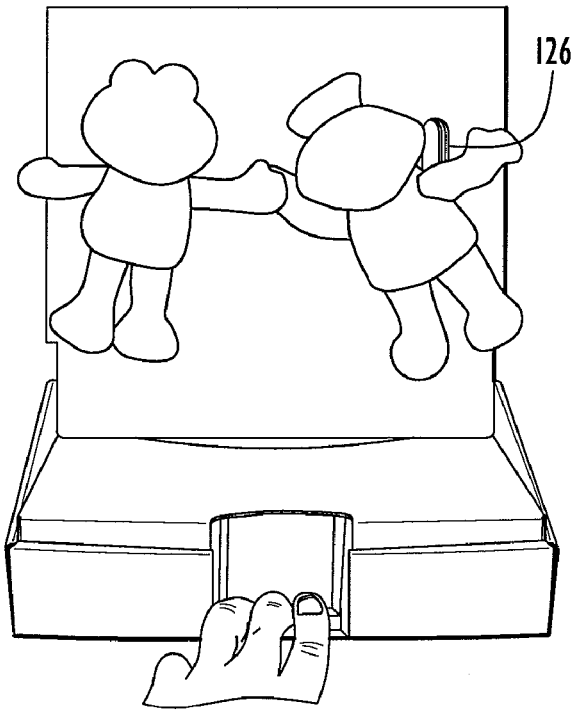

Operation of the display package 100 of FIG. 14 is described with reference to FIGS. 17A and 17B. The toy 160 begins in its first display position (FIG. 17A). A user may contact the top portion handle 520, urging it downward. Movement of the handle 520 pivots the rear portion of the handle coupled to the plate 530 as explained above. Specifically, the plate 530 moves/slides upward, causing a corresponding upward movement of the toy portions 163, 165 along the slots 126. As a result, the toy 160 is capable of moving from a first display position (FIG. 17A) to a second display position (FIG. 17B). For example, the animation mechanism may generate a "raise the roof" motion in the toy 160. Alternatively, as illustrated in FIGS. 18A and 18B, entire figures 160A, 160B may be repositioned within the display package 100. Specifically, a plurality of toys 160A, 160B may be reoriented from a first display position (FIG. 18A) to a second display position (FIG. 18B) via actuation of the handle assembly.

Figure 19:
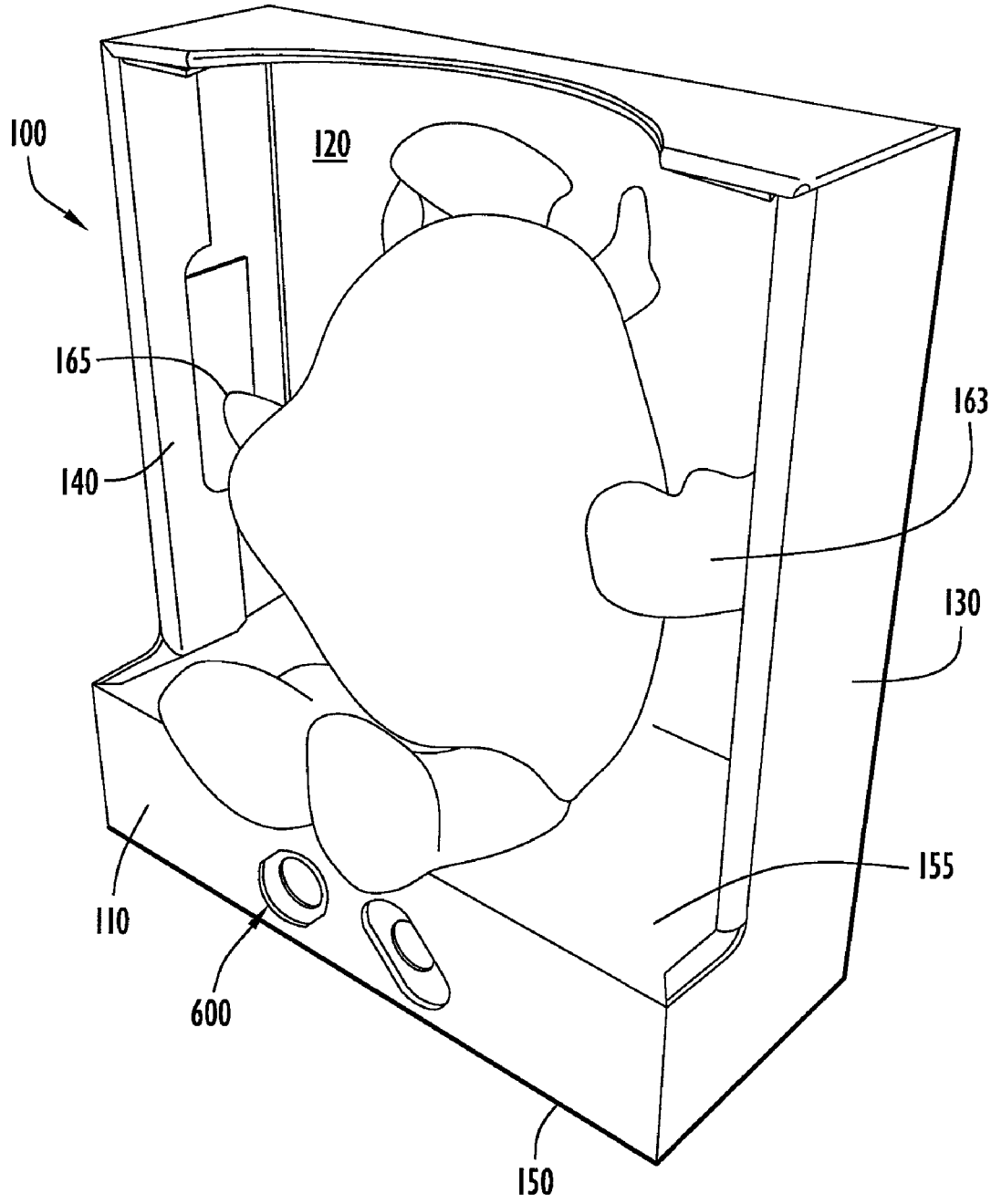
FIG. 19 illustrates a perspective view of display packaging in accordance with another embodiment of the present invention.

FIGS. 19-22 illustrate a display package 100 in accordance with another embodiment of the present invention. FIG. 19 illustrates a perspective view of the display package 100. As shown, the display package 100 of FIG. 19 may include a front package portion 110, a rear package portion 120, a first side package portion 130 coextensive with the rear package portion 120, a second side package portion 140 coextensive with the rear package portion 120, and a bottom package portion 150. In addition, the display package 100 of FIG. 19 may further include a display panel 155 positioned between the first and second side walls 130, 140, as well as between the front 110 and rear 120 package portions.

Figure 20:
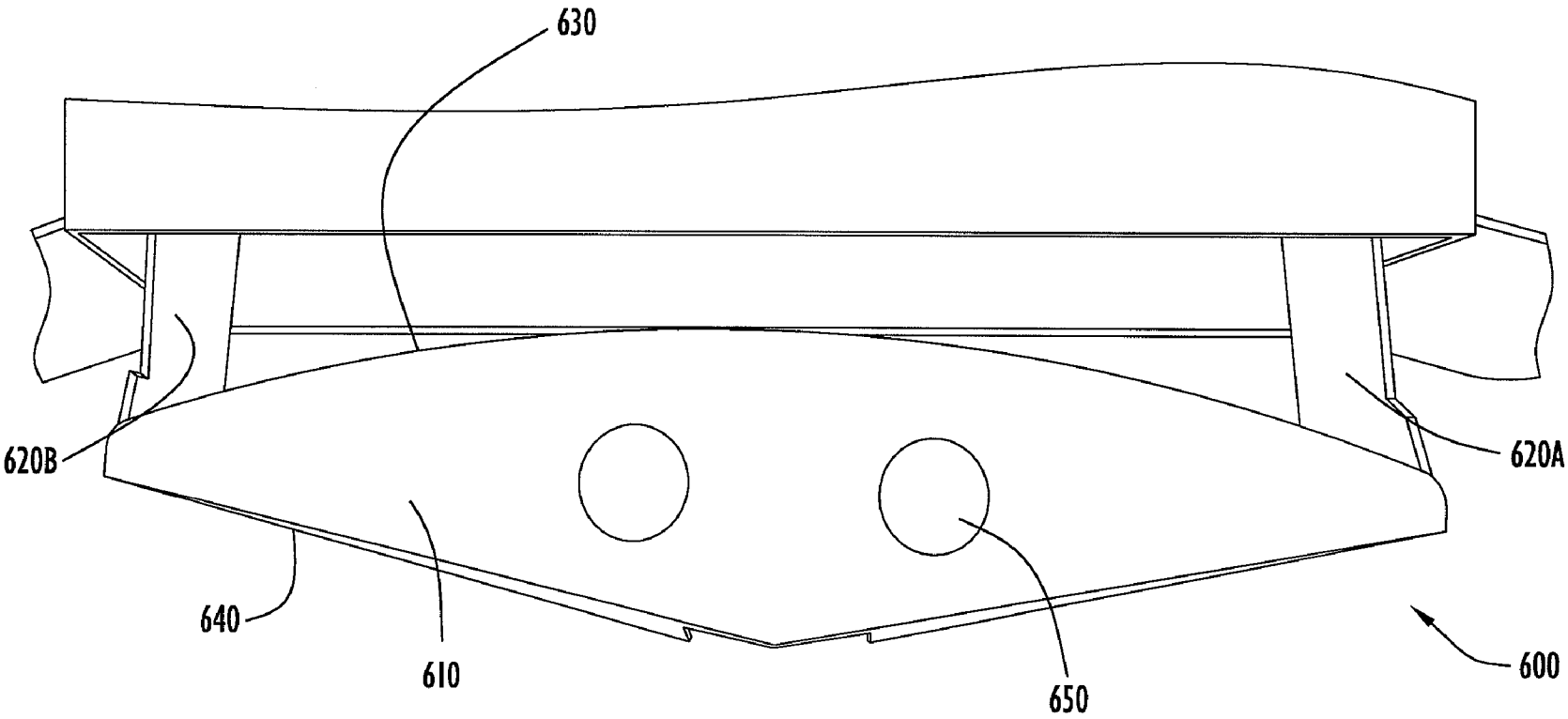
FIG. 20 illustrates an internal, front view of the packaging of FIG. 19, showing a rocking assembly with a base and stanchions.

The display package 100 of FIG. 19 may further contain a rocking assembly 600 operable to move the toy 160 (or a portion 161-166 thereof) from a first display position to a second display position, and vice versa. FIG. 20 is an internal, front view of the display package 100 of FIG. 19, with the front package portion 110 removed for clarity. The rocking assembly 600 may include a base 610 and one or more stanchions 620 (e.g., a first stanchion 620A and a second stanchion 620B). The base 610 may include, but is not limited to, a generally V-shaped structure including a curved top surface 630 and an angled bottom surface 640. The base 610 may further include one or more finger holes 650 that enable a user to tilt the base 610 about its angled bottom surface 640 (e.g., to tilt the base clockwise or counterclockwise on the fulcrum created by the intersection of the portions of the angled bottom surface 640).

Figure 21A:
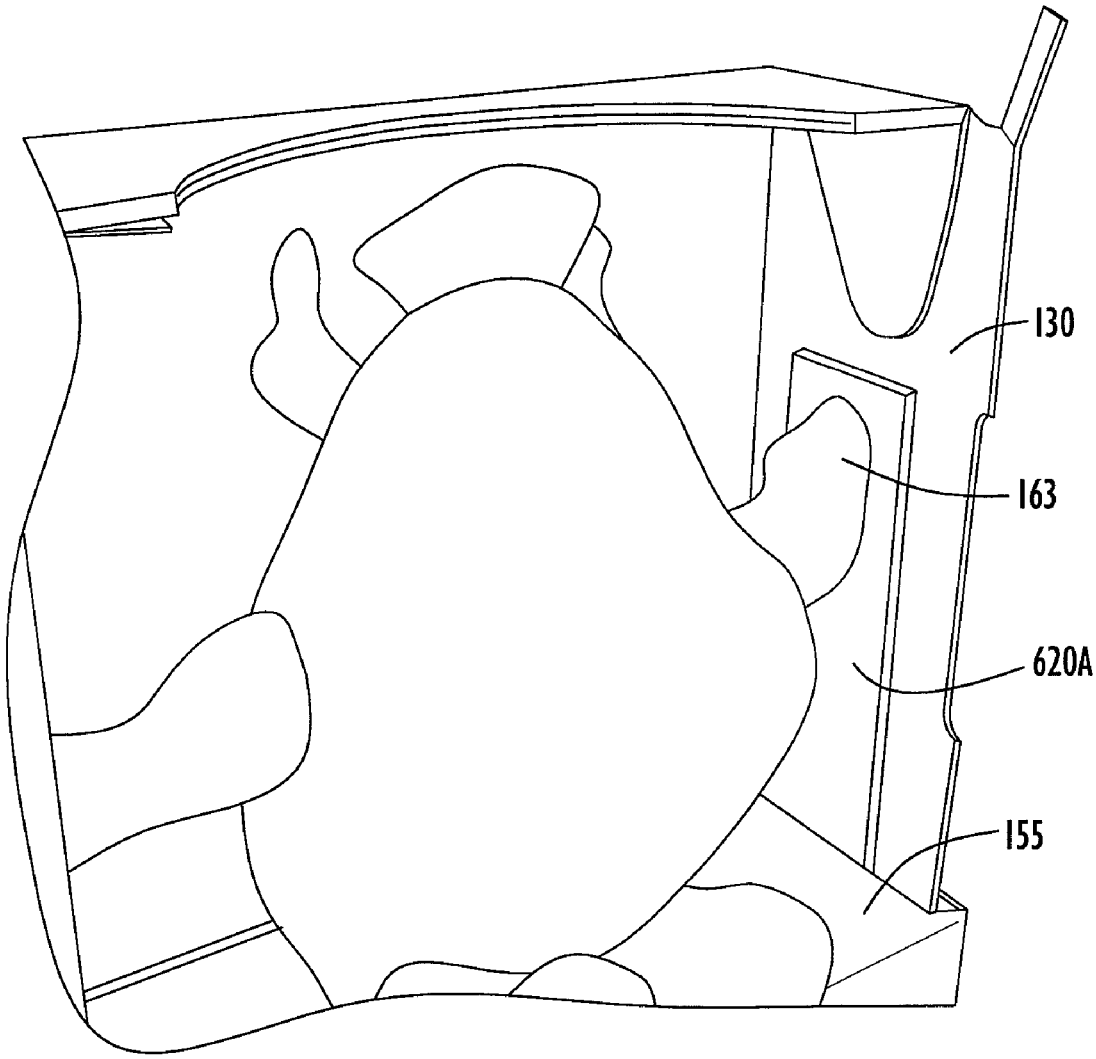
FIGS. 21A and 21B illustrate a close-up, perspective views of the inner sides of the display packaging of FIG. 19, showing the connection of the toy to a stanchion of the rocking assembly.
Figure 21B:
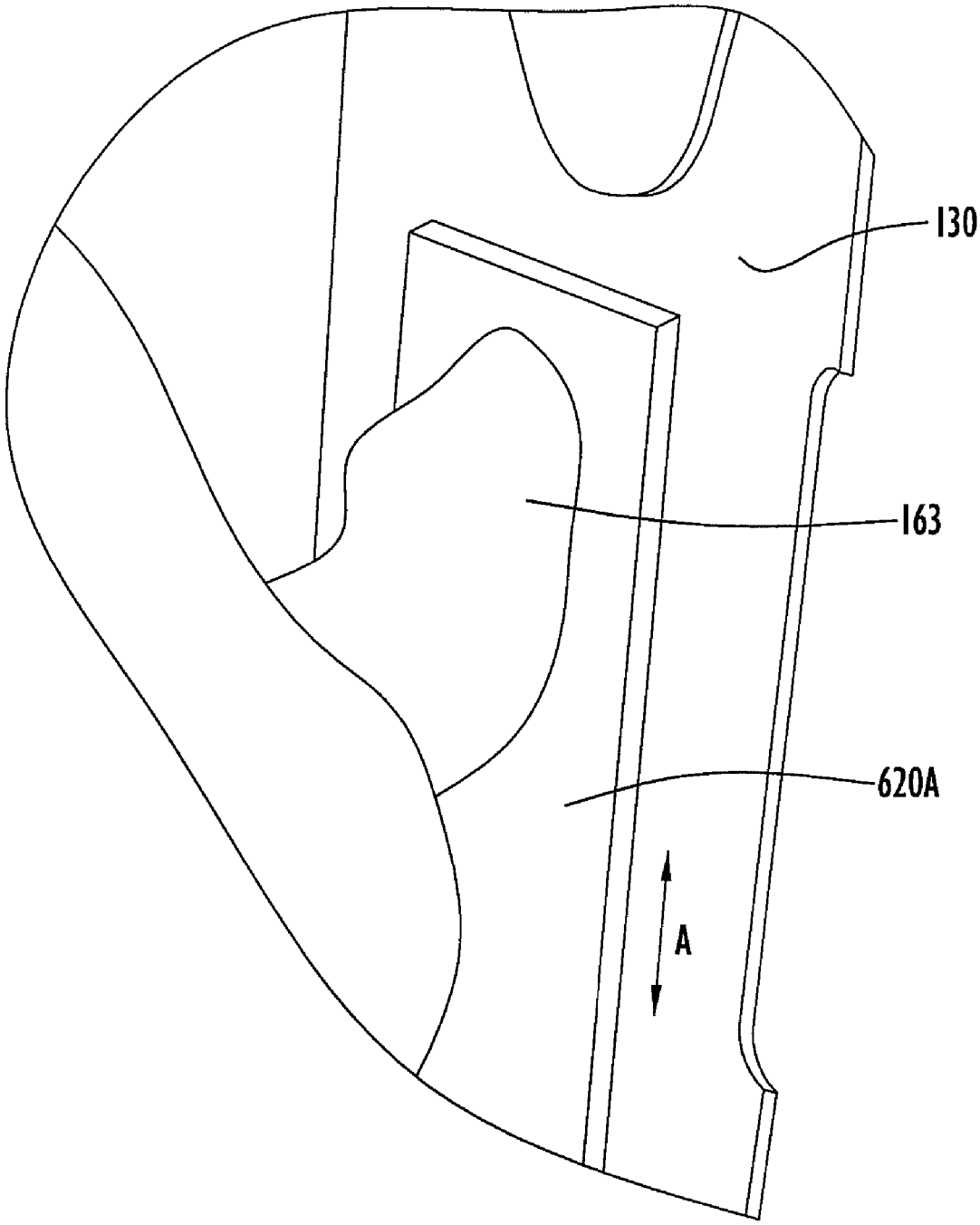

Each stanchion 620A, 620B may extend upward from the display panel 155 along the side walls 130, 140. With this configuration, the rocking/tilting of the base 610 extends one stanchion 620 further into the area above the display panel 155, while retracting the opposite stanchion 620 beneath the display panel 155. The toy 160 (or portions 161-166 of the toy 160) may be coupled to the stanchions 620A, 620B. By way of example, the second movable portion 163 (first arm/hand) of the toy 160 may be connected to the first stanchion 620A and the fourth movable portion 165 (second arm/hand) of the toy 160 may be connected to the second stanchion 620B. As a result, as the base 610 is tilted, the stanchions 620A, 620B move, driving the movable portions 163, 165 of the toy 160. FIGS. 21A and 21B illustrate close-up, perspective views of the inner side of the first side package portion 130, showing the connection of the toy 160 to the stanchions of the rocking assembly.

Figure 22A:
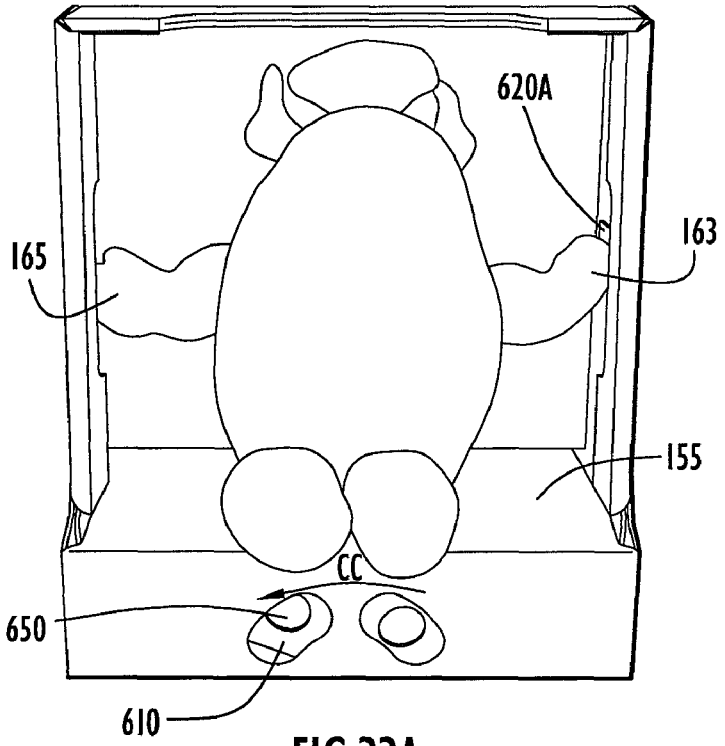
FIGS. 22A and 22B illustrate front perspective views of the display packaging of FIG. 19, showing the operating of the rocking assembly to move the toy from a first display position to a second display position.
Figure 22B:
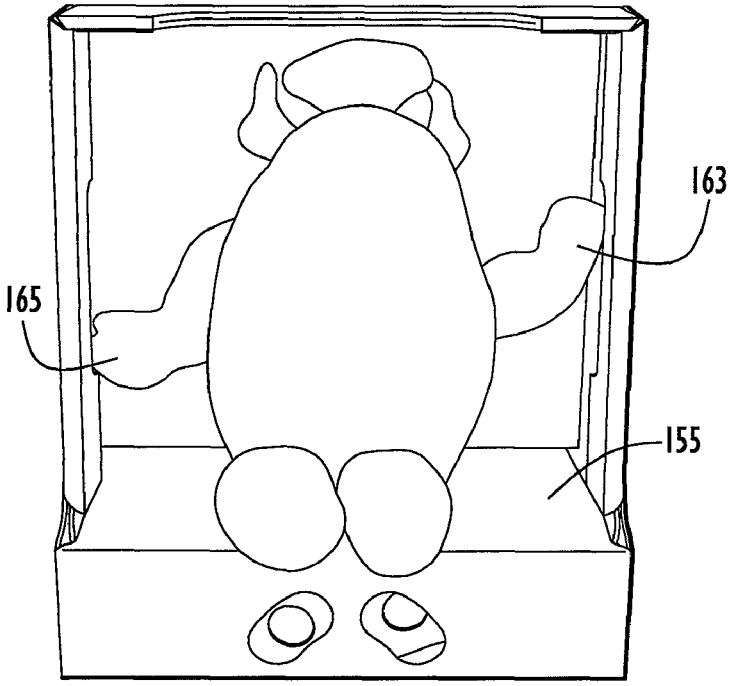

Operation of the display package 100 of FIG. 19 is explained with reference to FIGS. 22A and 22B (as well as FIG. 21B). The toy 160 begins in its first display position (FIG. 22A). A user engages the finger holes 650, tilting the base 610 counterclockwise (indicated by arrow CC). This tilting motion raises the first stanchion 620A with respect to the display panel 155, and lowers the second stanchion 620B. As a result, the second movable portion 163 of the toy is raised, while the fourth moveable portion 165 of the toy 160 is lowered with respect to the display panel 155. When the base is tilted clockwise, the opposite motion occurs—the second movable portion 163 is lowered and the fourth movable portion 165 is raised. As a result, the toy 160 is capable of moving from a first display position (FIG. 22A) to a second display position (FIG. 22B), and vice versa.

Figure 23:
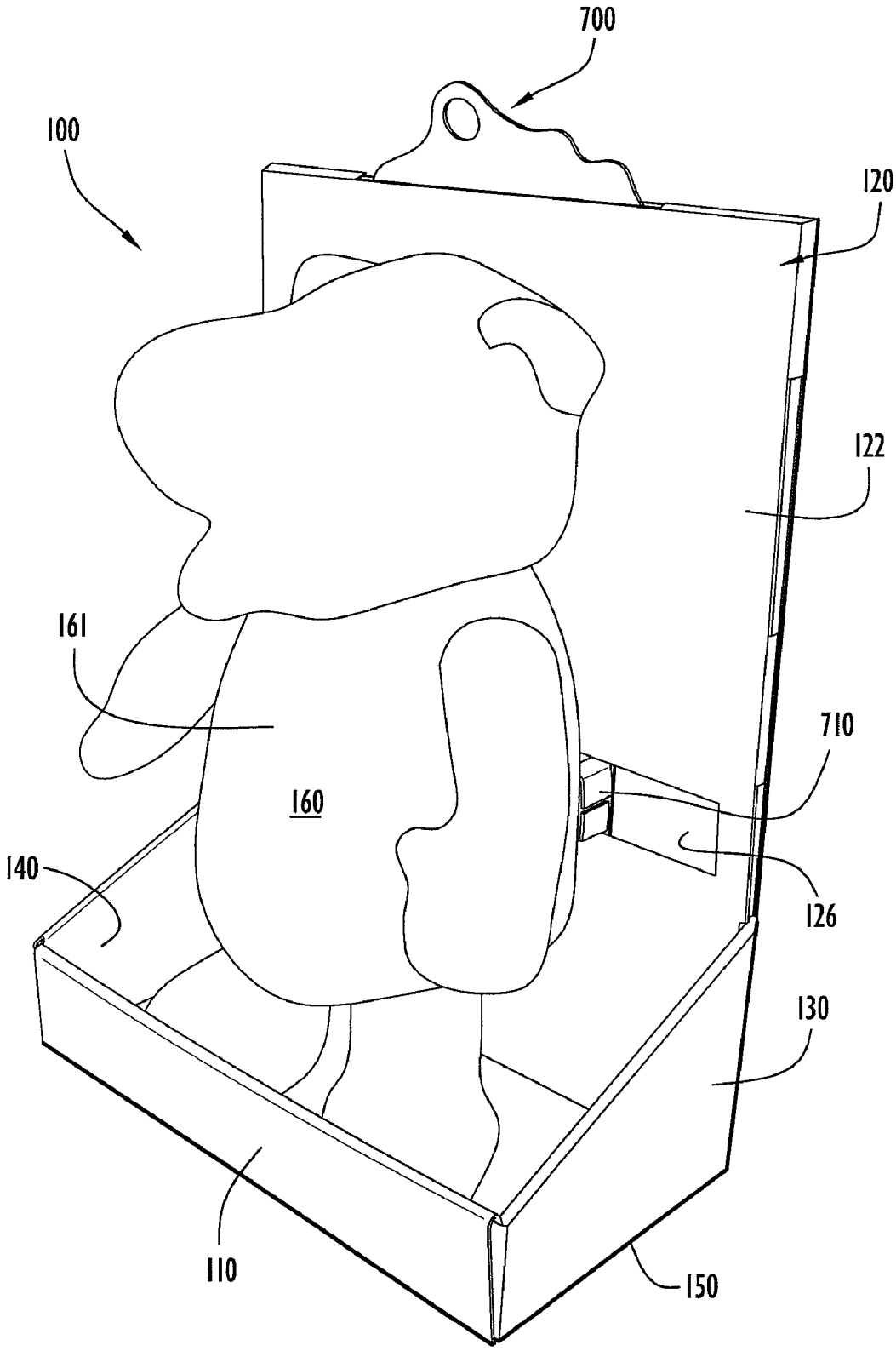
FIG. 23 illustrates a perspective view of display packaging in accordance with another embodiment of the present invention.

FIGS. 23-26 illustrate a display package 100 according to another embodiment of the present invention. FIG. 23 illustrates a perspective view of the display package 100. As shown, the display package 100 of FIG. 23 includes a general structure similar to that described above including a front package portion 110, a rear package portion 120, side package portions 130, 140, and a bottom package portion 150. The display package 100 of FIG. 23 may further contain a rotatable disk assembly 700 operable to move the toy 160 (or a portion 161-166 thereof) from a first display position to a second display position, and vice versa. The rear package portion 120 may include a slot 126 (e.g., a generally horizontal slot) formed into the interior wall 122. The slot 126 receives a sliding member 710 coupled to the toy (e.g., to the rear of the torso 161).

Figure 24:
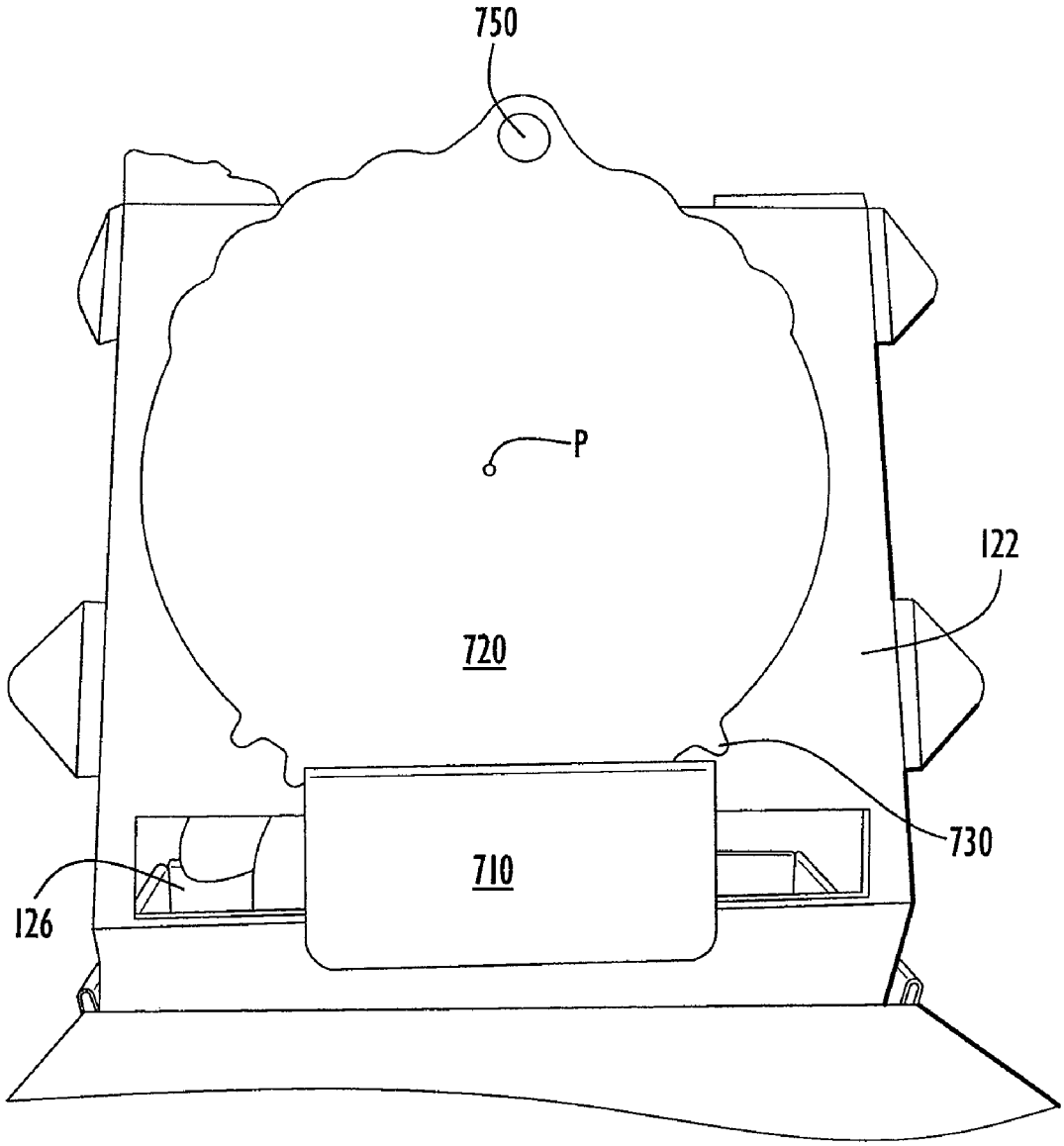
FIG. 24 illustrates an internal, rear view of the display packaging of FIG. 23, showing a rotatable gear in communication with a sliding member.
Figure 25:
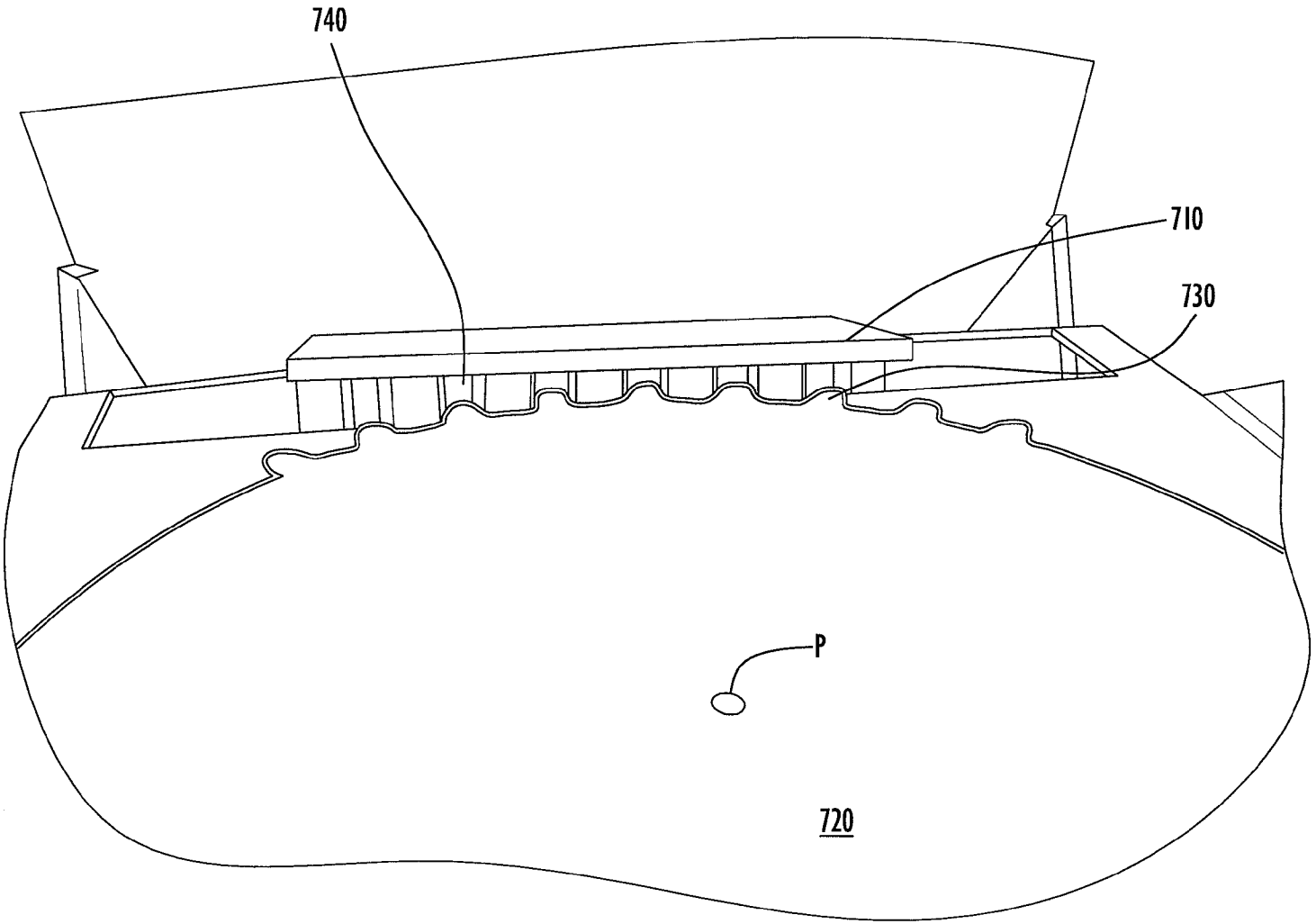
FIG. 25 illustrates a top perspective view of the rotatable gear and sliding member of FIG. 24, showing the interaction between the sliding member and the rotatable gear.

FIG. 24 is an internal, rear perspective view of the display package with the exterior wall 124 removed for clarity. A disk 720 may be coupled to the rear package portion 120 (e.g., captured between the interior wall 122 and the exterior wall 124) such that it is adapted to rotate about point P. The disk 720 may include a series of teeth 730 adapted to mesh with recesses 740 formed in the sliding member 710. FIG. 25 is a top perspective view of the disk 720 and sliding member 710, showing the interaction between the sliding member 710 and the rotatable disk 720. This is similar to the gear assembly discussed above with reference to the embodiment of FIGS. 9-13. The disk 720 may further include a finger hole 750 (see FIG. 24) protruding up from the rear package portion 120 that enables the rotation of the disk 720 about the pivot point P. Thus, as the disk 720 rotates, the teeth 730 engage recesses 740 formed in the sliding member 710, causing its lateral movement along the slot 126. Since the toy 160 (or a portion of the toy) is coupled to the sliding member 710, movement of the disk 720 results in the movement of the toy 160.

Figure 26A:
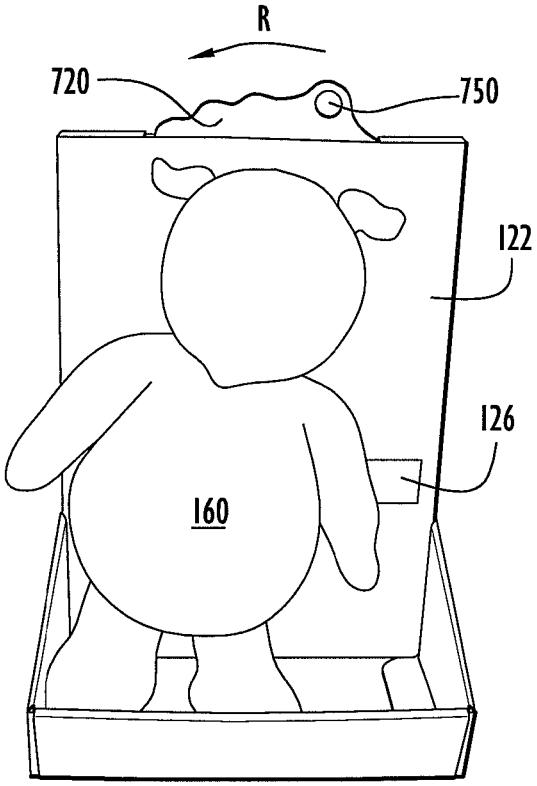
FIGS. 26A and 26B illustrate front perspective views of the display packaging of FIG. 23, showing the operation of the rotatable gear assembly and sliding member to move the toy from a first display position to a second display position.
Figure 26B:
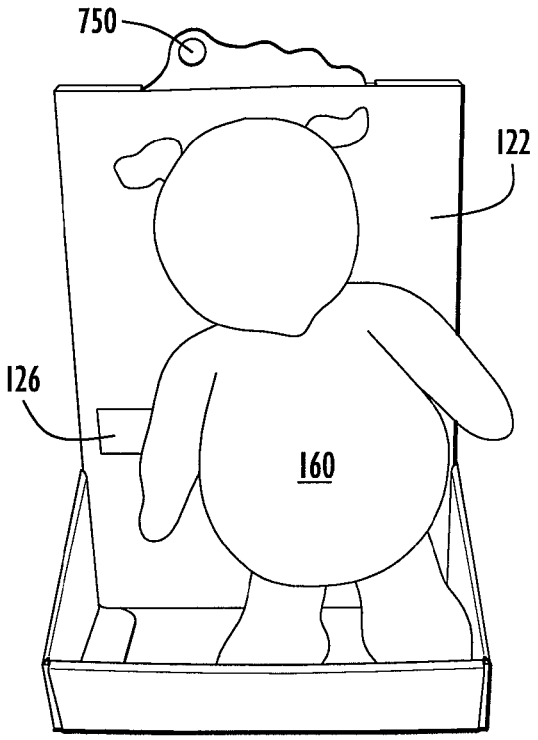

Operation of the display package 100 of FIG. 23 is explained with reference to FIGS. 26A and 26B. The toy 160 begins in its first display position (FIG. 26A). The finger hole 750 is engaged to rotate the disk 720 either clockwise or counterclockwise. As the disk 720 rotates, its teeth 730 engage the recesses 740 of the sliding member 710, moving it along the slot 126 formed in the interior wall 122. The toy 160, coupled to the sliding member 710, moves with the sliding member 710, causing the toy to be repositioned within the display package 100. With this configuration, the toy 160 and/or portions thereof 161-166 are capable of moving from a first display position (FIG. 26A) to a second display position (FIG. 26B). For example, a hip swaying motion may be generated in the toy 160.

Figure 26C:
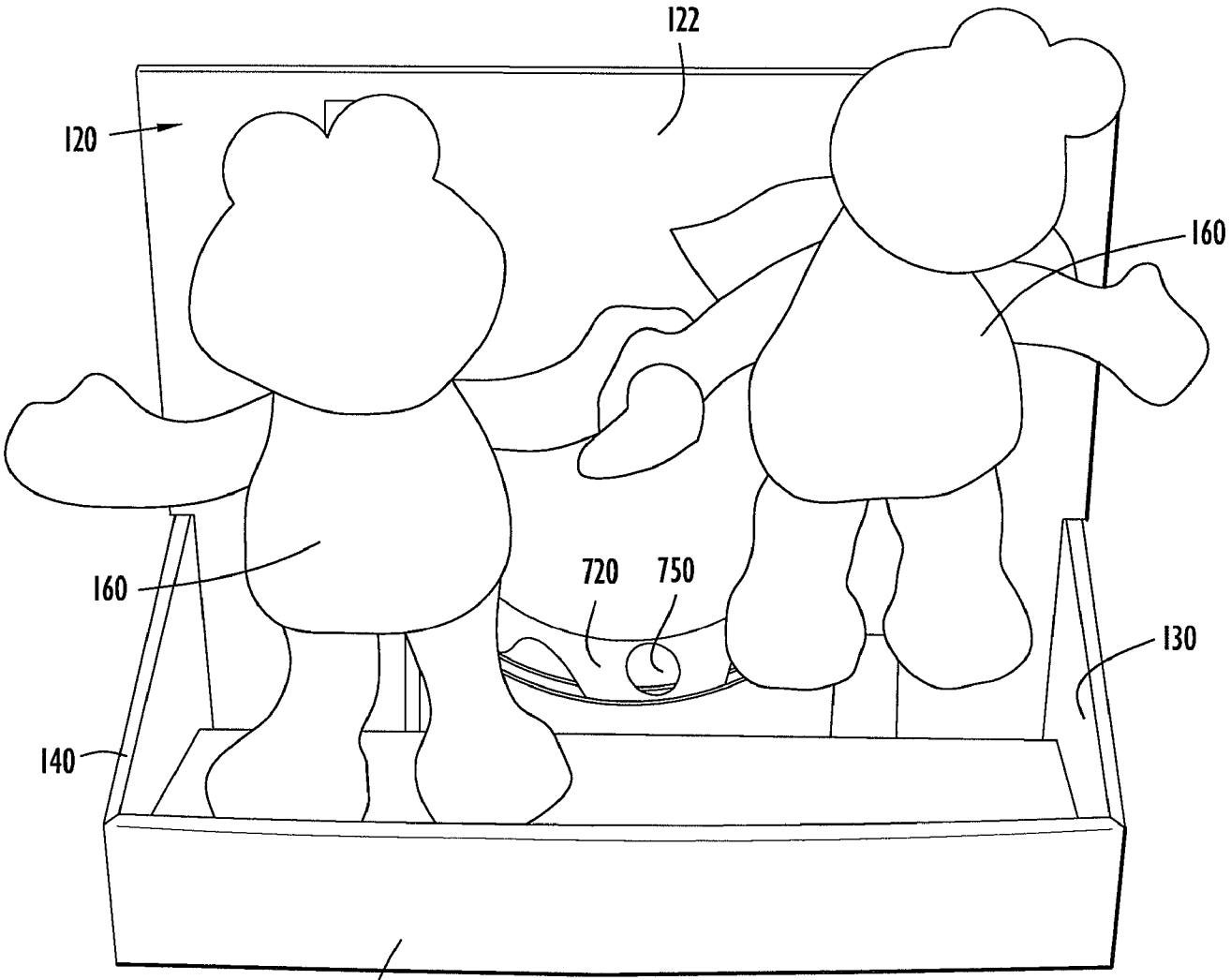
FIG. 26C illustrates a front perspective view of display packaging in accordance with another embodiment of the invention.

FIG. 26C further shows an embodiment similar to that of FIG. 23, which includes a rotatable disk assembly 700 operable to selectively move a pair of toys 160 from a first display position to a second display position, and vice versa. Specifically, the rear package portion 120 may include a slot 126 with a finger hole 750 that enables the rotation of a disk 720 about a pivot point. In addition, the interior wall 122 may further include a pair of slots 126, each including a sliding member 710 (not illustrated) coupled to a respective toy 160. With this configuration, manipulating the finger hole 750 causes a corresponding motion in the toys 160, moving the toys 160 up and down to generate a jumping motion. Specifically, rotating the finger hole 750 counterclockwise may cause one toy 160 to "jump" in the packaging 100, while rotating the finger hole clockwise may cause the other toy to jump.

Figure 27:
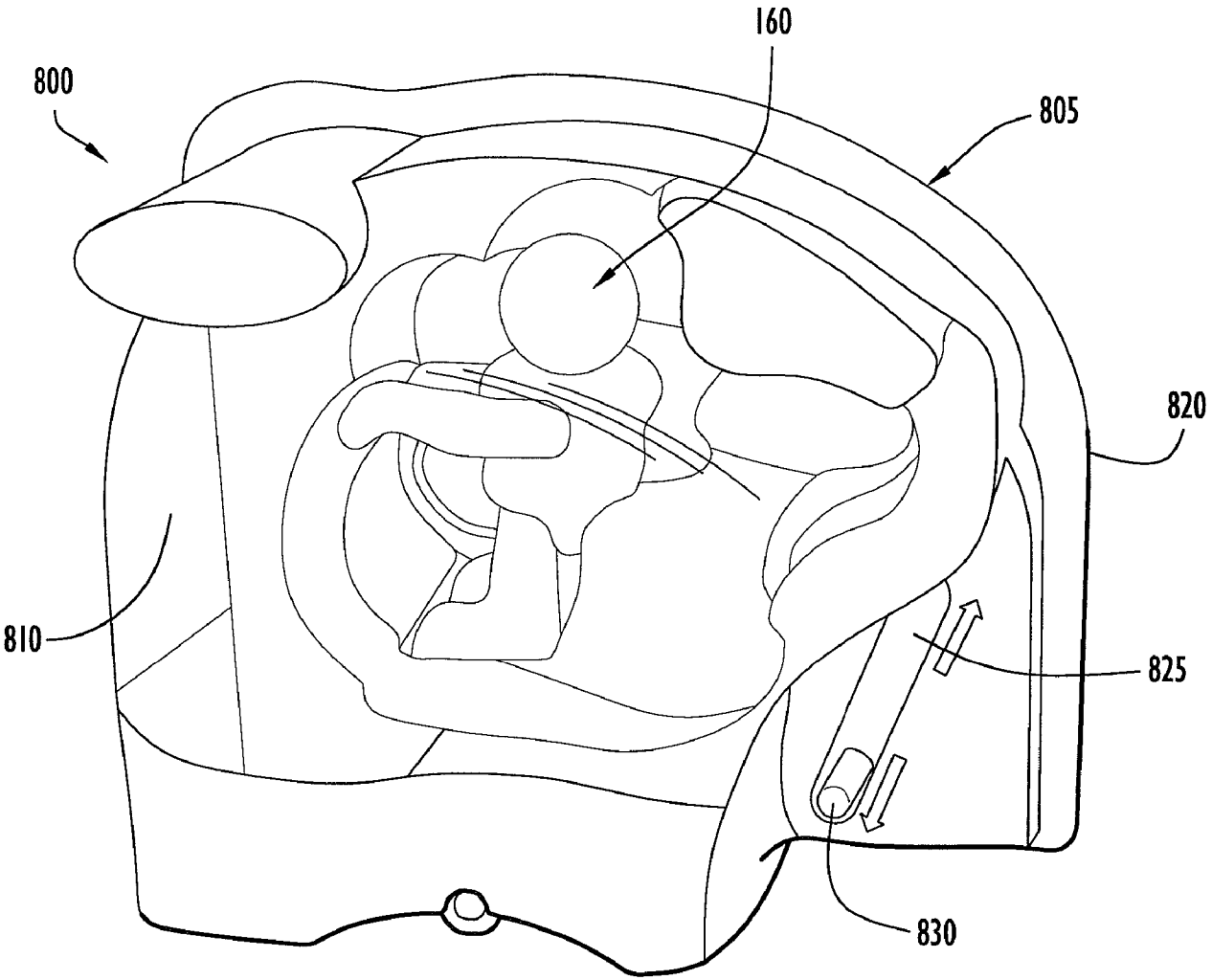
FIG. 27 illustrates a front perspective view of blister-type display packaging in accordance with an embodiment of the present invention.

FIGS. 27-31 illustrate a display package according to another embodiment of the present invention. FIG. 27 illustrates a front perspective view of the display package 800. As illustrated, the display package 800 may have a blister or bubble pack configuration including an outer shell 805 with a front package portion 810 and a rear package portion 820. The front package portion 810 may be formed from a transparent, molded piece of plastic coupled to the rear package portion 820. The rear package portion 820 may be formed from, but is not limited to, a sheet of cardboard. The front package portion 810 may further include a slot 825 configured to slidably engage an actuator knob 830, which, in turn, drives motion of the toy 160 as described below.

Figure 28A:
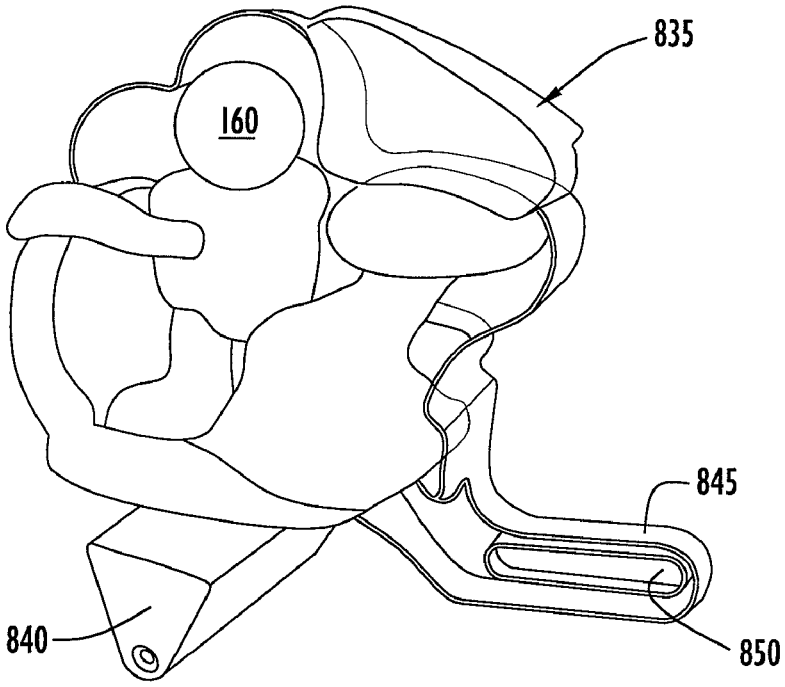
FIGS. 28A and 28B illustrate front and rear perspective views, respectively, of an inner shell contained within the display packaging of FIG. 27.
Figure 28B:
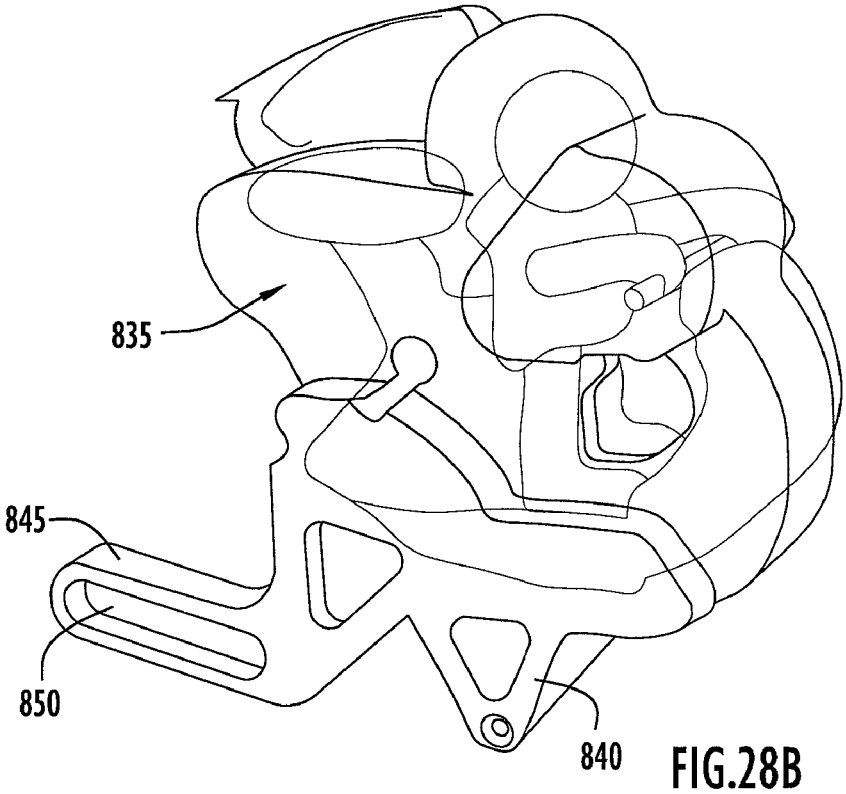
Figure 29:
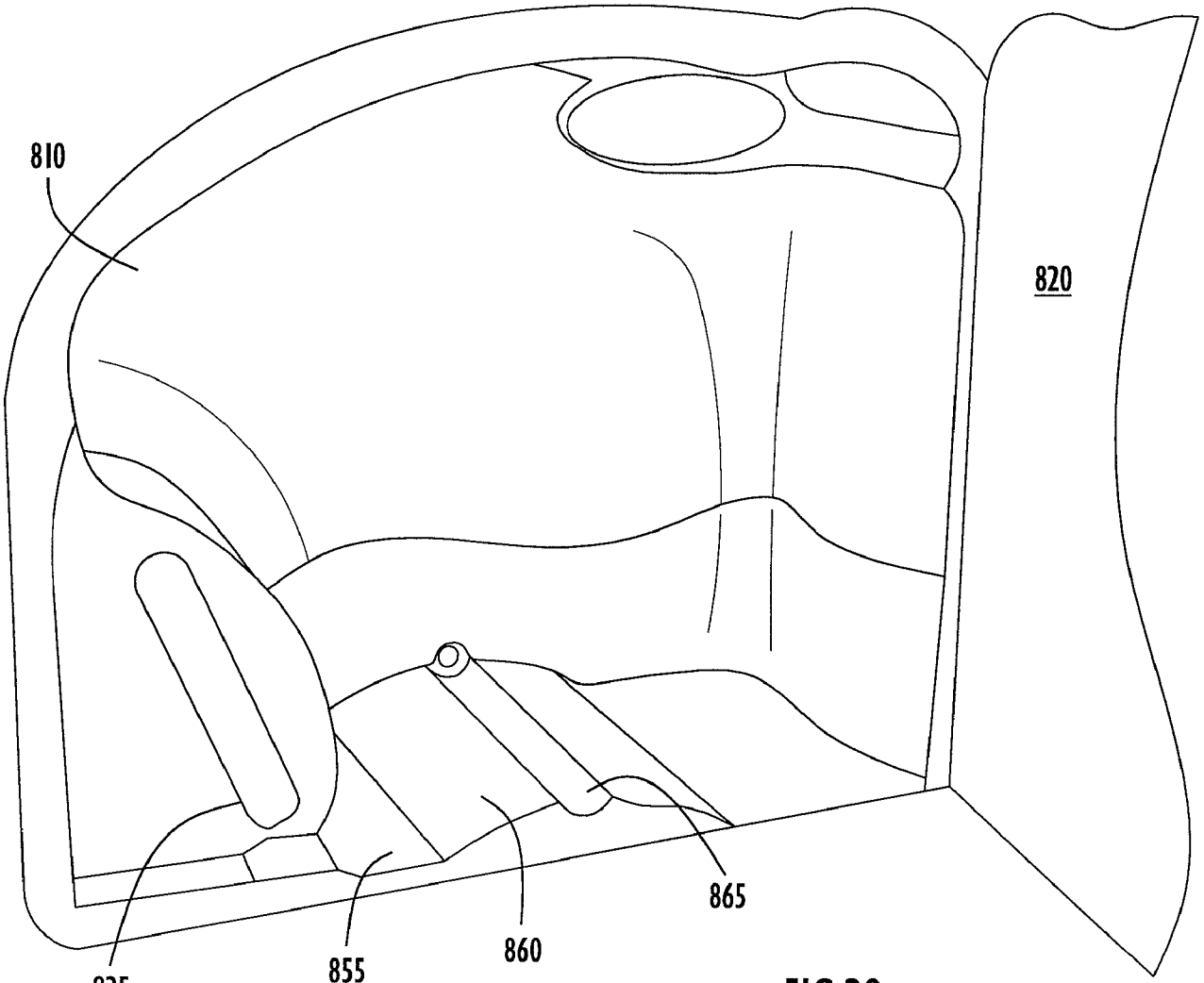
FIG. 29 illustrates an internal, rear view of the outer shell of the display packaging of FIG. 27.

The display package 800 may further include a manually-manipulated animation mechanism operable to move the toy 160 (or a portion thereof) from a first display position to a second display position, and vice versa. The display package 800 may further include an inner shell 835 configured to support the toy 160 within the outer shell 805. FIGS. 28A and 28B are front and rear perspective views, respectively, of an inner shell 835 contained within the display package 800. As illustrated, the inner shell 835 may be formed from a transparent, molded plastic and include a compartment that receives the toy 160. The inner shell 835 may further include a generally wedge-shaped tab 840 extending from its bottom surface, as well as a transversely extending lever arm 845 including a channel 850 operable to receive the actuator knob 830, discussed above. FIG. 29 illustrates an internal, rear view of the front portion 810 of the display package 800. The bottom 855 of the front package portion 810 may include a raised area 860 with a recess 865 formed therein that is configured to pivotally receive the wedge-shaped tab 840 of the inner shell 835. As a result, the recess 865 functions as the fulcrum of the lever arm 845 (and thus of the inner shell 835).

Figure 30A:
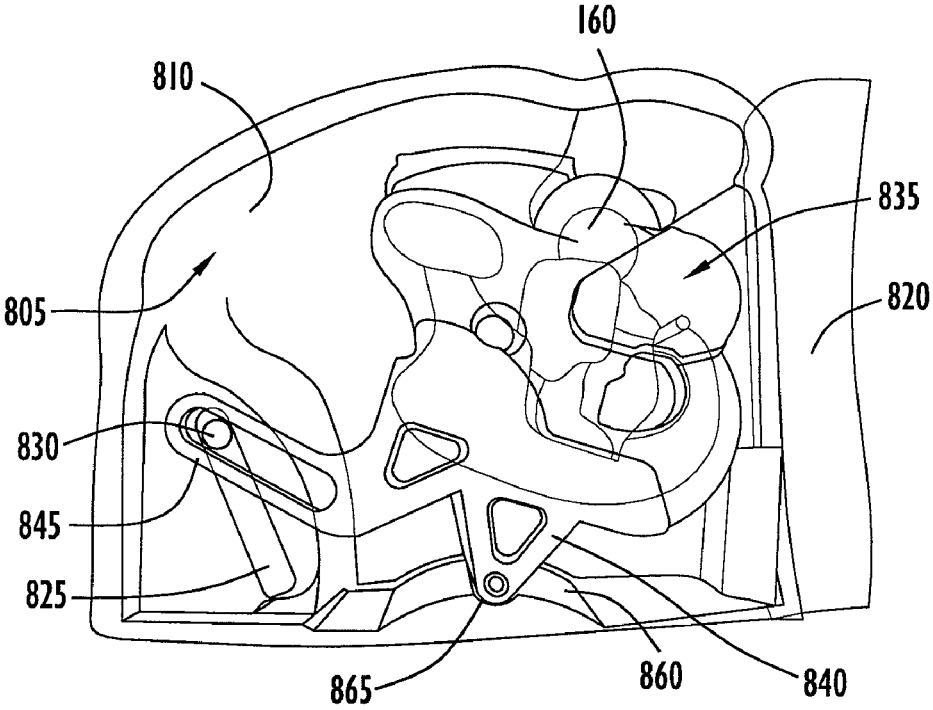
FIGS. 30A and 30B illustrate internal, rear views of the display packaging of FIG. 27, showing the interaction between the inner shell and the outer shell.
Figure 30B:
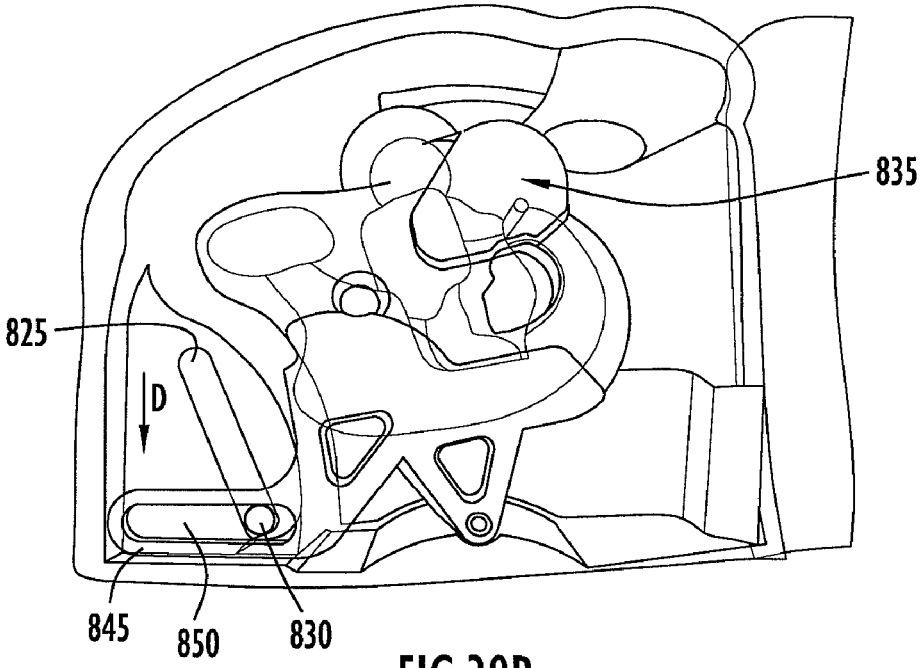
Figure 31A:
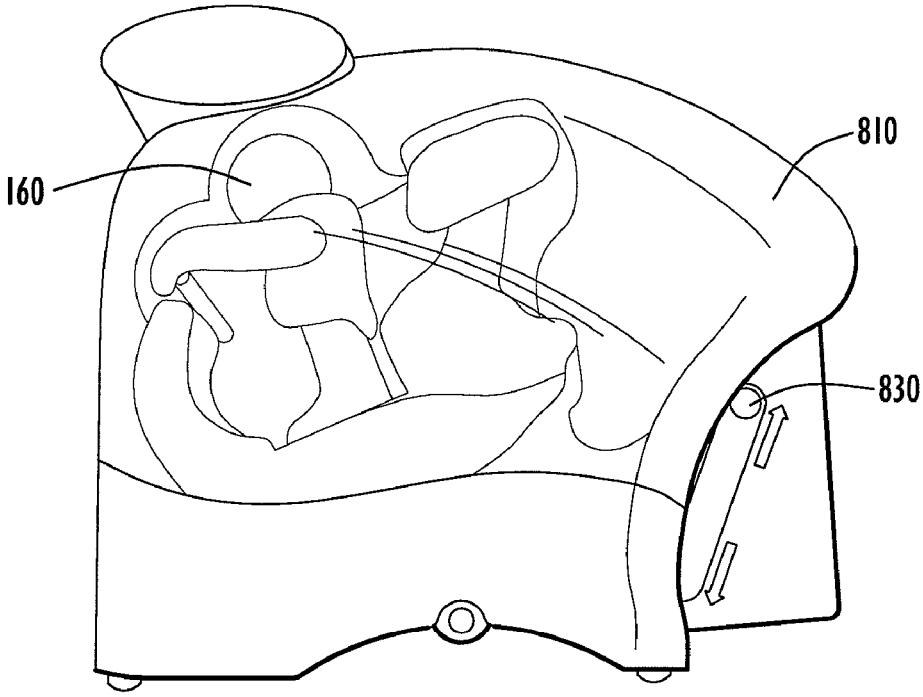
FIGS. 31A and 31B illustrate front views of the display packaging of FIG. 27, showing the operation of the animation mechanism to move the toy from a first display position to a second display position.
Figure 31B:
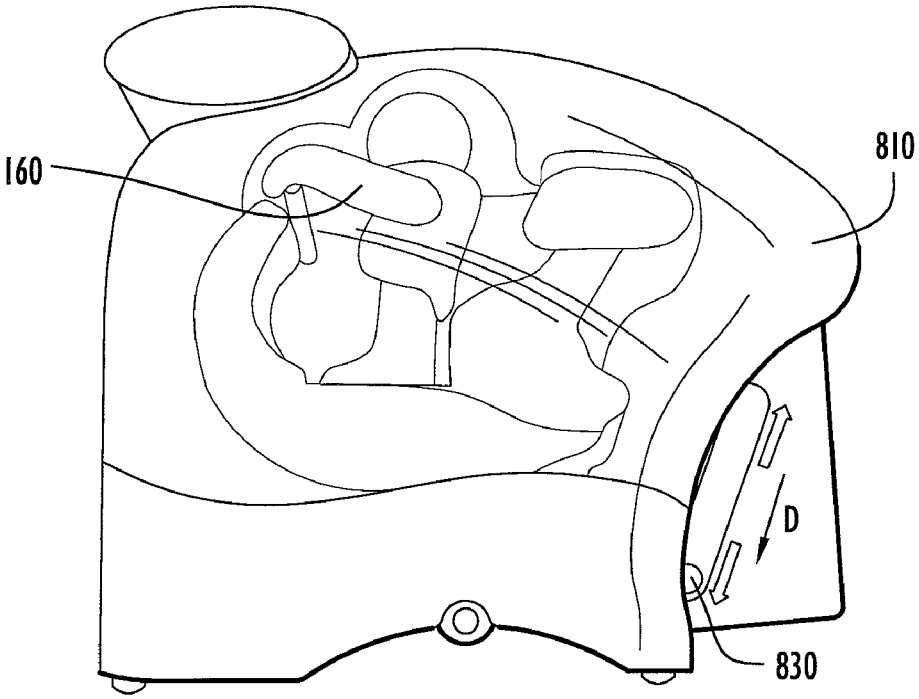

Operation of the display package of FIG. 27 is described with reference to FIGS. 30A, 30B, 31A, and 31B. FIGS. 30A and 30B are internal, rear views of the display package 800, with the rear package portion 820 removed for clarity. Note that the actuator knob 830 is slidingly captured with the rear package portion 820. FIGS. 31A and 31B are front views of the display package 800, with the rear package portion 820 in place. The inner shell 835 is positioned within the front package portion 810 such that the wedge-shaped tab 840 rests within the recess 865. A force may be applied to the actuator knob 830 (e.g., a downward force, indicated by arrow D) to move the actuator knob 830 along slot 825, which applies a corresponding force to the lever arm 845. As the lever arm pivots, the inner shell 835 (and thus the toy 160) moves from a first display position (FIGS. 30A, 31A) to a second display position (FIGS. 30B, 31B). Conversely, applying an opposite force to the actuator knob 830 pivots the toy 160 from the second display position back to the first display position. As a result, the toy appears to fly within the packaging, rocking therein.

Figure 32:
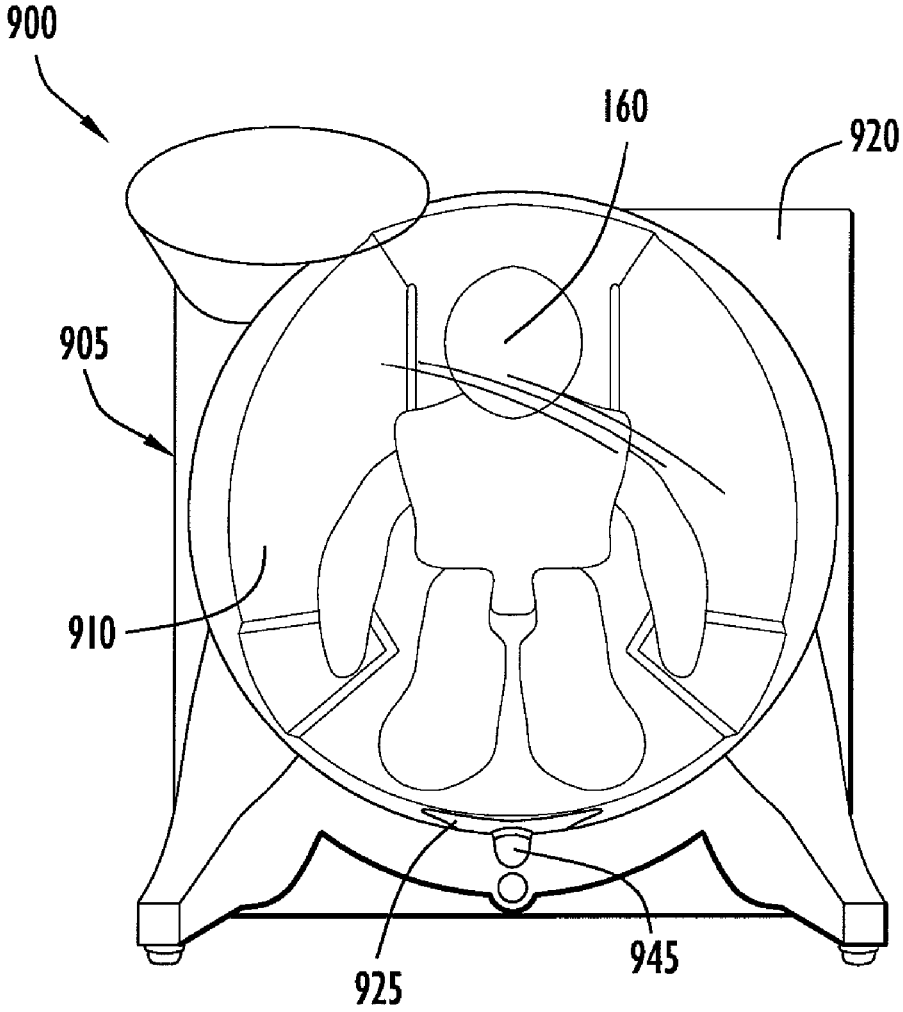
FIG. 32 illustrates a front perspective view of blister-type display packaging in accordance with another embodiment of the present invention.

FIGS. 32-36 illustrate a display package in accordance with another embodiment of the present invention. FIG. 32 illustrates a front perspective view of the display package 900. As shown, the display package 900 may have a blister or bubble pack configuration including an outer shell 905 with a front package portion 910 and a rear package portion 920. The front package portion 910 may be formed from a transparent, molded piece of plastic coupled to the rear package portion 920. The rear package portion 920 may be formed from, but is not limited to, a sheet of cardboard. The front package portion 910 may further include an opening 925 through which a user may access a rotatable control knob 945 to reorient the toy 160 within the packaging 900, as described below.

Figure 33A:
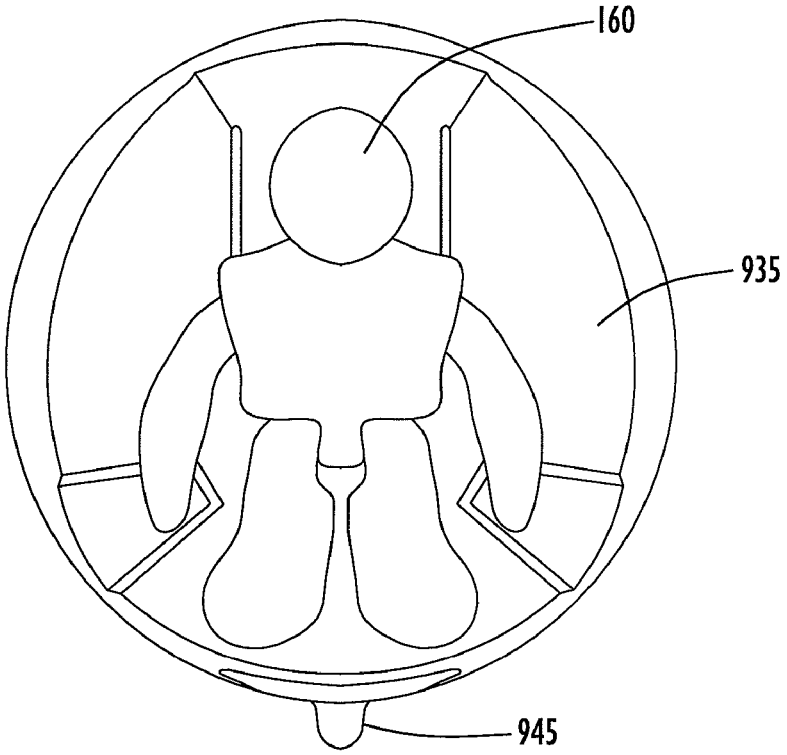
FIGS. 33A and 33B illustrate front and side perspective views, respectively, of an inner shell contained within the display packaging of FIG. 32.
Figure 33B:
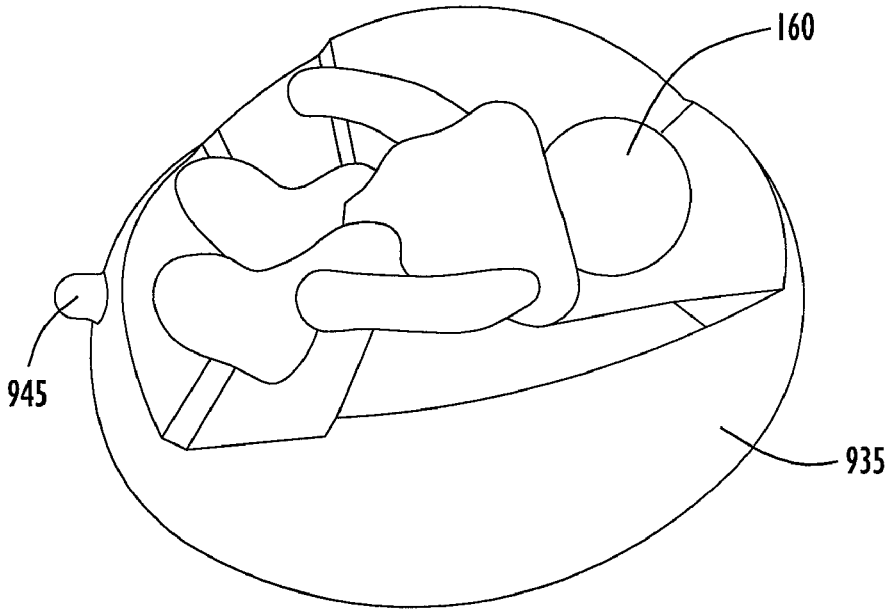
Figure 34:
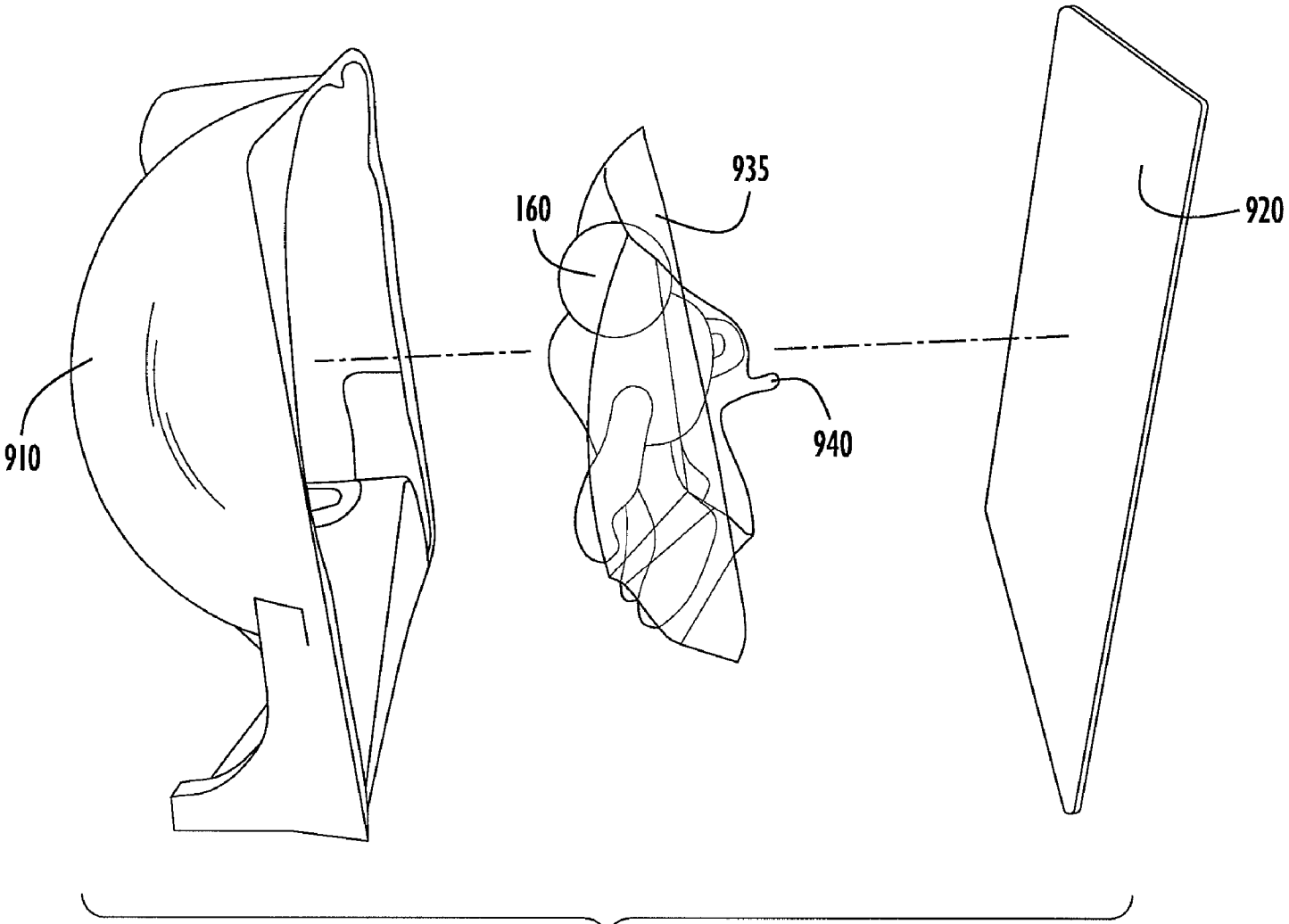
FIG. 34 illustrates an exploded view of the display packaging of FIG. 32.

The display package 900 may further include a manually-manipulated animation mechanism operable to reorient the toy 160 (or a portion thereof) from a first display position to a second display position, and vice versa. The display package 900 may further include an inner shell 935 configured to support the toy 160 within the outer shell 905. FIGS. 33A and 33B are top and side perspective views, respectively, of an inner shell 935 contained within the outer shell 905 of the display package 900. As illustrated, the inner shell 935 may be formed from a generally transparent, molded plastic and include a compartment that receives the toy 160. The inner shell 935 may completely or partially enclose the toy 160. FIG. 34 is a side exploded view of the display package 900. The inner shell 935 may further include a pivot post 940 extending from its back surface, as well as a control knob 945 extending from its bottom surface. The pivot post 940 is configured to engage the rear portion 920 of the display package such that the inner shell 935 may be selectively tilted on the rear package portion 920. Alternatively, a separate receptacle (not shown) may be a disposed on the inner surface of the rear package portion 920 and configured to engage the post 940. The inner shell 935 is received within the front package portion 910 such that it may be reoriented within the outer shell 905. The control knob 945 extends through the opening 925 in the front package portion 910.

Figure 35A:
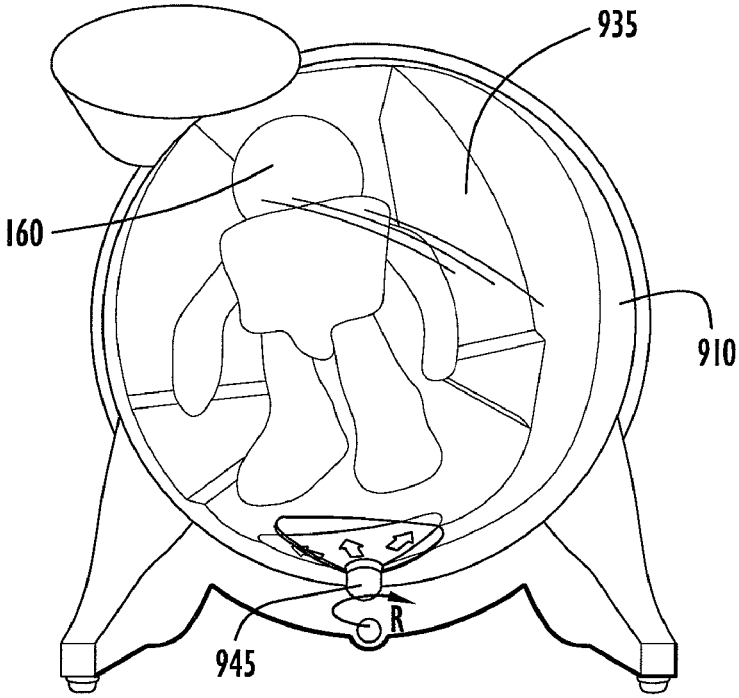
FIGS. 35A and 35B illustrate front views of the outer and inner shells of the display packaging of FIG. 32 with the rear package portion removed for clarity, showing the operation of the animation mechanism to move the toy from a first display position to a second display position.
Figure 35B:
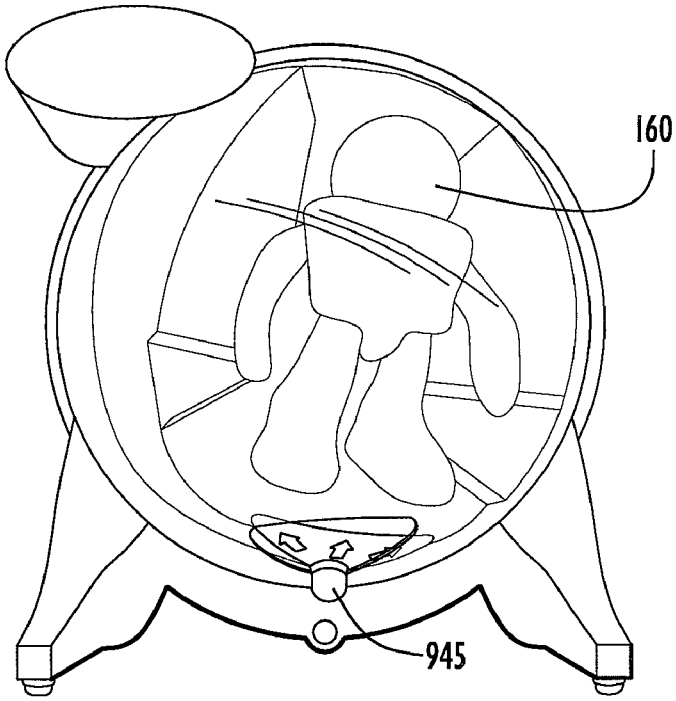
Figure 36A:
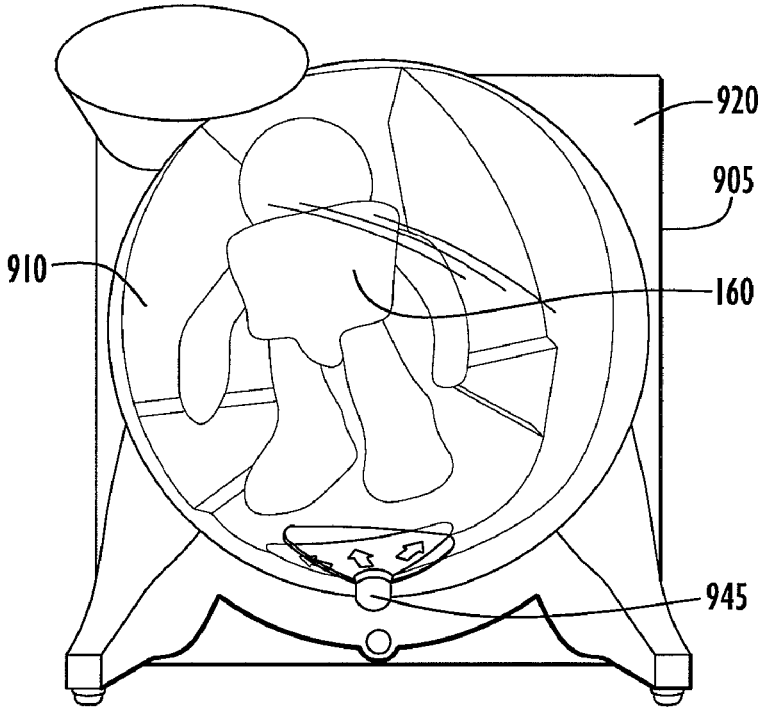
FIGS. 36A and 36B illustrate front views of the display packaging of FIG. 32, showing the operation of the animation mechanism to move the toy from a first display position to a second display position.
Figure 36B:
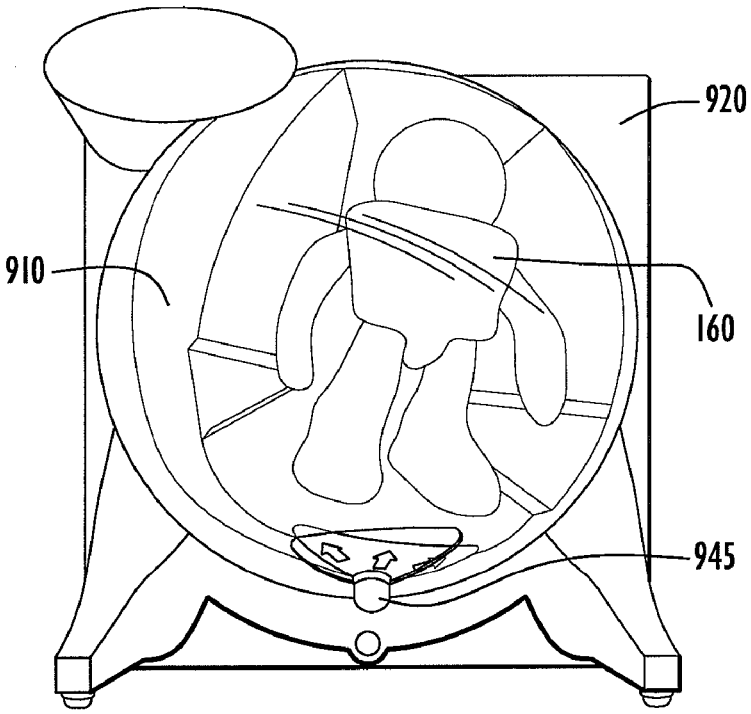

Operation of the display package 900 is described with reference to FIGS. 35A, 35B, 36A, and 36B. FIGS. 35A and 35B are front views of the display package 900, with the rear package portion 920 removed for clarity. FIGS. 36A and 36B are front views of the display package 900, showing the operation of the animation mechanism to move the toy from a first display position to a second display position. A force may be applied to the control knob 940 (e.g., a rotational force, indicated by arrow R), which tilts the inner shell 935 with respect to the rear package portion 920, moving the toy 160 a first display position (FIGS. 35A and 36A) to a second display position (FIGS. 35B and 36B). Conversely, applying an opposite force to the control knob 940 tilts the inner shell 935 with respect to the rear package portion 120, reorienting the toy 160 from the second display position back to the first display position. As a result, the toy 160 rotates and appears to fly within the packaging, floating therein.

Figure 37:
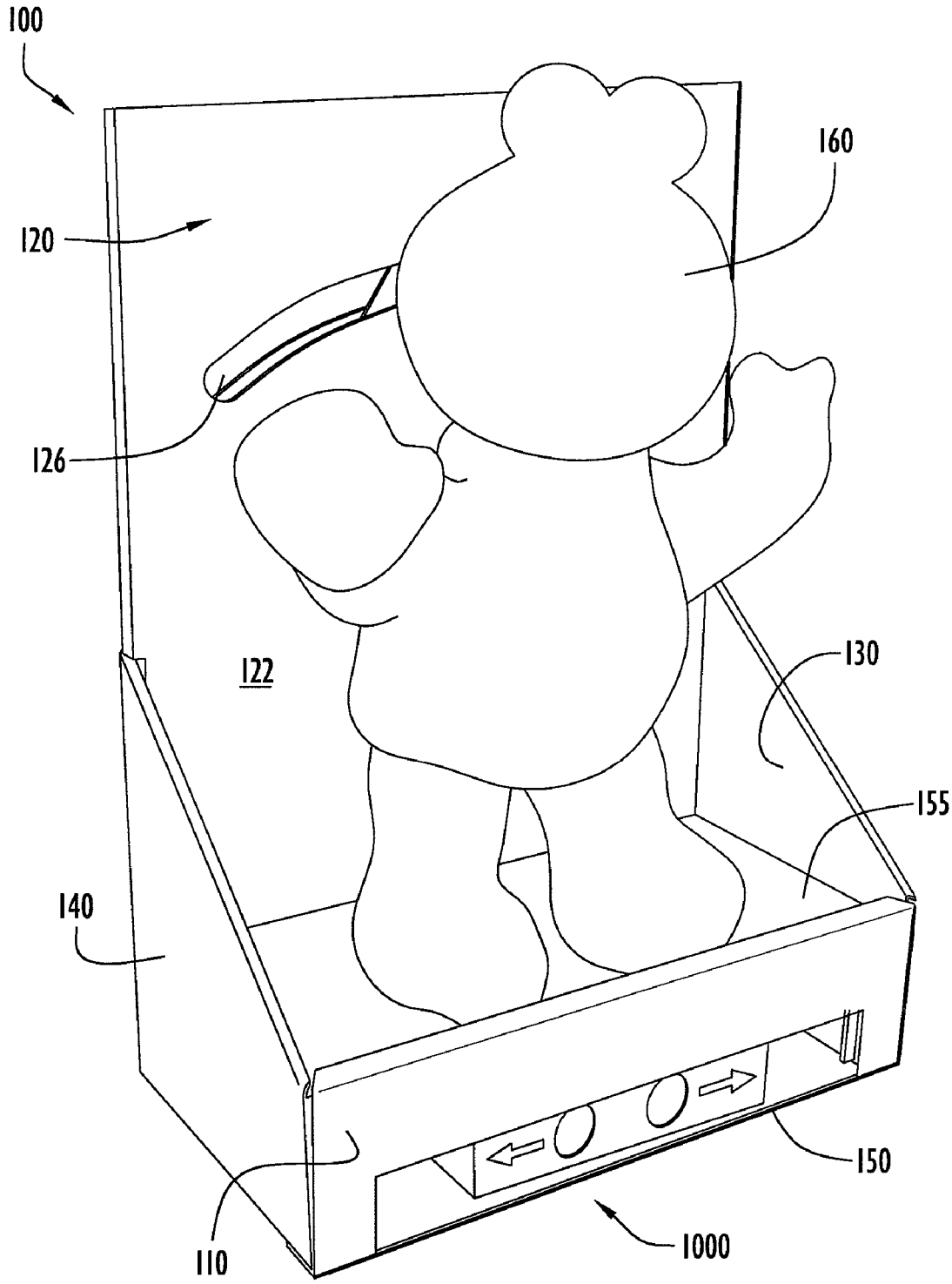
FIG. 37 illustrates a front perspective view of display packaging in accordance with yet another embodiment of the invention.

FIGS. 37-40 illustrate a display package 100 in accordance with another embodiment of the present invention. FIG. 37 illustrates a front perspective view of the display package 100. As shown, the display package 100 of FIG. 37 may have a general structure generally similar that described above with regard to FIGS. 1A-26B, having a front package portion 110, a rear package portion 120, side package portions 130, 140, and a bottom package portion 150. In addition, the display package may further include a display panel 155 positioned between the first and second side walls 130, 140, as well as between the front 110 and rear 120 package portions. The rear package portion 120 may include a slot 126 formed into the interior wall 122.

Figure 38:
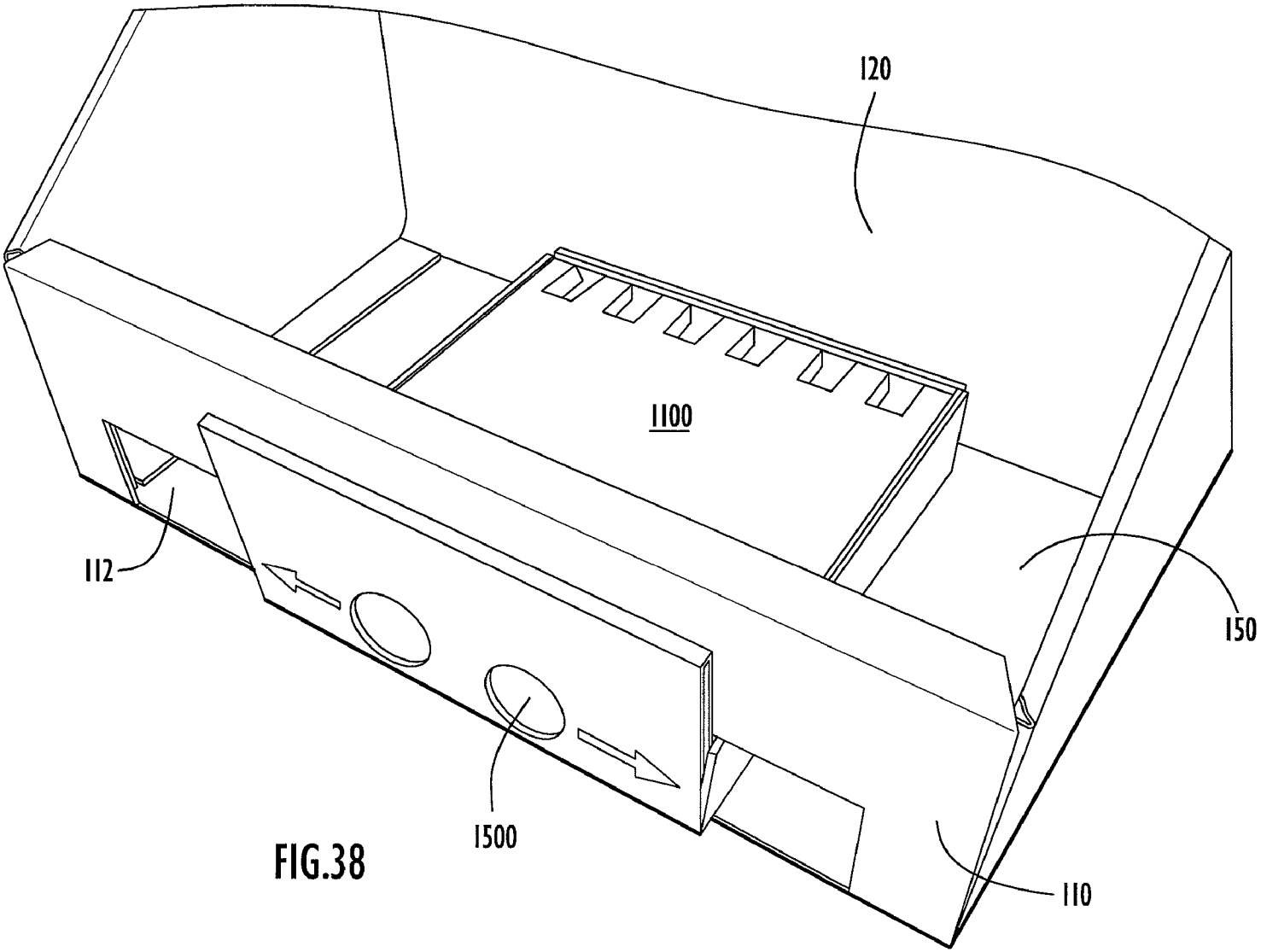
FIG. 38 illustrates an internal, front view of the display packaging of FIG. 37, showing the sliding platform of the animation mechanism.
Figure 39:
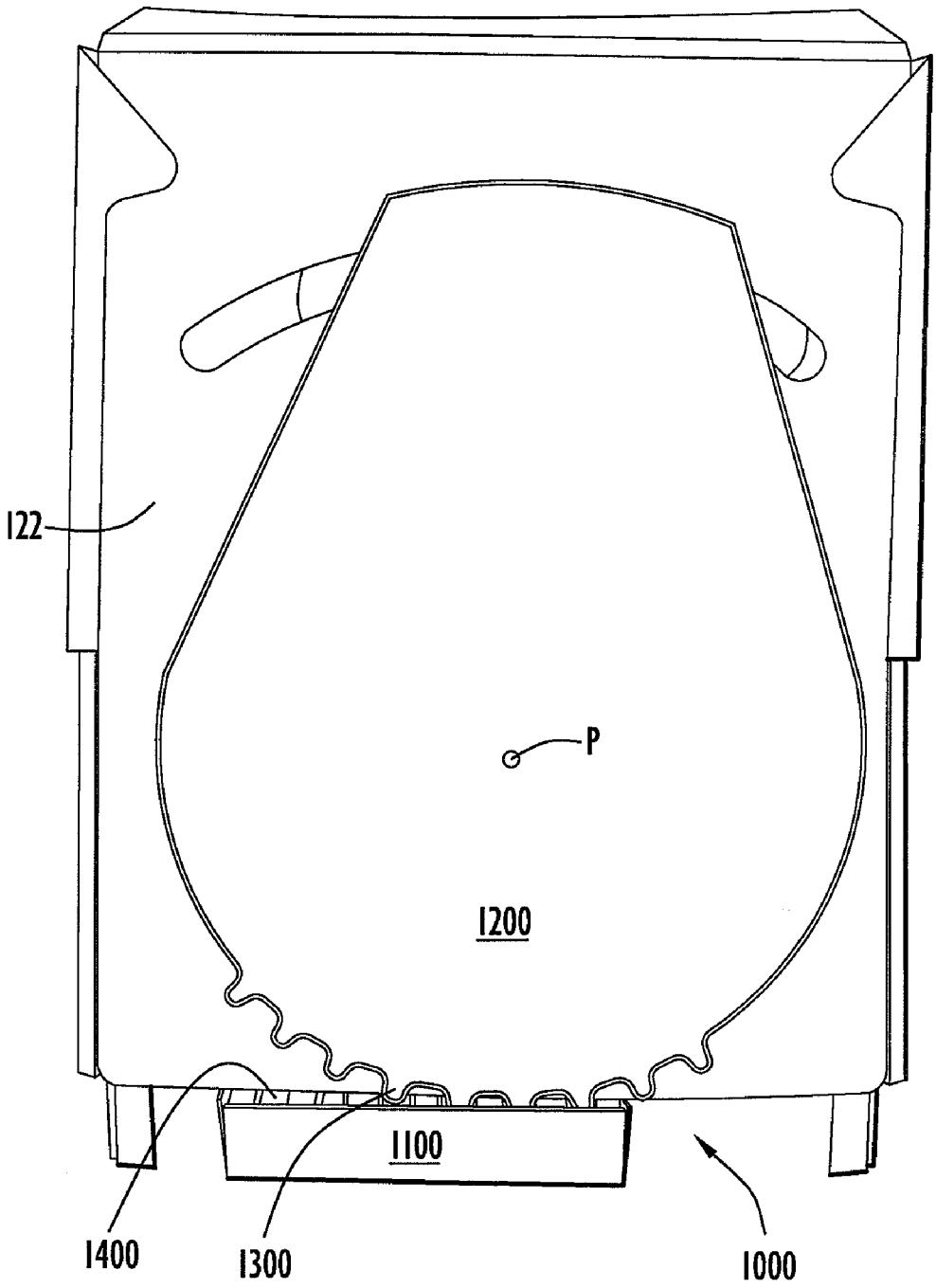
FIG. 39 illustrates an internal, rear view of the display packaging of FIG. 37, showing the pivoting plate of animation mechanism engaging the sliding platform.

The display package 100 of FIG. 37 may further contain an animation mechanism 1000 operable to move the toy 160 or a portion thereof 161-166 from a first display position to a second display position, and vice versa. FIG. 38 is a close-up view of the bottom portion of the display package 100 of FIG. 37, with the display panel 155 removed for clarity. As shown, the front package portion 110 includes an opening 112 and a platform 1100 adapted to slide within the opening 112 and over the bottom package portion 150. FIG. 39 is a rear, internal view of the display package 100 of FIG. 37 (with the exterior wall 124 removed for clarity), further showing the animation mechanism 1000. The rear package portion 120 may include a panel 1200 pivotally coupled to the rear package portion 120 (e.g., captured between the interior wall 122 and the exterior wall 124) such that it is adapted to rotate about pivot point P. The toy 160 may be connected to the opposite side of the panel 1200 via the slot 126 located on the interior wall 122. The panel 1200 may include a series of teeth 1300 adapted to mesh with recesses 1400 formed in the platform 1100. This is similar to the gear assembly discussed above with reference to the embodiment of FIGS. 9-13. The platform 1100 further includes at least one finger hole 1500 (see FIG. 38) that may be engaged to slide the platform 1100 along the opening 112 and across the bottom package portion 150. As the platform 1100 moves across the bottom package portion 150, the recesses 1400 engage the teeth 1300 of the panel 1200, pivoting the panel. Since the toy 160 (or a portion of the toy) is coupled to the panel 1200, movement of the panel 1200 results in the movement of the toy 160.

Figure 40A:
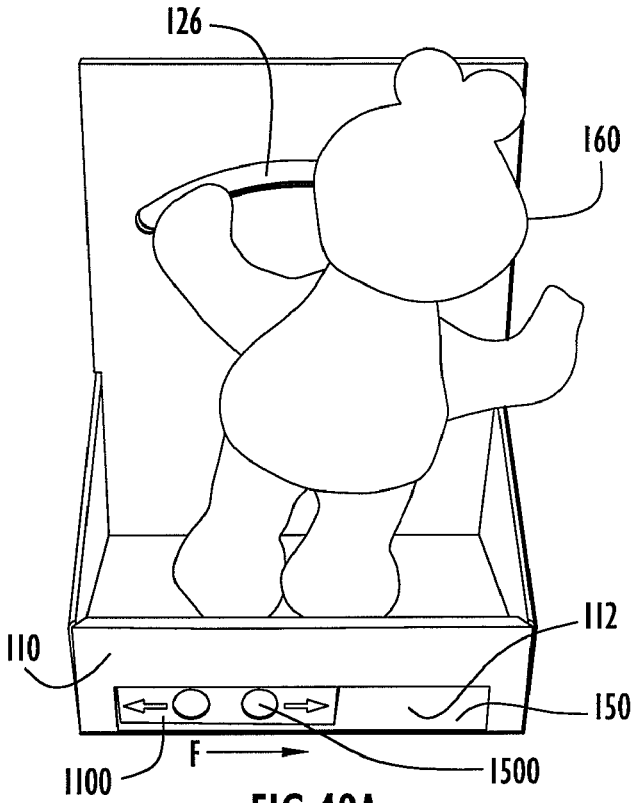
FIGS. 40A and 40B illustrate front perspective views of the display packaging of FIG. 37, showing the operation of the animation mechanism to move the toy from a first display position to a second display position.
Figure 40B:
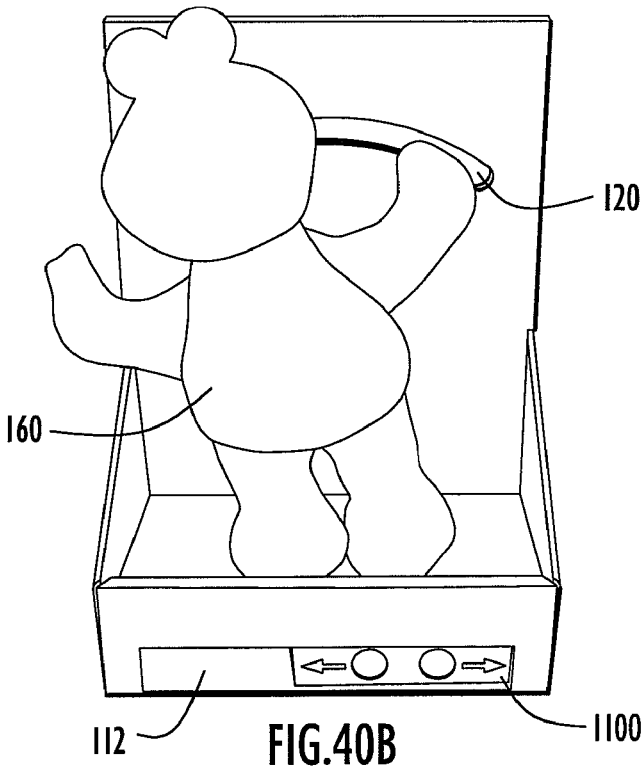

Operation of the display package 100 of FIG. 37 is explained with reference to FIGS. 40A and 40B. The toy 160 begins in its first display position (FIG. 40A). The finger hole 1500 is engaged to apply a force to the platform 1100 (indicated by arrow F). As the platform moves along the opening, the recesses 1400 engage the teeth 1300 of the panel 1200, pivoting the panel 1200 about the pivot point P. The toy 160, which is connected to the panel 1200, moves with the panel 1200, causing the toy to move within the display package 100. As a result, the toy 160 is capable of moving from a first display position (FIG. 40A) to a second display position (FIG. 40B), and vice versa. For example, a side bend motion may be generated in the toy 160.

Figure 41A:
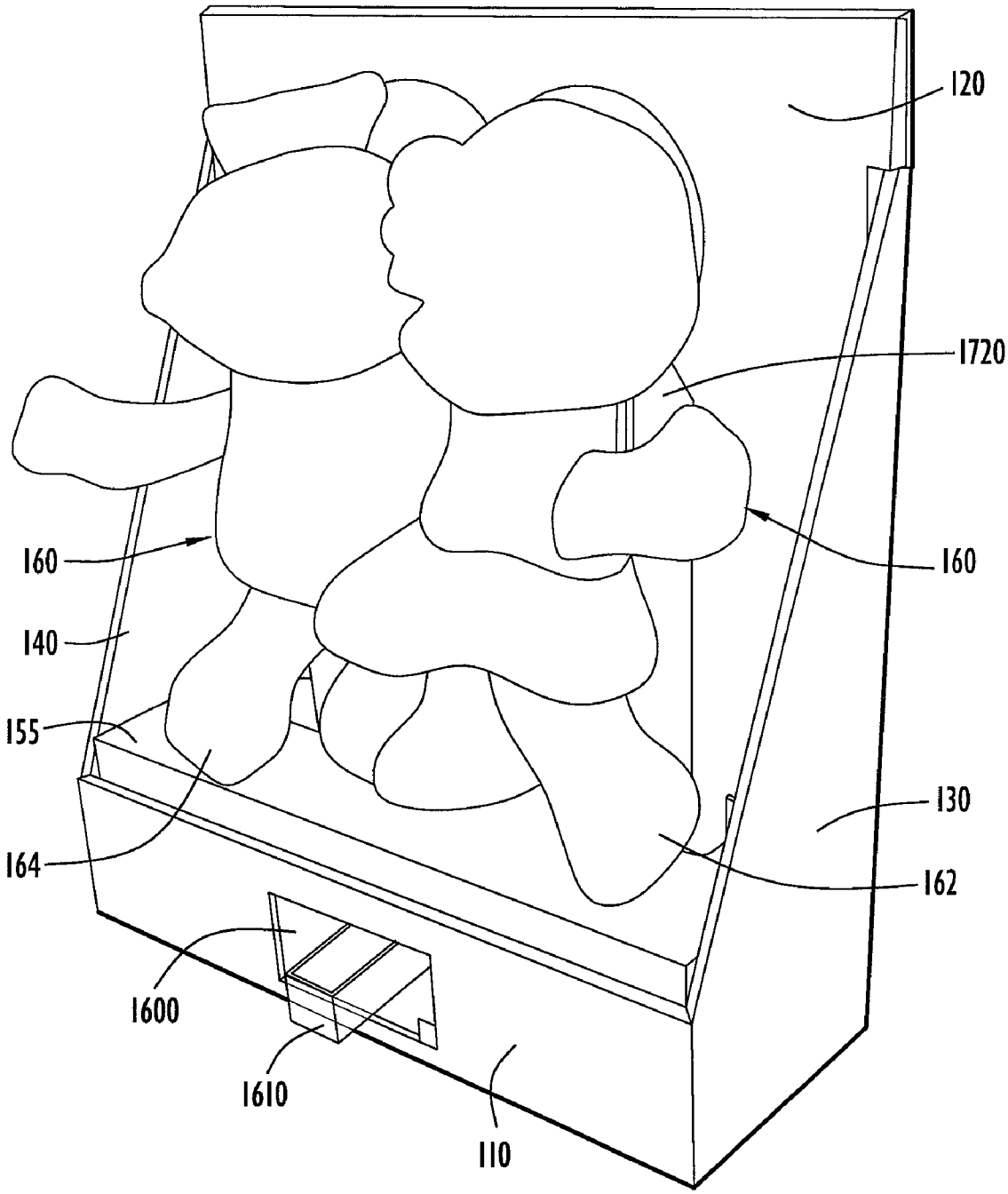
FIGS. 41A and 41B illustrate front perspective views of display packaging in accordance with another embodiment of the invention.
Figure 41B:
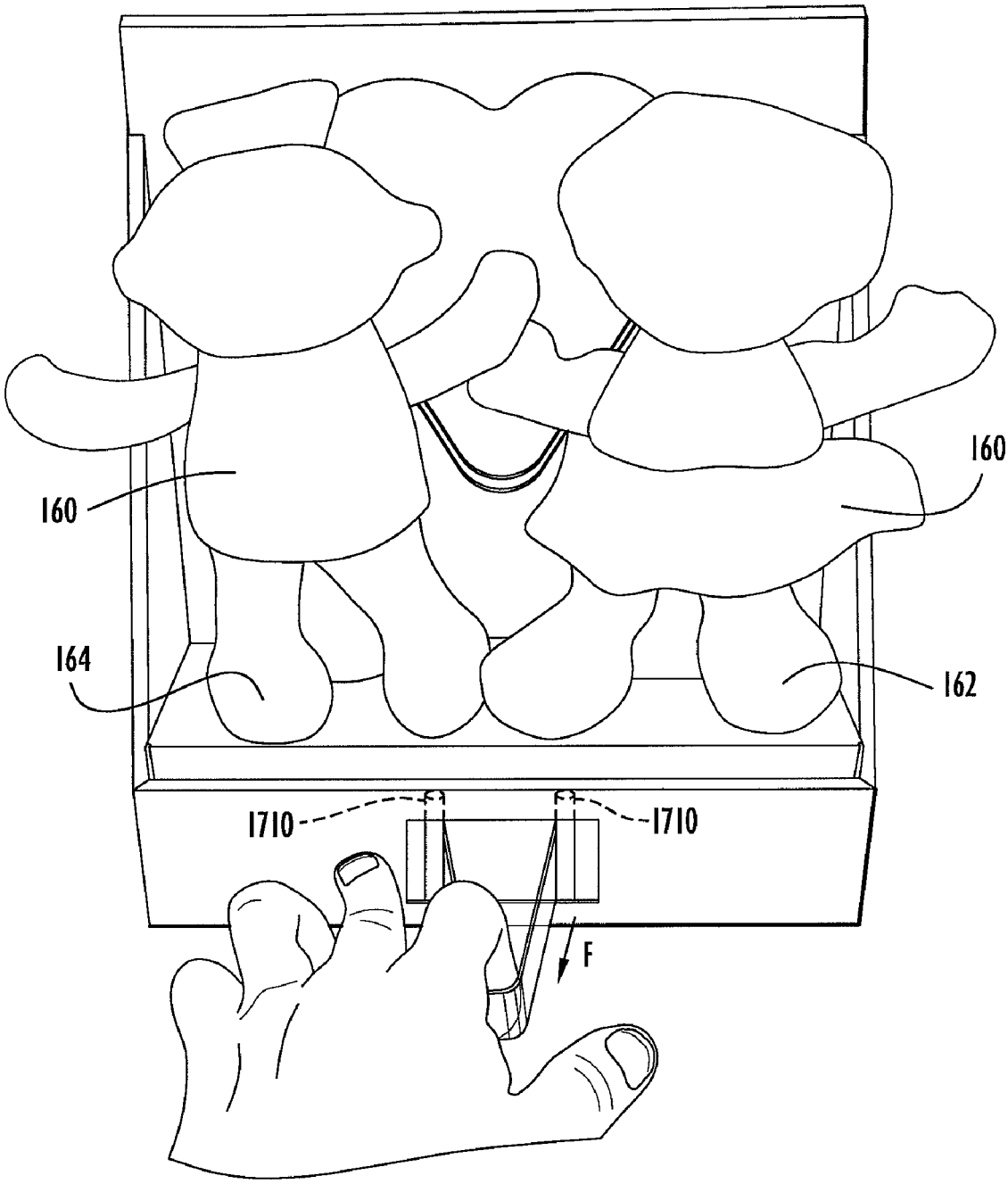

FIGS. 41A and 41B illustrate a display package 100 in accordance with another embodiment of the present invention, showing front perspective views. The display package 100 of FIGS. 41A and 41B may have a general structure generally similar that described above with regard to FIGS. 1A-26B, having a front package portion 110, a rear package portion 120, side package portions 130, 140, and a bottom package portion 150. In addition, the display package may further include a display panel 155 positioned between the first and second side walls 130, 140, as well as between the front 110 and rear 120 package portions. The front package portion 110 may include a slot opening 1600 through which a pull actuator 1610 may be accessed.

The display package 100 of FIGS. 41A and 41B may further contain an animation mechanism 1700 operable to move the toy 160 or a portion thereof 161-166 from a first display position to a second display position, and vice versa. Specifically, the pull actuator 1610 may be connected to first and second posts 1710 mounted to the bottom package portion 150. Each post 1710 communicates with a fin 1720 pivotally mounted to the rear package portion 120 such that as a post 1710 is drawn toward the front package portion 110, the post rotates its associated fin 1720 outward, toward its nearest side package portion 130, 140. A toy 160 may be secured to each post 1720. In addition, a movable portion of each toy 160 may be coupled to the display panel 155 to define a pivot point (e.g., the first movable portion 162 (first leg/foot) of one toy 160 may be coupled the display panel 155, while the third movable portion 164 (second leg/foot) of another toy 160 may be coupled to the display panel 155). Thus, as each fin 1720 pivots outward, each toy 160 is drawn from its first, normal position, to a second position. A biasing member (e.g., a rubber band) may be used to return the posts 1710 (and thus the fins 1720) back to the normal position.

In operation, engaging the pull actuator 1610 (indicated as F in FIG. 41B) draws the posts 1710 toward the front package portion 110, causing each fin 1720 to pivot outward and, in turn, causing each toy 160 to pivot outward within the display package 100. The toys 160 pivot from a first display position (FIG. 41A), in which the toys 160 face each other, to a second display position (FIG. 41B), in which the toys 160 face forward.

With the above described configurations, the animation features of a toy 160 may be demonstrated to a user, while the toy itself is still housed within the display packaging 100. A user need not purchase the toy 160 and remove it from the packaging 100 before assessing whether or not the animation features are attractive to the user.

While the invention has been described in detail and with reference to specific embodiments thereof, it will be apparent to one skilled in the art that various changes and modifications can be made therein without departing from the spirit and scope thereof. For example, the size and shape of the display package 100 is not limited to that illustrated herein. The materials from which the display package 100 of the present invention may be formed include, but are not limited to, conventional paper board, cardboard, flake board, plastic, metal, wood, or any other conventional packaging material.

The animation mechanism of the present invention may be configured to move a portion of the toy 160, or may be configured to reorient the entire toy within the display package 100 (e.g., from a first display position to a second display position). In accordance with the present invention, a display package 100 could include multiple, independent animation mechanisms, such that individual portions of the toy 160 could be individually manipulated. The range of movement of the animation mechanism or toy is not limited to that illustrated herein, and include leg, arm and head motions, as well as cartwheels, somersaults, and spins. The mechanism, moreover, may animate multiple toys within the package by manipulating a single engagement mechanism.

The slots 126 of the present invention may have any dimension suitable for their described purpose, and may be disposed on the display package 100 at any suitable position. For example, the bottom package portion 120 may include a slot 126 configured to repeatedly and reliably guide the motion of the toy 160. An internal animation mechanism within the toy 160 may then pivot the figure in a predetermined pattern (e.g., a 90° pivot), with the slot 126 helping to guide the toy 160 in such motion. The toy 160 may be coupled to other, nonmoving portions of the display package 100 to further secure the toy 160 within the display package and/or create desired movement patterns.

In addition, the slot 126 and/or assembly operable to move the toy 160 or a portion thereof 161-166 from a first display position to a second display position, and vice versa (e.g., the lever assembly, disk assembly, sliding assembly, gear assembly, etc.) may be disposed in any suitable location on the display package 100. By way of example, the assembly operable to move the toy 160 may be located proximate the bottom edge of the rear package portion 120. The slots 126 may be disposed at any suitable location on the display package 100 to allow for any desired engagement (when an engagement member, finger hole, etc. is disposed therein), as well as any desired guide movement (when the slot functions as a guide slot for the movement of the toy 160).

Thus, it is intended that the present invention covers the modifications and variations of this invention provided they come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

I claim:

1. A try-me display package for removably housing a toy figure having an animation feature, the display package comprising:

an enclosure comprising: a rear package portion, a front package portion, and a bottom package portion extending between the rear and front package portions, wherein the package portions define a toy figure housing area;

a toy figure housed within the toy figure housing area of the enclosure, the toy figure having a movable portion that defines an animation feature of the toy figure; and an animation mechanism to engage the animation feature of the toy figure, the animation mechanism comprising:

a movable plate configured to move along the rear package portion from a first plate position to a second plate position, and an actuator configured to selectively move the movable plate from the first plate position to the second plate position, wherein the movable portion of the toy figure is connected to the movable plate such that movement of the plate from the first plate position to the second plate position moves the movable portion of the toy figure from a first display position to a second display position, wherein the toy figure is removable from the display package and the animation mechanism demonstrates the animation feature of the toy figure while the toy figure is housed within the display package.

2. The try-me display package of claim 1, wherein the actuator is mounted to one of the front package portion and the rear package portion.

3. The try-me display package of claim 1, wherein the enclosure further includes a first side package portion and a second side package portion, the side package portions extending from the rear package portion to the front package portion to further define the toy figure housing area.

4. The try-me display package of claim 1, wherein:

the actuator comprises a receptacle configured to receive a finger of a user therein; and movement of the actuator by the finger moves the figure movable portion from the first display position to the second display position.

5. The try-me display package of claim 1, wherein:

the toy figure is housed within the toy housing area of the enclosure such that a user does not have access to the figure; and the actuator is accessible from an exterior of the enclosure to enable a user to reposition the movable portion of the figure while the toy figure is enclosed in the display package.

6. The try-me display package of claim 1, wherein the toy figure comprises a humanoid figure including arms and legs, and wherein the movable portion is at least one of an arm and a leg.

7. The try-me display package of claim 1, wherein:

the actuator comprises a pivoting actuator that is in communication with the movable plate;

the movable plate is configured to translate with respect to the rear package portion; and pivoting the actuator translates the plate along the rear package portion to move the movable portion of the toy figure from the first display position to the second display position.

8. A display package for removably housing a toy figure including an animation feature, the display package comprising:

an enclosure comprising a rear package portion, a front package portion, and a bottom package portion extending between the rear and front package portions, wherein the package portions define a toy housing area;

a toy figure housed within the toy housing area such that the toy is at least partially enclosed by the display package, the toy figure including a moveable portion that defines an animation feature;

a guide slot formed in the enclosure, wherein the guide slot is disposed within the toy housing area, and wherein the guide slot defines a pathway along which the moveable portion of the toy figure travels; and a handle assembly operable to engage the animation feature of the toy figure, the handle assembly comprising:

a handle coupled to the display package, and a plate configured to translate within the enclosure, wherein the handle is operably coupled to the plate such that motion of the handle results in translating motion of the plate, wherein the movable portion of the toy figure is coupled to the plate via the guide slot such that moving the handle from a first handle position to a second handle position moves the movable portion of the toy figure along the pathway defined by the guide slot from a first display to a second display position, wherein the toy is removable from the display package, and wherein handle assembly permits demonstration of the animation feature while the toy figure is housed within the display package.

9. The display package of claim 8, wherein:

the handle assembly further comprises a biasing member operable to bias the plate toward a first plate position, and the plate is disposed in the first plate position when the handle is in the first handle position.

10. The display package of claim 8, wherein:

the guide slot is formed in the rear package portion; and the handle is coupled to the bottom package portion.

11. The display package of claim 8, wherein the guide slot defines a generally linear pathway.

12. The display package of claim 8, wherein:

the movable portion of the toy figure is a first movable portion defining a first animation feature;

the toy figure further includes a second movable portion defining a second animation feature;

the guide slot is a first guide slot defining a first pathway along which the first movable portion travels;

the enclosure includes a second guide slot defining a second pathway along which the second movable portion travels;

the second movable portion is coupled to the plate via the second guide slot; and moving the handle moves the first movable portion along the first pathway and moves the second movable portion along the second pathway to demonstrate the animation features while the toy figure is housed within the display package.

13. The display package of claim 12, wherein the guide slots comprise elongated slots formed into the rear package portion.

14. The display package of claim 12, wherein the guide slots define generally linear pathways.

15. The try-me display package of claim 1, wherein:

the actuator comprises a handle pivotally coupled to the display package;

the display package further comprises a guide slot that defines the pathway of the movable portion; and the movable portion of the toy figure is connected to the movable plate via the guide slot such that driving the movable plate from the first plate position to the second plate position moves the movable portion of the toy figure along the guide slot from the first display position to the second display position.

16. The try-me display package of claim 1 further comprising a biasing member to bias the movable plate toward the first plate position.

17. The try-me display package of claim 16, wherein the biasing member is connected to each of the rear package portion and the movable plate.

18. The try-me display package of claim 1, wherein:

the rear package portion comprises a first wall and a second wall; and the movable plate is slidably captured between the first and second walls of the rear package portion.

19. The try-me display package of claim 1, wherein:

the movable portion of the toy figure is a first movable portion defining a first animation feature;

the toy figure further comprises a second movable portion defining a second animation feature;

the movable portions are connected to the movable plate such that engaging the actuator drives the first and second movable portions of the toy figure from the first display position to the second display position to demonstrate the first and second animation features while the toy is housed within the display package.

20. The try-me display package of claim 1, wherein the toy figure is housed within the toy figure housing area such that the toy is at least partially enclosed by the enclosure.

21. The try-me display package of claim 1, wherein the toy figure possesses a first motion capability within the package and a second motion capability when separated from the display package.

22. The try-me display package of claim 1, wherein the toy figure is a plush toy figure.

23. The display package of claim 8, wherein the display package is a try-me display package that permits the demonstration of the animation feature of the toy figure without compromising the integrity of the display package.

* * * * *